US010036087B2

(12) United States Patent
Na et al.

(10) Patent No.: US 10,036,087 B2
(45) Date of Patent: Jul. 31, 2018

(54) BULK PLATINUM-COPPER-PHOSPHORUS GLASSES BEARING BORON, SILVER, AND GOLD

(71) Applicant: Glassimetal Technology, Inc., Pasadena, CA (US)

(72) Inventors: Jong Hyun Na, Pasadena, CA (US); Marios D. Demetriou, West Hollywood, CA (US); Oscar Abarca, Anaheim, CA (US); Maximilien Launey, Pasadena, CA (US); William L. Johnson, San Marino, CA (US); Glenn Garrett, Pasadena, CA (US); Danielle Duggins, Garden Grove, CA (US); Chase Crewdson, Los Angeles, CA (US); Kyung-Hee Han, Pasadena, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 270 days.

(21) Appl. No.: 14/667,191

(22) Filed: Mar. 24, 2015

(65) Prior Publication Data

US 2015/0267286 A1 Sep. 24, 2015

Related U.S. Application Data

(60) Provisional application No. 61/969,599, filed on Mar. 24, 2014, provisional application No. 61/979,412, (Continued)

(51) Int. Cl.
*C22C 45/00* (2006.01)
*C22C 5/04* (2006.01)

(52) U.S. Cl.
CPC ..... *C22C 45/003* (2013.01); *C22C 5/04* (2013.01); *C22C 45/00* (2013.01)

(58) Field of Classification Search
None
See application file for complete search history.

(56) References Cited

U.S. PATENT DOCUMENTS 4,175,950 A 11/1979 Linares et al.
4,696,731 A 9/1987 Tenhover
(Continued)

FOREIGN PATENT DOCUMENTS

CN 101191184 6/2008
JP 3808354 8/2006

OTHER PUBLICATIONS

Saotome et al., "Characteristic behavior of Pt-based metallic glass under rapid heating and it application to microforming," Materials Science and Engineering A, 2004, vol. 375-377, pp. 389-393.
(Continued)

*Primary Examiner* — George Wyszomierski
(74) *Attorney, Agent, or Firm* — Polsinelli PC

(57) ABSTRACT

The disclosure provides Pt—Cu—P glass-forming alloys bearing at least one of B, Ag, and Au, where each of B, Ag, and Au can contribute to improve the glass forming ability of the alloy in relation to the alloy that is free of these elements. The alloys are capable of forming metallic glass rods with diameters in excess of 3 mm, and in some embodiments 50 mm or larger. The alloys and metallic glasses can satisfy platinum jewelry hallmarks PT750, PT800, PT850, and PT900.

20 Claims, 29 Drawing Sheets

Related U.S. Application Data filed on Apr. 14, 2014, provisional application No. 62/000,579, filed on May 20, 2014, provisional application No. 62/061,758, filed on Oct. 9, 2014, provisional application No. 62/092,636, filed on Dec. 16, 2014, provisional application No. 62/109,385, filed on Jan. 29, 2015.

(56) References Cited

U.S. PATENT DOCUMENTS

| | | | | |
|---|---|---|---|---|
| 4,781,803 | A | 11/1988 | Harris et al. | |
| 5,350,468 | A | 9/1994 | Masumoto et al. | |
| 6,695,936 | B2 | 2/2004 | Johnson | |
| 6,749,698 | B2 | 6/2004 | Shimizu et al. | |
| 7,582,172 | B2 | 9/2009 | Schroers et al. | |
| 8,066,827 | B2 | 11/2011 | Demetriou et al. | |
| 8,361,250 | B2 | 1/2013 | Demetriou et al. | |
| 2006/0157164 | A1 | 7/2006 | Johnson et al. | |
| 2009/0236494 | A1 | 9/2009 | Hata et al. | |
| 2013/0139931 | A1 | 6/2013 | Demetriou et al. | |
| 2013/0306196 | A1* | 11/2013 | Prest | B22D 41/01 148/403 |
| 2014/0009872 | A1 | 1/2014 | Prest et al. | |
| 2014/0096874 | A1* | 4/2014 | Weber | C22C 5/04 148/561 |

OTHER PUBLICATIONS

Biggs, "The Hardening of Platinum Alloys for Potential Jewelry Application," *Platinum Metals Review,* 2005, vol. 49, No. 1, pp. 2-15.

* cited by examiner

BULK PLATINUM-COPPER-PHOSPHORUS GLASSES BEARING BORON, SILVER, AND GOLD

CROSS-REFERENCE TO RELATED APPLICATION(S)

The present application claims the benefit of U.S. Provisional Patent Application No. 61/969,599, entitled "Bulk Platinum-Copper-Phosphorus Glasses Bearing Boron and Silver," filed on Mar. 24, 2014, U.S. Provisional Patent Application No. 61/979,412, entitled "Bulk Platinum-Copper-Phosphorus Glasses Bearing Boron, Silver and Gold, filed on Apr. 14, 2014, U.S. Provisional Patent Application No. 62/000,579, entitled "Bulk Platinum-Copper-Phosphorus Glasses Bearing Boron, Silver and Gold," filed on May 20, 2014, U.S. Provisional Patent Application No. 62/061,758, entitled "Bulk Platinum-Copper-Phosphorus Glasses Bearing Boron, Silver and Gold, filed on Oct. 9, 2014, U.S. Provisional Patent Application No. 62/092,636, entitled "Bulk Platinum-Copper-Phosphorus Glasses Bearing Boron, Silver and Gold, filed on Dec. 16, 2014, and U.S. Provisional Patent Application No. 62/109,385, entitled "Bulk Platinum-Copper-Phosphorus Glasses Bearing Boron, Silver and Gold," filed on Jan. 29, 2015, which are incorporated herein by reference in their entirety.

FIELD

The disclosure is directed to Pt—Cu—P alloys bearing at least one of B, Ag, and Au that are capable of forming metallic glass samples with a lateral dimension greater than 3 mm and as large as 50 mm or larger.

BACKGROUND

U.S. Pat. No. 6,749,698 entitled "Precious Metal Based Amorphous Alloys," the disclosure of which is incorporated herein by reference in its entirety, discloses ternary Pt—Cu—P glass-forming alloys with an optional addition of Pd. The patent does not refer on the possible addition of any of B, Ag, and Au in Pt—Cu—P compositions.

Among other things, U.S. Pat. No. 7,582,172 entitled "Pt-Based Bulk Solidifying Amorphous Alloys," the disclosure of which is incorporated herein by reference in its entirety, discloses the addition of Ni and/or Co at relatively high concentrations in ternary Pt—Cu—P glass-forming alloys. The patent also discloses the optional addition of B, Ag, and Au among many possible additional elements in broad lists of elemental components. The patent does not disclose the optional addition of B, Ag, or Au in alloys that do not contain Ni and/or Co.

U.S. Pat. No. 8,361,250 entitled "Amorphous Platinum-Rich Alloys," the disclosure of which is incorporated herein by reference in its entirety, discloses the addition of Si in ternary Pt—Cu—P alloys where the weight fraction of Pt is at least 0.925. The patent does not disclose lower Pt weight fractions and does not disclose alloys that do not contain Si.

BRIEF SUMMARY

The disclosure provides Pt—Cu—P metallic glass-forming alloys and metallic glasses comprising at least one of B, Ag, and Au with potentially other elements, where B and/or Ag and/or Au contribute to increase the critical rod diameter of the alloy in relation to the alloy free of B and/or Ag and/or Au.

In one embodiment, the disclosure provides a metallic glass-forming alloy or metallic glass that comprises at least Pt, Cu, and P, where the atomic fraction of Pt is in the range of 45 to 75 percent and the weight fraction of Pt does not exceed 91 percent, the atomic fraction of Cu is in the range of 3 to 35 percent, the atomic fraction of P is in the range of 14 to 26. The alloy or metallic glass also comprises at least one additional element selected from the group consisting of Ag, Au, and B where the atomic fraction of each of the at least one additional elements is in the range of 0.05 to 7.5 percent. In some embodiments, the group consisting of Ag, Au, and B has an atomic fraction ranging from 0.1 to 7.5 perfect for least one elements. Among other optional elements, the alloy or metallic glass may also comprise one optional element selected from the group consisting of Ni and Co where the combined atomic fraction of Ni and Co is less than 2 percent. The critical rod diameter of the alloy is at least 3 mm.

In another embodiment, the atomic fraction of Pt is in the range of 45 to 60 percent, the atomic fraction of Cu is in the range of 15 to 35 percent, the atomic fraction of P is in the range of 17 to 24, and wherein the Pt weight fraction is at least 80.0 percent.

In another embodiment, the atomic fraction of Pt is in the range of 50 to 65 percent, the atomic fraction of Cu is in the range of 15 to 30 percent, the atomic fraction of P is in the range of 17 to 24, and wherein the Pt weight fraction is at least 85.0 percent.

In another embodiment, the atomic fraction of Pt is in the range of 55 to 70 percent, the atomic fraction of Cu is in the range of 3 to 25 percent, the atomic fraction of P is in the range of 17 to 24, and wherein the Pt weight fraction is at least 90.0 percent.

In another embodiment, the atomic fraction of Pt is in the range of 45 to 60 percent, the atomic fraction of Cu is in the range of 15 to 35 percent, the atomic fraction of P is in the range of 14 to 24, and wherein the Pt weight fraction is at least 80.0 percent. The alloy or metallic glass also comprises at least one additional element selected from the group consisting of Ag, Au, and B where the atomic fraction of each of the at least one additional elements is in the range of 0.1 to 6 percent.

In another embodiment, the atomic fraction of Pt is in the range of 50 to 65 percent, the atomic fraction of Cu is in the range of 14 to 30 percent, the atomic fraction of P is in the range of 17 to 24, and wherein the Pt weight fraction is at least 85.0 percent. The alloy or metallic glass also comprises at least one additional element selected from the group consisting of Ag, Au, and B where the atomic fraction of each of the at least one additional elements is in the range of 0.1 to 5 percent.

In another embodiment, the atomic fraction of Pt is in the range of 55 to 70 percent, the atomic fraction of Cu is in the range of 3 to 25 percent, the atomic fraction of P is in the range of 17 to 24, and wherein the Pt weight fraction is at least 90.0 percent. The alloy or metallic glass also comprises at least one additional element selected from the group consisting of Ag, Au, and B where the atomic fraction of each of the at least one additional elements is in the range of 0.1 to 6 percent.

In another embodiment, the atomic fraction of Pt is in the range of 57 to 63 percent, the atomic fraction of Cu is in the range of 16 to 23 percent, the atomic fraction of P is in the range of 15 to 25, and wherein the Pt weight fraction is at least 90.0 percent. The alloy or metallic glass also comprises at least one additional element selected from the group consisting of Ag, Au, and B where the atomic fraction of each of the at least one additional elements is in the range of 0.1 to 6 percent.

In another embodiment, the atomic fraction of each of the at least one additional elements selected from the group consisting of Ag, Au, and B is in the range of 0.2 to 5.

In another embodiment, the atomic fraction of each of the at least one additional elements selected from the group consisting of Ag, Au, and B is in the range of 0.25 to 3.

In another embodiment, the disclosure provides a metallic glass-forming alloy or metallic glass that comprises at least Pt, Cu, P and B, where the atomic fraction of Pt is in the range of 45 to 75 percent and the weight fraction of Pt does not exceed 91 percent, the atomic fraction of Cu is in the range of 3 to 35 percent, the atomic fraction of P is in the range of 14 to 24, and the atomic fraction of B is in the range of 0.25 to 6 percent.

In another embodiment, the critical rod diameter of the alloy containing at least B is greater by at least 25% compared to an alloy where the B content is entirely substituted by P.

In another embodiment, the critical rod diameter of the alloy containing at least B is greater by at least 50% compared to an alloy where the B content is entirely substituted by P.

In another embodiment, the critical rod diameter of the alloy containing at least B is greater by at least 75% compared to an alloy where the B content is entirely substituted by P.

In another embodiment, the critical rod diameter of the alloy is at least 5 mm.

In another embodiment, the critical rod diameter of the alloy is at least 6 mm.

In another embodiment, the critical rod diameter of the alloy is at least 9 mm.

In another embodiment, the critical rod diameter of the alloy is at least 10 mm.

In another embodiment, the critical rod diameter of the alloy is at least 13 mm.

In another embodiment, the critical rod diameter of the alloy is at least 17 mm.

In another embodiment, the critical rod diameter of the alloy is at least 25 mm.

In another embodiment, the atomic fraction of B is in the range of 0.25 to 5.

In another embodiment, the atomic fraction of B is in the range of 0.25 to 4.

In another embodiment, the atomic fraction of B is in the range of 0.25 to 3.

In another embodiment, the atomic fraction of B is in the range of 0.25 to 2.

In another embodiment, the atomic fraction of B is in the range of 0.5 to 1.75.

In another embodiment, the atomic fraction of Pt is in the range of 45 to 60 percent, the atomic fraction of Cu is in the range of 15 to 35 percent, the atomic fraction of P is in the range of 17 to 23, and the atomic fraction of B is in the range of 0.25 to 3.

In another embodiment, the atomic fraction of Pt is in the range of 55 to 70 percent, the atomic fraction of Cu is in the range of 3 to 25 percent, the atomic fraction of P is in the range of 17 to 23, and the atomic fraction of B is in the range of 0.25 to 3.

In another embodiment, the atomic fraction of Pt is in the range of 50 to 65 percent, the atomic fraction of Cu is in the range of 15 to 30 percent, the atomic fraction of P is in the range of 17 to 23, and the atomic fraction of B is in the range of 0.25 to 3.

In another embodiment, the atomic fraction of Pt is in the range of 57 to 63 percent, the atomic fraction of Cu is in the range of 16 to 23 percent, the atomic fraction of P is in the range of 17.5 to 22.5, and the atomic fraction of B is in the range of 0.5 to 1.5.

In another embodiment, the combined atomic fraction of P and B is between 18 and 25 percent.

In another embodiment, the combined atomic fraction of P and B is between 19 and 24 percent.

In another embodiment, the combined atomic fraction of P and B is between 19.5 and 23.5 percent.

In another embodiment, the Pt weight fraction is in the range of 74 to 91 percent.

In another embodiment, the Pt weight fraction is in the range of 79 to 86 percent.

In another embodiment, the Pt weight fraction is in the range of 84 to 91 percent.

In another embodiment, the Pt weight fraction is in the range of 84.5 to 86 percent.

In another embodiment, the Pt weight fraction is at least 80.0 percent.

In another embodiment, the Pt weight fraction is at least 85.0 percent.

In another embodiment, the Pt weight fraction is at least 90.0 percent.

In another embodiment, the alloy or metallic glass also comprises at least one of Ni or Co in a combined atomic fraction of less than 2 percent.

In another embodiment, the alloy or metallic glass comprises an amount of Ni and Co in a combined atomic fraction that is the lower of either less than 2 percent of the total atomic fraction of the alloy, or less than 25 percent of the atomic fraction of Cu in the alloy.

In another embodiment, the alloy or metallic glass also comprises Ag in an atomic fraction in the range of up to 7.5 percent.

In another embodiment, the alloy or metallic glass also comprises Ag in an atomic fraction in the range of 0.25 to 5 percent.

In another embodiment, the alloy or metallic glass also comprises Ag in an atomic fraction in the range of 0.25 to 3 percent.

In another embodiment, the alloy or metallic glass also comprises Ag in an atomic fraction in the range of 0.25 to 2.5 percent.

In another embodiment, the alloy or metallic glass also comprises Au in an atomic fraction of up to 5 percent.

In another embodiment, the alloy or metallic glass also comprises Au in an atomic fraction in the range of 0.1 to 3 percent.

In another embodiment, the alloy or metallic glass also comprises Au in an atomic fraction in the range of 0.1 to 2.5 percent.

In another embodiment, the alloy or metallic glass also comprises Au in an atomic fraction in the range of 0.1 to 2 percent.

In another embodiment, the alloy or metallic glass also comprises Au in an atomic fraction in the range of 0.25 to 1.5 percent.

In other embodiments, the disclosure provides a metallic glass-forming alloy or metallic glass that comprises at least Pt, Cu, P and Ag, where the atomic fraction of Pt is in the range of 45 to 75 percent and the weight fraction of Pt does not exceed 91 percent, the atomic fraction of Cu is in the range of 3 to 35 percent, the atomic fraction of P is in the range of 15 to 25, and the atomic fraction of Ag is in the range of 0.25 to 7.5 percent.

In another embodiment, the critical rod diameter of the alloy is greater by at least 25% compared to the alloy where Ag is entirely substituted by Cu and/or Pt.

In another embodiment, the critical rod diameter of the alloy is greater by at least 50% compared to the alloy where Ag is entirely substituted by Cu and/or Pt.

In another embodiment, the critical rod diameter of the alloy is greater by at least 75% compared to the alloy where Ag is entirely substituted by Cu and/or Pt.

In another embodiment, the critical rod diameter of the alloy is at least 5 mm.

In another embodiment, the critical rod diameter of the alloy is at least 6 mm.

In another embodiment, the critical rod diameter of the alloy is at least 9 mm.

In another embodiment, the critical rod diameter of the alloy is at least 10 mm.

In another embodiment, the critical rod diameter of the alloy is at least 13 mm.

In another embodiment, the critical rod diameter of the alloy is at least 17 mm.

In another embodiment, the critical rod diameter of the alloy is at least 25 mm.

In another embodiment, the atomic fraction of Ag is in the range of 0.25 to 5.

In another embodiment, the atomic fraction of Ag is the range of 0.25 to 3.

In another embodiment, the atomic fraction of Ag is the range of 0.25 to 2.5.

In another embodiment, the atomic fraction of Pt is in the range of 45 to 60 percent, the atomic fraction of Cu is in the range of 15 to 35 percent, the atomic fraction of P is in the range of 18 to 24, and the atomic fraction of Ag is in the range of 0.25 to 4.

In another embodiment, the atomic fraction of Pt is in the range of 55 to 70 percent, the atomic fraction of Cu is in the range of 3 to 25 percent, the atomic fraction of P is in the range of 18 to 24, and the atomic fraction of Ag is in the range of 0.25 to 4.

In another embodiment, the atomic fraction of Pt is in the range of 50 to 65 percent, the atomic fraction of Cu is in the range of 15 to 30 percent, the atomic fraction of P is in the range of 18 to 24, and the atomic fraction of Ag is in the range of 0.25 to 3.

In another embodiment, the atomic fraction of Pt is in the range of 57 to 63 percent, the atomic fraction of Cu is in the range of 16 to 23 percent, the atomic fraction of P is in the range of 19 to 23, and the atomic fraction of Ag is in the range of 0.25 to 2.5.

In another embodiment, the Pt weight fraction is in the range of 74 to 91 percent.

In another embodiment, the Pt weight fraction is in the range of 79 to 86 percent.

In another embodiment, the Pt weight fraction is in the range of 84 to 91 percent.

In another embodiment, the Pt weight fraction is in the range of 84.5 to 86 percent.

In another embodiment, the Pt weight fraction is at least 80.0 percent.

In another embodiment, the Pt weight fraction is at least 85.0 percent.

In another embodiment, the Pt weight fraction is at least 90.0 percent.

In another embodiment, the alloy or metallic glass also comprises at least one of Ni or Co in a combined atomic fraction of less than 2 percent.

In another embodiment, the alloy or metallic glass also comprises at least one of Ni and Co in a combined atomic fraction of either less than 2 percent, or less than 25 percent of the Cu atomic fraction, whichever is lower.

In another embodiment, the alloy or metallic glass also comprises B in an atomic fraction of up to 6 percent.

In another embodiment, the alloy or metallic glass also comprises B in an atomic fraction in the range of 0.25 to 5 percent.

In another embodiment, the alloy or metallic glass also comprises B in an atomic fraction in the range of 0.25 to 4 percent.

In another embodiment, the alloy or metallic glass also comprises B in an atomic fraction in the range of 0.25 to 3 percent.

In another embodiment, the alloy or metallic glass also comprises B in an atomic fraction in the range of 0.25 to 2 percent.

In another embodiment, the alloy or metallic glass also comprises B in an atomic fraction in the range of 0.5 to 1.75 percent.

In another embodiment, the alloy or metallic glass also comprises Au in an atomic fraction of up to 5 percent.

In another embodiment, the alloy or metallic glass also comprises Au in an atomic fraction in the range of 0.1 to 3 percent.

In another embodiment, the alloy or metallic glass also comprises Au in an atomic fraction in the range of 0.1 to 2.5 percent.

In another embodiment, the alloy or metallic glass also comprises Au in an atomic fraction in the range of 0.1 to 2 percent.

In another embodiment, the alloy or metallic glass also comprises Au in an atomic fraction in the range of 0.25 to 1.5 percent.

In other embodiments, the disclosure provides a metallic glass-forming alloy or metallic glass that comprises at least Pt, Cu, P and Au, where the atomic fraction of Pt is in the range of 45 to 75 percent and the weight fraction of Pt does not exceed 91 percent, the atomic fraction of Cu is in the range of 3 to 35 percent, the atomic fraction of P is in the range of 15 to 25, and the atomic fraction of Au is in the range of 0.05 to 5 percent.

In another embodiment, the critical rod diameter of the alloy is greater by at least 25% compared to the alloy where Au is entirely substituted by Cu and/or Pt.

In another embodiment, the critical rod diameter of the alloy is greater by at least 50% compared to the alloy where Au is entirely substituted by Cu and/or Pt.

In another embodiment, the critical rod diameter of the alloy is greater by at least 75% compared to the alloy where Au is entirely substituted by Cu and/or Pt.

In another embodiment, the critical rod diameter of the alloy is at least 5 mm.

In another embodiment, the critical rod diameter of the alloy is at least 6 mm.

In another embodiment, the critical rod diameter of the alloy is at least 9 mm.

In another embodiment, the critical rod diameter of the alloy is at least 10 mm.

In another embodiment, the critical rod diameter of the alloy is at least 13 mm.

In another embodiment, the critical rod diameter of the alloy is at least 17 mm.

In another embodiment, the critical rod diameter of the alloy is at least 25 mm.

In another embodiment, the atomic fraction of Au is in the range of 0.1 to 3.

In another embodiment, the atomic fraction of Au is in the range of 0.1 to 2.5.

In another embodiment, the atomic fraction of Au is in the range of 0.1 to 2.

In another embodiment, the atomic fraction of Au is in the range of 0.25 to 1.5.

In another embodiment, the atomic fraction of Pt is in the range of 45 to 60 percent, the atomic fraction of Cu is in the range of 15 to 35 percent, the atomic fraction of P is in the range of 18 to 24, and the atomic fraction of Au is in the range of 0.1 to 2.5.

In another embodiment, the atomic fraction of Pt is in the range of 55 to 70 percent, the atomic fraction of Cu is in the range of 3 to 25 percent, the atomic fraction of P is in the range of 18 to 24, and the atomic fraction of Au is in the range of 0.1 to 2.5.

In another embodiment, the atomic fraction of Pt is in the range of 50 to 65 percent, the atomic fraction of Cu is in the range of 15 to 30 percent, the atomic fraction of P is in the range of 18 to 24, and the atomic fraction of Au is in the range of 0.1 to 2.

In another embodiment, the atomic fraction of Pt is in the range of 57 to 63 percent, the atomic fraction of Cu is in the range of 16 to 23 percent, the atomic fraction of P is in the range of 19 to 23, and the atomic fraction of Ag is in the range of 0.25 to 1.75.

In another embodiment, the Pt weight fraction is in the range of 74 to 91 percent.

In another embodiment, the Pt weight fraction is in the range of 79 to 86 percent.

In another embodiment, the Pt weight fraction is in the range of 84 to 91 percent.

In another embodiment, the Pt weight fraction is in the range of 84.5 to 86 percent.

In another embodiment, the Pt weight fraction is at least 80.0 percent.

In another embodiment, the Pt weight fraction is at least 85.0 percent.

In another embodiment, the Pt weight fraction is at least 90.0 percent.

In another embodiment, the alloy or metallic glass also comprises at least one of Ni or Co in a combined atomic fraction of less than 2 percent.

In another embodiment, the alloy or metallic glass also comprises at least one of Ni and Co in a combined atomic fraction of either less than 2 percent, or less than 25 percent of the Cu atomic fraction, whichever is lower.

In another embodiment, the alloy or metallic glass also comprises B in an atomic fraction of up to 6 percent.

In another embodiment, the alloy or metallic glass also comprises B in an atomic fraction in the range of 0.25 to 5 percent.

In another embodiment, the alloy or metallic glass also comprises B in an atomic fraction in the range of 0.25 to 4 percent.

In another embodiment, the alloy or metallic glass also comprises B in an atomic fraction in the range of 0.25 to 3 percent.

In another embodiment, the alloy or metallic glass also comprises B in an atomic fraction in the range of 0.5 to 2 percent.

In another embodiment, the alloy or metallic glass also comprises B in an atomic fraction in the range of 0.75 to 1.75 percent.

In another embodiment, the alloy or metallic glass also comprises Ag in an atomic fraction of up to 7.5 percent.

In another embodiment, the alloy or metallic glass also comprises Ag in an atomic fraction in the range of 0.25 to 5 percent.

In another embodiment, the alloy or metallic glass also comprises Ag in an atomic fraction in the range of 0.25 to 4 percent.

In another embodiment, the alloy or metallic glass also comprises Ag in an atomic fraction in the range of 0.25 to 3 percent.

In another embodiment, the alloy or metallic glass also comprises Ag in an atomic fraction in the range of 0.25 to 2.5 percent.

In another embodiment, the disclosure is directed to an alloy capable of forming a metallic glass or metallic glass having a composition represented by the following formula (subscripts denote atomic percentages):

$$Pt_{(100-a-b-c-d-e)}Cu_aAg_bAu_cP_dB_e$$

where:

a ranges from 3 to 35;

b is up to 7.5;

c is up to 7.5;

d ranges from 14 to 26;

e is up to 7.5;

wherein at least one of b, c, and e is at least 0.05;

wherein the Pt weight fraction is between 74 and 91 percent; and wherein the critical rod diameter of the alloy is at least 3 mm.

In another embodiment, at least one of b, c, and e is at least 0.1.

In another embodiment, a ranges from 16 to 23, d ranges from 19 to 23, e ranges from 0.25 to 3, wherein the Pt weight fraction is at least 85.0. In some embodiments in these ranges, the critical rod diameter of the alloy is at least 10 mm.

In another embodiment, the sum of d and e ranges from 19 to 24.

In another embodiment, a ranges from 19.5 to 21.5, d ranges from 20 to 22, e ranges from 1 to 1.5, wherein the Pt weight fraction is at least 85.0. In some embodiments in these ranges, the critical plate thickness of the alloy is at least 8 mm.

In another embodiment, a ranges from 20 to 21, d ranges from 20.4 to 21.4, e ranges from 1.05 to 1.25, wherein the Pt weight fraction is at least 85.0. In some embodiments in these ranges, the critical plate thickness of the alloy is at least 9 mm.

In another embodiment, a ranges from 16 to 23, b ranges from 0.1 to 5, d ranges from 19 to 23, e ranges from 0.25 to 3, wherein the Pt weight fraction is at least 85.0. In some embodiments in these ranges, the critical rod diameter of the alloy is at least 15 mm.

In another embodiment, a ranges from 17 to 21, b ranges from 0.5 to 2, d ranges from 19 to 23, e ranges from 0.5 to 2, wherein the Pt weight fraction is at least 85.0. In some embodiments in these ranges, the critical rod diameter of the alloy is at least 20 mm.

In another embodiment, a ranges from 13 to 23, b ranges from 0.1 to 6, d ranges from 20 to 25, wherein the Pt weight fraction is at least 85.0. In some embodiments in these ranges, the critical rod diameter of the alloy is at least 10 mm.

In another embodiment, a ranges from 4 to 13, b ranges from 0.1 to 4, d ranges from 20 to 25, and wherein the Pt weight fraction is at least 90.0. In some embodiments in these ranges, the critical rod diameter of the alloy is at least 5 mm.

In another embodiment, a ranges from 16 to 23, c ranges from 0.1 to 2.5, d ranges from 20 to 25, wherein the Pt weight fraction is at least 85.0. In some embodiments in these ranges, the critical rod diameter of the alloy is at least 10 mm.

In other embodiments, the disclosure provides an alloy or a metallic glass having a composition represented by the following formula (subscripts denote atomic percentages):

$$Pt_{(100-a-b-c-d-e)}Cu_aAg_bAu_cP_dB_e \quad \text{EQ. (1)}$$

where:

a ranges from 3 to 35;

b is up to 7.5;

c is up to 3;

d ranges from 17 to 25;

e ranges from 0.25 to 5;

and wherein the Pt weight fraction is between 74 and 91 percent.

In other embodiments, an alloy or metallic glass has a composition representation by the EQ. 1, where a ranges from 5 to 30; d ranges from 14 to 24; e ranges from 0.25 to 6; and the atomic percent of Pt ranges from 45 to 75.

In other embodiments, an alloy or metallic glass has a composition representation by the EQ. 1, where a ranges from 5 to 30; b ranges from 0.25 to 7.5; d ranges from 15 to 25; and the atomic percent of Pt ranges from 45 to 75.

In other embodiments, an alloy or metallic glass has a composition representation by the EQ. 1, where a ranges from 5 to 35; c ranges from 0.1 to 5; d ranges from 15 to 25; and the atomic percent of Pt ranges from 45 to 75.

In other embodiments, the disclosure provides an alloy or a metallic glass having a composition represented by the following formula (subscripts denote atomic percentages):

$$Pt_{(100-a-b-c-d-e)}Cu_aAg_bAu_cP_dB_e \quad \text{EQ. (1)}$$

where:

a ranges from 3 to 35 b ranges from 0.25 to 7.5 c is up to 3 d ranges from 17 to 25 e is up to 5 and wherein the Pt weight fraction is between 74 and 91 percent.

In other embodiments, the disclosure provides an alloy or a metallic glass having a composition represented by the following formula (subscripts denote atomic percentages):

$$Pt_{(100-a-b-c-d-e)}Cu_aAg_bAu_cP_dB_e \quad \text{EQ. (1)}$$

where:

a ranges from 3 to 35;

b is up to 7.5;

c ranges from 0.05 to 3;

d ranges from 17 to 25;

e is up to 5;

and wherein the Pt weight fraction is between 74 and 91 percent.

In another embodiment of the alloy or metallic glass, a ranges from 12 to 28.

In another embodiment of the alloy or metallic glass, a ranges from 16 to 23.

In another embodiment of the alloy or metallic glass, b ranges from 0.25 to 5.

In another embodiment of the alloy or metallic glass, b ranges from 0.25 to 4.

In another embodiment of the alloy or metallic glass, b ranges from 0.25 to 2.5.

In another embodiment of the alloy or metallic glass, c ranges from 0.1 to 2.5.

In another embodiment of the alloy or metallic glass, c ranges from 0.1 to 2.

In another embodiment of the alloy or metallic glass, c ranges from 0.2 to 1.75.

In another embodiment of the alloy or metallic glass, c ranges from 0.25 to 1.5.

In another embodiment of the alloy or metallic glass, d ranges from 19 to 23.

In another embodiment of the alloy or metallic glass, d ranges from 19.5 to 22.5.

In another embodiment of the alloy or metallic glass, e ranges from 0.25 to 4.

In another embodiment of the alloy or metallic glass, e ranges from 0.25 to 3.

In another embodiment of the alloy or metallic glass, e ranges from 0.25 to 2.

In another embodiment of the alloy or metallic glass, e ranges from 0.5 to 1.75.

In another embodiment of the alloy or metallic glass, the sum of d and e ranges from 19 to 24.

In another embodiment of the alloy or metallic glass, the sum of d and e ranges from 19.5 to 23.5.

In another embodiment of the alloy or metallic glass, the alloy or metallic glass also comprises at least one of Pd, Rh, and Ir, each in an atomic fraction of up to 5 percent.

In another embodiment of the alloy or metallic glass, the alloy or metallic glass also comprises at least one of Si, Ge, and Sb, each in an atomic fraction of up to 3 percent.

In another embodiment of the alloy or metallic glass, the alloy or metallic glass also comprises at least one of Ni and Co in a combined atomic fraction of less than 2 percent.

In another embodiment, the alloy or metallic glass also comprises at least one of Ni and Co in a combined atomic fraction of either less than 2 percent, or less than 25 percent of the Cu atomic fraction, whichever is lower.

In another embodiment of the alloy or metallic glass, the alloy or metallic glass also comprises at least one of Sn, Zn, Fe, Ru, Cr, Mo, and Mn, each in an atomic fraction of up to 3 percent.

In another embodiment, the Pt weight fraction is in the range of 74 to 91 percent.

In another embodiment, the Pt weight fraction is in the range of 79 to 86 percent.

In another embodiment, the Pt weight fraction is in the range of 84 to 91 percent.

In another embodiment, the Pt weight fraction is in the range of 84.5 to 86 percent.

In another embodiment, the Pt weight fraction is at least 80.0 percent.

In another embodiment, the Pt weight fraction is at least 85.0 percent.

In another embodiment, the Pt weight fraction is at least 90.0 percent.

In yet another embodiment of the alloy or metallic glass, the melt of the alloy is fluxed with a reducing agent prior to rapid quenching.

In yet another embodiment of the alloy or metallic glass, the reducing agent is boron oxide.

In yet another embodiment of the alloy or metallic glass, the temperature of the melt prior to quenching is at least 100° C. above the liquidus temperature of the alloy.

In yet another embodiment of the alloy or metallic glass, the temperature of the melt prior to quenching is at least 700° C.

In another embodiment, the disclosure provides a metallic glass-forming alloy or metallic glass that comprises Pt, Cu, P and B, where the weight fraction of Pt does not exceed 85.5 percent, the atomic fraction of Cu is in the range of 19.5 to 21.5 percent, the atomic fraction of P is in the range of 20 to 22, and the atomic fraction of B is in the range of 1 to 1.5 percent, and wherein the critical plate thickness is at least 8 mm.

In another embodiment, the disclosure provides a metallic glass-forming alloy or a metallic glass that comprises Pt, Cu, P and B, where the weight fraction of Pt does not exceed 85.25 percent, the atomic fraction of Cu is in the range of 20 to 21 percent, the atomic fraction of P is in the range of 20.4 to 21.4, and the atomic fraction of B is in the range of 1.05 to 1.25 percent, and wherein the critical plate thickness is at least 9 mm.

In another embodiment, the disclosure provides a metallic glass-forming alloy or a metallic glass that comprises Pt, Cu, P and B, where the weight fraction of Pt does not exceed 85.2 percent, the atomic fraction of Cu is in the range of 20.2 to 20.7 percent, the atomic fraction of P is in the range of 20.65 to 21.15, and the atomic fraction of B is in the range of 1.1 to 1.2 percent, and wherein the critical plate thickness is at least 10 mm.

The disclosure is also directed to an alloy or a metallic glass having compositions selected from a group consisting of: $Pt_{60}Cu_{20}P_{19.5}B_{0.5}$, $Pt_{60}Cu_{20}P_{19}B_1$, $Pt_{60}Cu_{20}P_{18.5}B_{1.5}$, $Pt_{58}Cu_{22}P_{19}B_1$, $Pt_{55}Cu_{25}P_{19}B_1$, $Pt_{53}Cu_{27}P_{19}B_1$, $Pt_{50}Cu_{30}P_{19}B_1$, $Pt_{58.4}Cu_{22.6}P_{18}B_1$, $Pt_{58.2}Cu_{22.3}P_{18.5}B_1$, $Pt_{57.85}Cu_{21.65}P_{19.5}B_1$, $Pt_{57.7}Cu_{21.3}P_{20}B_1$, $Pt_{57.5}Cu_{21}P_{20.5}B_1$, $Pt_{57.35}Cu_{20.65}P_{21}B_1$, $Pt_{57.2}Cu_{20.3}P_{21.5}B_1$, $Pt_{57}Cu_{20}P_{22}B_1$, $Pt_{58.7}Cu_{20.3}Ag_1P_{20}$, $Pt_{59.15}Cu_{18.85}Ag_2P_{20}$, $Pt_{66.9}Cu_{8.1}Ag_2P_{23}$, $Pt_{58.5875}Cu_{21.1625}Au_{0.25}P_{20}$, $Pt_{58.925}Cu_{20.575}Au_{0.5}P_{20}$, $Pt_{59.2625}Cu_{19.9875}Au_{0.75}P_{20}$, $Pt_{59.6}Cu_{19.4}Au_1P_{20}$, $Pt_{60.95}Cu_{17.05}Au_2P_{20}$, $Pt_{58.45}Cu_{20.55}Ag_1P_{19}B_1$, $Pt_{58.7}Cu_{19.8}Ag_{1.5}P_{19}B_1$, $Pt_{58.9}Cu_{19.1}Ag_2P_{19}B_1$, $Pt_{59.125}Cu_{18.375}Ag_{2.5}P_{19}B_1$, $Pt_{58.3}Cu_{20.2}Ag_1P_{19.5}B_1$, $Pt_{58.7}Cu_{20.8}Au_{0.5}P_{19}B_1$, $Pt_{59.15}Cu_{19.35}Ag_1Au_{0.5}P_{19}B_1$, $Pt_{57.55}Cu_{20.45}P_{20.9}B_{1.1}$, $Pt_{57.5}Cu_{20.45}P_{20.9}B_{1.15}$, $Pt_{57.5}Cu_{20.5}P_{20.8}B_{1.2}$, $Pt_{57.5}Cu_{20.5}P_{20.7}B_{1.3}$, $Pt_{57.5}Cu_{20.5}P_{20.6}B_{1.4}$, $Pt_{57.5}Cu_{20.5}P_{20.5}B_{1.5}$, $Pt_{57.95}Cu_{19}Ag_1P_{20.9}B_{1.15}$, $Pt_{57.8}Cu_{19.2}Ag_1P_{20.6}B_{1.4}$, $Pt_{57.9}Cu_{18.9}Ag_{1.2}P_{20.6}B_{1.4}$, $Pt_{58.6}Cu_{20.4}Ag_1P_{19.5}B_{0.5}$, $Pt_{58}Cu_{19}Ag_1P_{21.5}B_{0.5}$, $Pt_{52.5}Cu_{27}P_{19.5}B_1$, $Pt_{52.5}Cu_{26}Ag_1P_{19.5}B_1$, $Pt_{52.5}Cu_{25}Ag_2P_{19.5}B_1$, $Pt_{53}Cu_{26}Ag_1P_{19}B_1$, and $Pt_{53}Cu_{25}Ag_2P_{19}B_1$.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
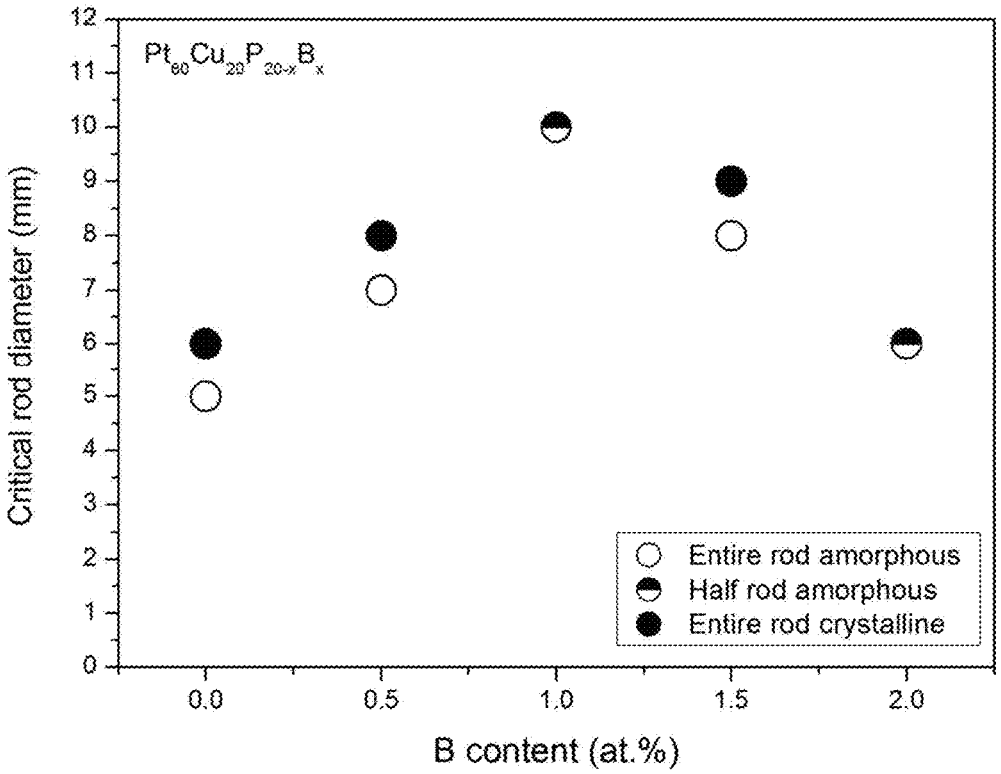
FIG. 1 provides a data plot showing the effect of varying the atomic fraction of B on the glass forming ability of $Pt_{60}Cu_{20}P_{20-x}B_x$ alloys for $0 \le x \le 2$.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to Pt—Cu—P based metallic glass forming alloys and metallic glasses comprising at least one of B, Ag, Au, or combinations thereof.

Pt-based jewelry alloys typically contain Pt at weight fractions of less than 100%. Hallmarks are used by the jewelry industry to indicate the Pt metal content, or fineness, of a jewelry article by way of a mark, or marks, stamped, impressed, or struck on the metal. These marks may also be referred to as quality or purity marks. Although the Pt content associated with a hallmark varies from country to country, Pt weight fractions of about 75.0% (PT750), 80.0% (PT800), 85.0% (PT850), 90.0% (PT900), and 95.0% (PT950) are commonly used hallmarks in platinum jewelry. In certain embodiments, this disclosure is directed to glass-forming Pt-based alloys or metallic glasses that satisfy the PT750, PT800, PT850, and PT900 hallmarks. Hence, in such embodiments, the Pt weight fraction does not exceed 91 percent, or alternatively it ranges from 74 to 91 percent. In other embodiments, this disclosure is directed to glass-forming Pt-based alloys and metallic glasses that satisfy the PT850 and PT900 hallmarks. Hence, in such embodiments the Pt weight fraction ranges from 84 to 91 percent. In yet other embodiments, this disclosure is directed to glass-forming Pt-based alloys or metallic glasses that satisfy the PT850 hallmark. Hence, in such embodiments the Pt weight fraction ranges from 84 to 87 percent. In yet other embodiments, this disclosure is directed to glass-forming Pt-based alloys or metallic glasses that satisfy the PT900 hallmark. Hence, in such embodiments the Pt weight fraction ranges from 89 to 91 percent. In yet other embodiments, this disclosure is directed to glass-forming Pt-based alloys and metallic glasses that satisfy the PT800 and PT850 hallmarks. Hence, in such embodiments the Pt weight fraction ranges from 79 to 86 percent.

In accordance with the provided disclosure and drawings, Pt—Cu—P glass-forming alloys and metallic glasses bearing at least one of B, Ag, and Au are provided, where B, Ag, and Au contribute to improve the glass forming ability of the alloy in relation to the Pt—Cu—P alloy free of B, Ag, and Au.

In one embodiment of the disclosure, the glass-forming ability of each alloy is/can be quantified by the "critical rod diameter," defined as the largest rod diameter in which the amorphous phase can be formed when processed by a method of water quenching a quartz tube having 0.5 mm thick walls containing a molten alloy.

In another embodiment of the disclosure, the glass-forming ability of each alloy is quantified by the "critical plate thickness," defined as the largest plate thickness in which the amorphous phase can be formed when processed by a method of casting the molten alloy in a copper mold having a rectangular cavity.

Description of B-Bearing Pt—Cu—P Alloys and Metallic Glass Compositions

In one embodiment, the disclosure provides a metallic glass-forming alloy, or a metallic glass, that comprises at least Pt, Cu, P and B, where the weight fraction of Pt does not exceed 91 percent and the atomic fraction of Pt is in the range of 45 to 75 percent, the atomic fraction of Cu is in the range of 3 to 35 percent, the atomic fraction of P is in the range of 14 to 24, and the atomic fraction of B is in the range of 0.25 to 6. In further embodiments, the atomic fraction of Cu is in the range of 5 to 30 percent.

Specific embodiments of metallic glasses formed of alloys with compositions according to the formula $Pt_{60}Cu_{20}P_{20-x}B_x$ with Pt weight fraction of at least 85.0 percent satisfying the PT850 hallmark, are presented in Table 1. The critical rod diameters of the example alloys along with the Pt weight percentage are also listed in Table 1. FIG. 1 shows a data plot illustrating the effect of varying the B atomic fraction x on the glass forming ability of the alloys according to the composition formula $Pt_{60}Cu_{20}P_{20-x}B_x$. The atomic fraction x of B was increased with a corresponding decrease in the atomic faction of P.

TABLE 1

Sample metallic glasses demonstrating the effect of increasing the B atomic concentration with an accompanying reduction in the atomic concentration of P on the glass forming ability, glass-transition, crystallization, solidus, and liquidus temperatures of the $Pt_{60}Cu_{20}P_{20-x}B_x$ alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 1 | $Pt_{60}Cu_{20}P_{20}$ | 86.10 | 5 | 233.9 | 291.4 | 545.9 | 584.3 |
| 2 | $Pt_{60}Cu_{20}P_{19.5}B_{0.5}$ | 86.16 | 7 | 233.9 | 295.5 | 545.1 | 571.2 |
| 3 | $Pt_{60}Cu_{20}P_{19}B_1$ | 86.22 | 10 | 235.0 | 272.8 | 541.6 | 578.3 |
| 4 | $Pt_{60}Cu_{20}P_{18.5}B_{1.5}$ | 86.29 | 8 | 238.2 | 267.1 | 541.7 | 612.8 |
| 5 | $Pt_{60}Cu_{20}P_{18}B_2$ | 86.35 | 6 | 236.9 | 264.2 | 542.0 | 630.0 |

As shown in Table 1 and FIG. 1, substituting very small fractions of P with B according to $Pt_{60}Cu_{20}P_{20-x}B_x$ results in an enhancement of glass forming ability. For example, the critical rod diameter increases from 5 mm for the B-free alloy (Example 1) to 10 mm for the alloy containing 1 atomic percent B (Example 3), and then decreases again back to 6 mm for alloys containing 2 atomic percent B (Example 5). Hence, substituting 0.5 atomic percent of P with B increases the critical rod diameter by about 40%, 1 atomic percent substitution increases the critical rod diameter by about 100%, 1.5 atomic percent substitution increases the critical rod diameter by about 60%, and 2 atomic percent substitution increases the critical rod diameter by about 20%.

Figure 2:
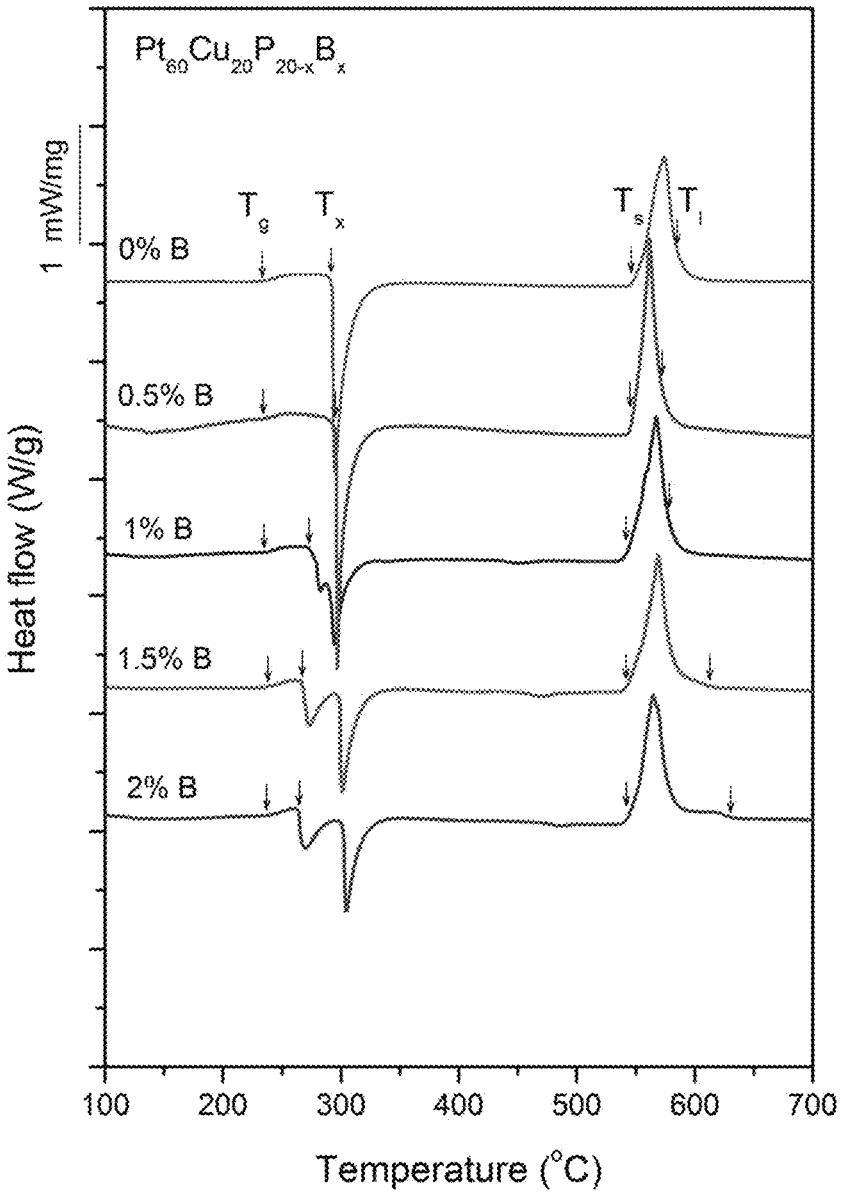
FIG. 2 provides calorimetry scans for sample metallic glasses $Pt_{60}Cu_{20}P_{20-x}B_x$ in accordance with embodiments of the disclosure. The glass transition temperature $T_g$, crystallization temperature $T_x$, solidus temperature $T_s$, and liquidus temperature $T_l$ are indicated by arrows.

FIG. 2 provides calorimetry scans for sample metallic glasses $Pt_{60}Cu_{20}P_{20-x}B_x$ in accordance with embodiments of the disclosure. The glass transition temperature $T_g$, crystallization temperature $T_x$, solidus temperature $T_s$, and liquidus temperature $T_l$ are indicated by arrows in FIG. 2, and are listed in Table 1. As seen in FIG. 2 and Table 1, $T_g$ increases from 233.9 to 238.2° C. by increasing the B atomic fraction from 0 to 1.5 percent, while it decreases back to 236.9° C. when the B atomic fraction increases to 2 percent. On the other hand, $T_l$ decreases significantly from 585.3 to 571.2° C. by increasing the B fraction from 0 to 0.5 percent, slightly increases to 578.3° C. when the B atomic fraction is 1 atomic percent, and then increases significantly to 630° C. as the atomic fraction of B is increased from 1 to 2 atomic percent. Increasing $T_g$ while decreasing $T_l$, that is, increasing the ratio $T_g/T_o$ (in units of Kelvin) known as the "reduced glass transition", is expected to improve glass forming ability. In the alloys depicted in Table 1, the reduced glass transition appears to be maximized around 1 atomic percent B, where the glass forming ability is seen to peak. The solidus temperature $T_s$ remains roughly unchanged with increasing the atomic fraction of B. $T_s$ and $T_l$ remain fairly close to each other as the atomic fraction of B increases from 0 to 2 percent, which suggests that including B in a Pt—Cu—P alloy does not disrupt the near-eutectic crystal structure of Pt—Cu—P. The crystallization temperature $T_x$ is shown to slightly increase with increasing the atomic fraction of B from 0 to 0.5, and then monotonically decrease as the atomic fraction of B is increased further.

Figure 3:
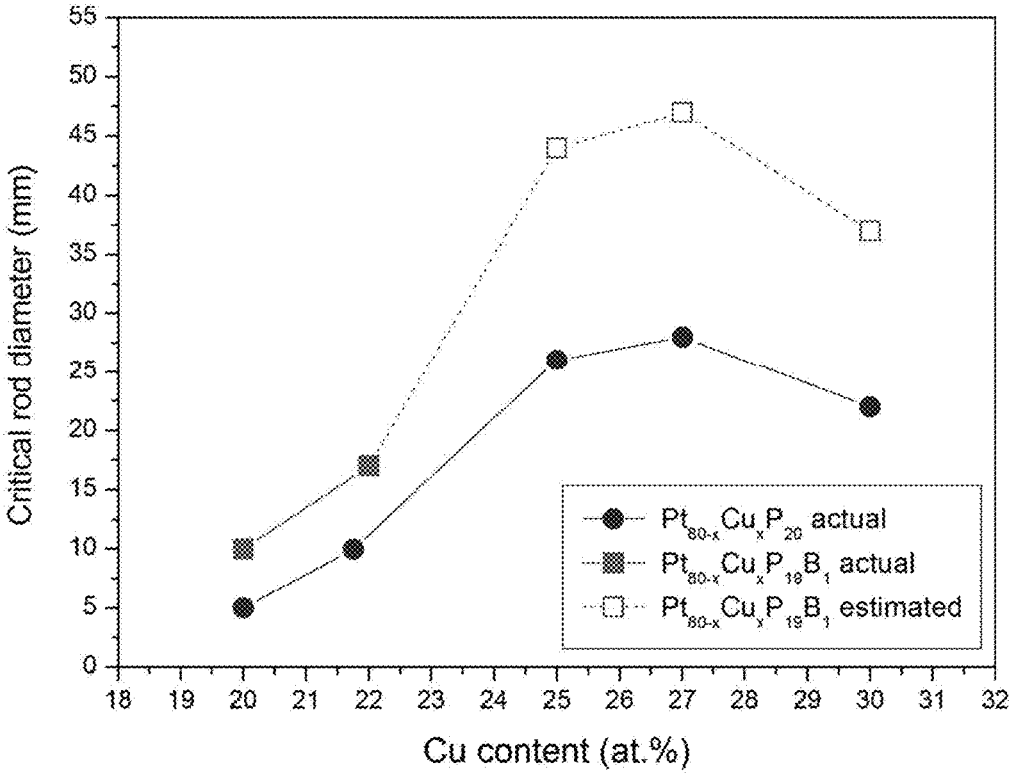
FIG. 3 provides a data plot comparing the glass-forming ability of alloys $Pt_{80-x}Cu_xP_{19}B_1$ to $Pt_{80-x}Cu_xP_{20}$ for x ranging from 20 to 30 atomic percent. Open square symbols are estimated critical rod diameters assuming that substituting 1 atomic percent P by B results in about 80% improvement in critical rod diameter.

To further demonstrate the effect of substituting P with B in the ternary Pt—Cu—P, the glass-forming ability of alloys $Pt_{80-x}Cu_xP_{19}B_1$ was contrasted to $Pt_{80-x}Cu_xP_{20}$ for x ranging from 20 to 30 atomic percent. As shown in Table 2 and FIG. 3, when x is between 20 and 22 atomic percent, substitution of 1 atomic percent of P with B results in an increase in critical rod diameter of 100-140%. Specifically, the critical rod diameter of $Pt_{60}Cu_{20}P_{20}$ and $Pt_{58.25}Cu_{21.75}P_{20}$ is 5 and 10 mm respectively, while that of $Pt_{60}Cu_{20}P_{19}B_1$ and $Pt_{58}Cu_{22}P_{19}B_1$ is 10 and 17 mm, respectively. As also shown in Table 2 and FIG. 3, when x is between 22 and 30 atomic percent, the critical rod diameter of ternary $Pt_{80-x}Cu_xP_{20}$ is higher, ranging from 26 mm at x=25, reaching 28 mm at x=27 atomic percent, and falling back to 22 mm at x=30 atomic percent. A critical rod diameter of 30 mm is the largest critical rod diameter that could be measured according to the method described herein. Substitution of 1 atomic percent P by B in ternary $Pt_{80-x}Cu_xP_{20}$ for x=25, 27, and 30 atomic percent resulted in a critical rod diameter for alloys $Pt_{55}Cu_{25}P_{19}B_1$, $Pt_{53}Cu_{27}P_{19}B_1$, and $Pt_{50}Cu_{30}P_{19}B_1$ that was verified to be greater than 30 mm. However, assuming that an increase in critical rod diameter of at least 70% also continues for x between 22 and 30 atomic percent, the critical rod diameter for $Pt_{55}Cu_{25}P_{19}B_1$, $Pt_{53}Cu_{27}P_{19}B_1$, and $Pt_{50}Cu_{30}P_{19}B_1$ can be estimated to be about 44, 47, and 37 mm, respectively. These are plotted by open square symbols in FIG. 3 to show an expected trend.

TABLE 2

Sample metallic glasses demonstrating the effect of increasing the Cu atomic concentration with an accompanying reduction in the atomic concentration of Pt on the glass forming ability, glass-transition, crystallization, solidus, and liquidus temperatures of $Pt_{80-x}Cu_xP_{20}$ and $Pt_{80-x}Cu_xP_{19}B_1$ alloys

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 1 | $Pt_{60}Cu_{20}P_{20}$ | 86.1 | 5 | 233.9 | 291.4 | 545.9 | 584.3 |
| 3 | $Pt_{60}Cu_{20}P_{19}B_1$ | 86.22 | 10 | 235.0 | 272.8 | 541.6 | 578.3 |
| 6 | $Pt_{58.25}Cu_{21.75}P_{20}$ | 85.0 | 10 | 233.2 | 295.2 | 545.8 | 576.3 |
| 7 | $Pt_{58}Cu_{22}P_{19}B_1$ | 85.0 | 17 | 237.4 | 276.9 | 538.4 | 578.1 |

TABLE 2-continued

Sample metallic glasses demonstrating the effect of increasing the Cu atomic concentration with an accompanying reduction in the atomic concentration of Pt on the glass forming ability, glass-transition, crystallization, solidus, and liquidus temperatures of $Pt_{80-x}Cu_xP_{20}$ and $Pt_{80-x}Cu_xP_{19}B_1$ alloys

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 8 | $Pt_{55}Cu_{25}P_{20}$ | 82.9 | 26 | 235.1 | 306.7 | 544.8 | 582.8 |
| 9 | $Pt_{55}Cu_{25}P_{19}B_1$ | 83.1 | >30 | 236.8 | 282.4 | 539.1 | 583.8 |
| 10 | $Pt_{53}Cu_{27}P_{20}$ | 81.6 | 28 | 236.3 | 304.2 | 544.0 | 598.2 |
| 11 | $Pt_{53}Cu_{27}P_{19}B_1$ | 81.7 | >30 | 239.9 | 297.7 | 539.9 | 598.6 |
| 12 | $Pt_{50}Cu_{30}P_{20}$ | 79.4 | 22 | 239.2 | 310.0 | 542.4 | 619.3 |
| 13 | $Pt_{50}Cu_{30}P_{19}B_1$ | 79.6 | >30 | 241.1 | 295.5 | 551.9 | 606.7 |

Figure 4:
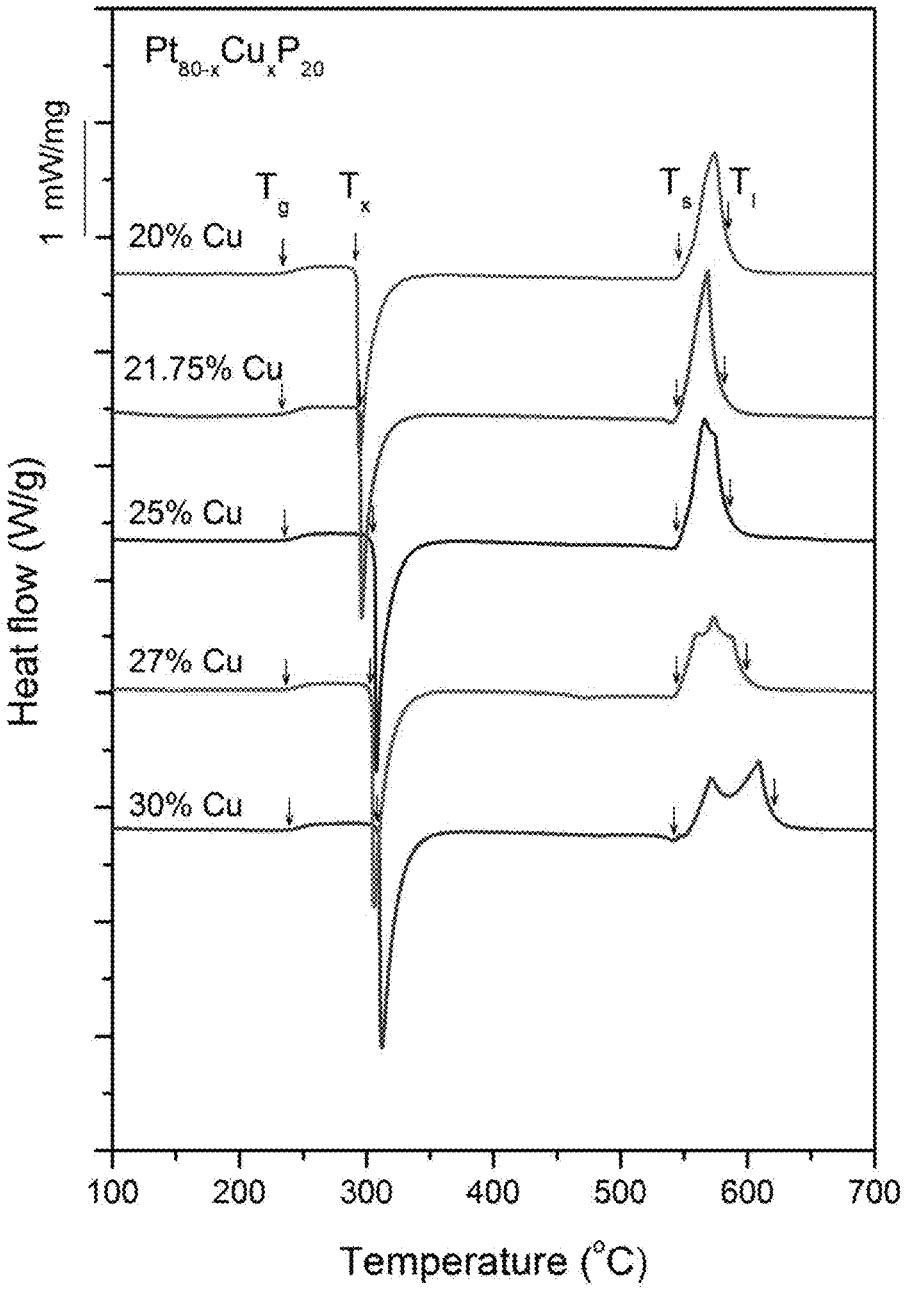
FIG. 4 provides calorimetry scans for sample metallic glasses $Pt_{80-x}Cu_xP_{20}$ in accordance with embodiments of the disclosure. The glass transition temperature $T_g$, crystallization temperature $T_x$, solidus temperature $T_s$, and liquidus temperature $T_l$ are indicated by arrows.
Figure 5:
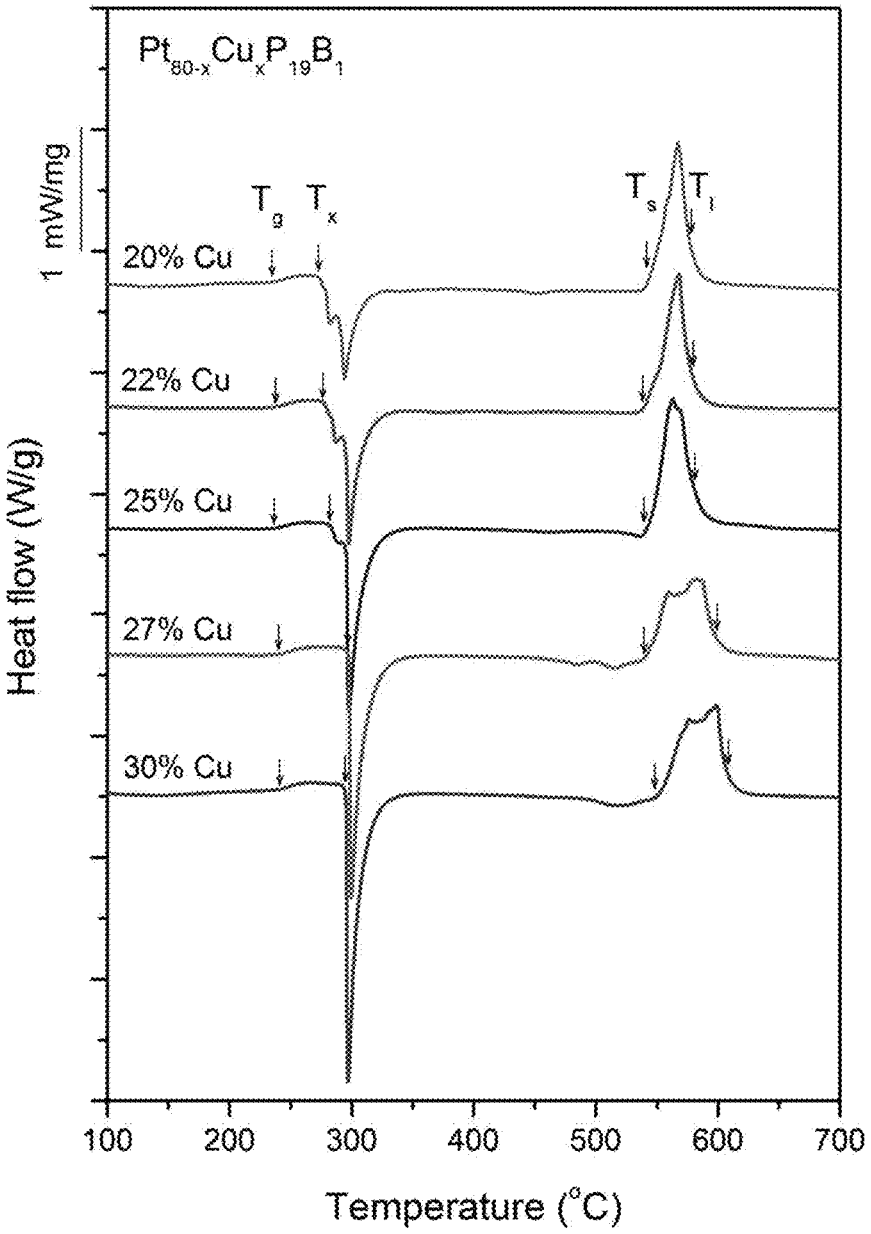
FIG. 5 provides calorimetry scans for sample metallic glasses $Pt_{80-x}Cu_xP_{19}B_1$ in accordance with embodiments of the disclosure. The glass transition temperature $T_g$, crystallization temperature $T_x$, solidus temperature $T_s$, and liquidus temperature $T_l$ are indicated by arrows.

FIG. 4 provides calorimetry scans for sample metallic glasses $Pt_{80-x}Cu_xP_{20}$ and FIG. 5 for sample metallic glasses $Pt_{80-x}Cu_xP_{19}B_1$ in accordance with embodiments of the disclosure. The glass transition temperature $T_g$, crystallization temperature $T_x$, solidus temperature $T_s$, and liquidus temperature $T_l$ are indicated by arrows in FIGS. 4 and 5, and are listed in Table 2. As seen in FIGS. 4 and 5 and Table 2, the trends in $T_g$ and $T_l$ between the B-free and B-bearing alloys are consistent with those in FIG. 2 and Table 1. Specifically, $T_g$ is higher for the B-bearing alloy compared to the B-free alloy by at least 1° C. and as much as 4° C., while $T_l$ is either roughly constant (Examples 6-11) or decreases significantly for the B-bearing alloy compared to the B-free alloy (Examples 1-2 and 12-13). These trends between $T_g$ and $T_l$ are consistent with an improving glass forming ability for the B-bearing alloys as anticipated by the concept of reduced glass transition. The solidus temperature $T_s$ is generally lower for the B-bearing alloys (with the exception of Examples 12-13); the crystallization temperature $T_x$ is consistently lower for the B-bearing alloys.

Figure 6:
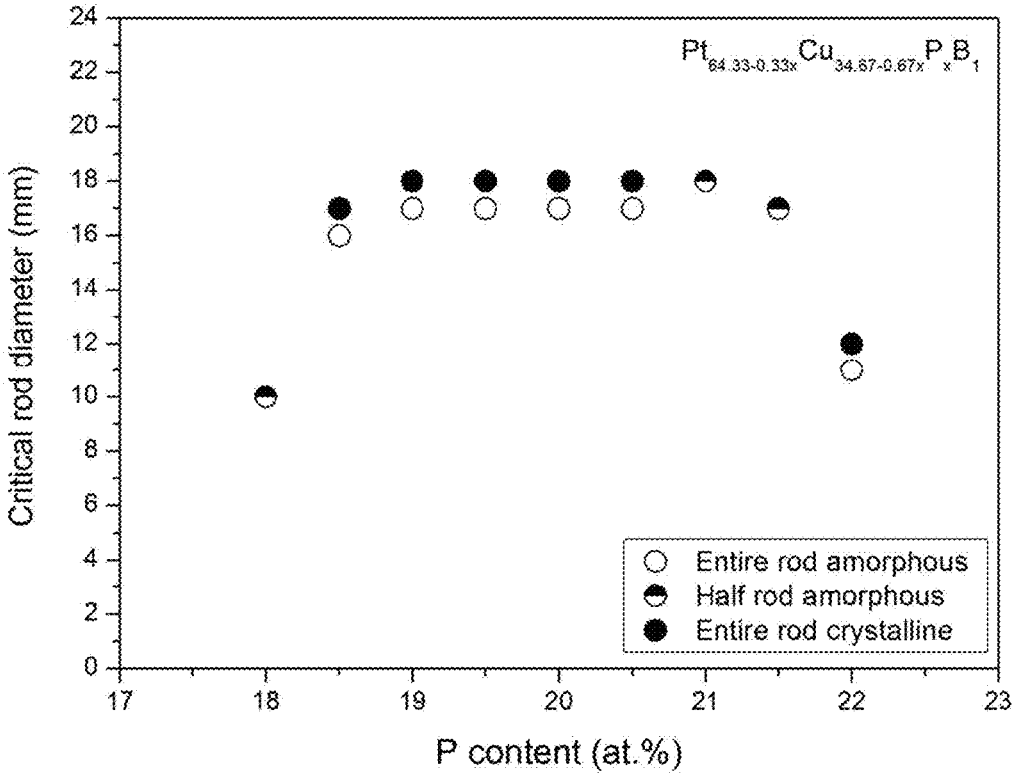
FIG. 6 provides a data plot showing the effect of varying the atomic fraction of P on the glass forming ability of $Pt_{64.33-0.33x}Cu_{34.67-0.67x}P_xB_1$ alloys for $18.5 \le x \le 22$.

The effect of substituting Pt and/or Cu by P according to the formula $Pt_{64.33-0.33x}Cu_{34.67-0.67x}P_xB_1$ on the glass forming ability of the Pt—Cu—P—B system is also investigated for x ranging between 18.5 to 22. As shown in Table 3 and FIG. 6, the critical rod diameter increases sharply from 10 mm to 16 mm when x increases from 18 to 18.5, is greater than 17 mm when x is in the range of 18.5 to 20 (Examples 7 and 15-17), goes through a peak of 18 mm when x is 21 (Example 19), and drops precipitously when x is greater than 21.5 reaching 11 mm when x is 22 (Example 21).

Figure 7:
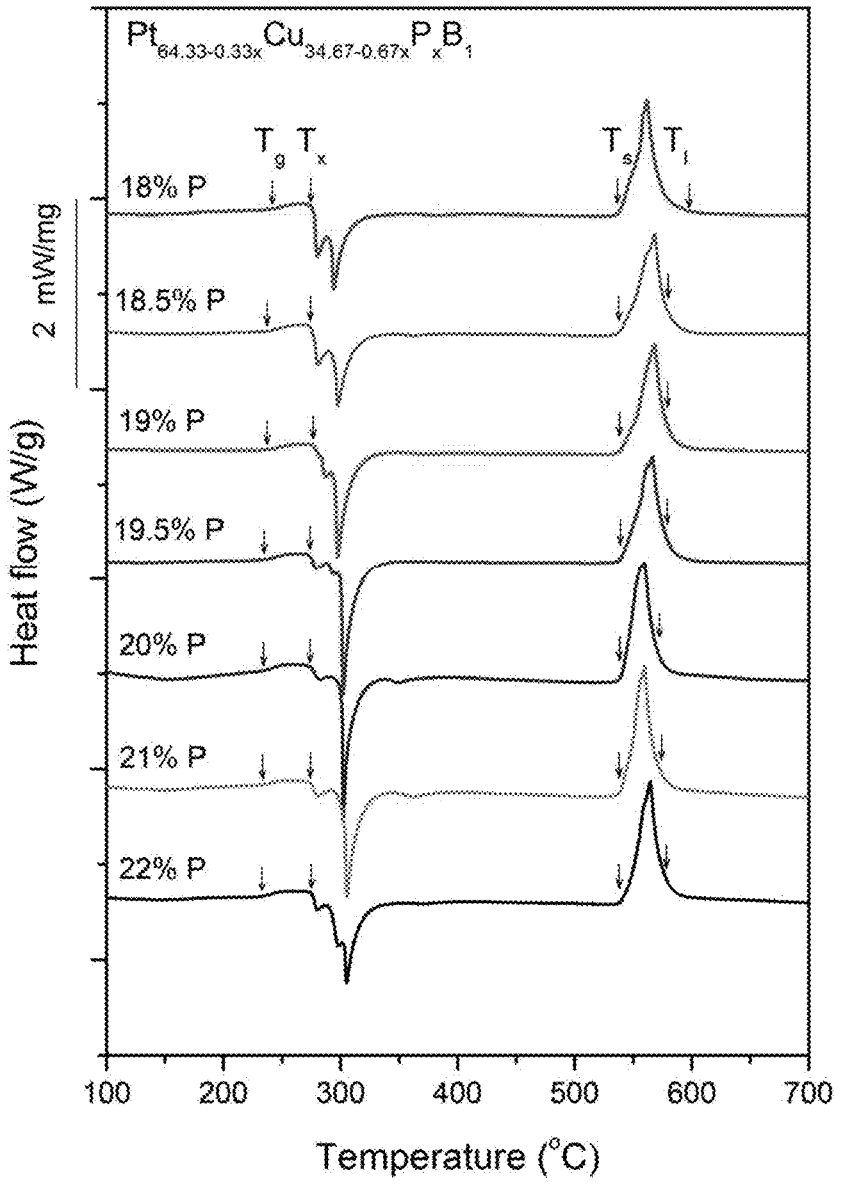
FIG. 7 provides calorimetry scans for sample metallic glasses $Pt_{64.33-0.33x}Cu_{34.67-0.67x}P_xB_1$ in accordance with embodiments of the disclosure. The glass transition temperature $T_g$, crystallization temperature $T_x$, solidus temperature $T_s$, and liquidus temperature $T_l$ are indicated by arrows.

FIG. 7 provides calorimetry scans for sample metallic glasses $Pt_{64.33-0.33x}Cu_{34.67-0.67x}P_xB_1$ in accordance with embodiments of the disclosure. The glass transition temperature $T_g$, crystallization temperature $T_x$, solidus temperature $T_s$, and liquidus temperature $T_l$ are indicated by arrows in FIG. 7 and are listed in Table 3. As seen in FIG. 7 and Table 3, both $T_g$ and $T_l$ decrease substantially with increasing the P content x between 18 and 18.5 (Examples 14 and 15), with $T_g$ decreasing form 241.2 to 237.2° C. and $T_l$ decreasing from 599.7 to 577.3° C. This trend is consistent with the large variation in critical rod diameter for x between 18 and 18.5. Further increasing the P content x between 18.5 and 21 (Examples 7 and 15-19), decreases both $T_g$ and $T_l$ slightly, with $T_g$ decreasing from 237.2 to 233.4° C. and $T_l$ decreasing from 577.3 to 568.3° C. This trend is consistent with the large variation in critical rod diameter for x between 18 and 18.5, and the slight variation in critical rod diameter in the range. On the other hand, at x=22 (Example 21) where the critical rod diameter drops considerably, $T_g$ decreases slightly from 233.4 to 233° C. while $T_l$ increases from 568.3 to 573.9° C. Both observations roughly conform to the reduced glass transition concept. $T_x$ and $T_s$ remain roughly constant through the entire x range.

In certain embodiments of this disclosure, an alloy according to the disclosure may comprise B in an atomic fraction of up to 6 percent. In another embodiment, an alloy according to the disclosure may comprise B in an atomic fraction in the range of 0.1 to 5 percent. In another embodiment, an alloy according to the disclosure may comprise B in an atomic fraction in the range of 0.25 to 2.5 percent. In

TABLE 3

Sample metallic glasses demonstrating the effect of increasing the P atomic concentration according to the formula $Pt_{64.33-0.33x}Cu_{34.67-0.67x}P_xB_1$ on the glass forming ability, glass-transition, crystallization, solidus, and liquidus temperatures of the alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 14 | $Pt_{58.4}Cu_{22.6}P_{18}B_1$ | 85.0 | 10 | 241.2 | 275.3 | 538.0 | 599.7 |
| 15 | $Pt_{58.2}Cu_{22.3}P_{18.5}B_1$ | 85.0 | 16 | 237.2 | 274.2 | 537.5 | 577.3 |
| 7 | $Pt_{58}Cu_{22}P_{19}B_1$ | 85.0 | 17 | 237.4 | 276.9 | 538.4 | 578.1 |
| 16 | $Pt_{57.85}Cu_{21.65}P_{19.5}B_1$ | 85.0 | 17 | 234.2 | 274.2 | 538.9 | 576.9 |
| 17 | $Pt_{57.7}Cu_{21.3}P_{20}B_1$ | 85.0 | 17 | 233.8 | 274.1 | 539.6 | 569.8 |
| 18 | $Pt_{57.5}Cu_{21}P_{20.5}B_1$ | 85.0 | 17 | 234.2 | 275.0 | 538.7 | 570.4 |
| 19 | $Pt_{57.35}Cu_{20.65}P_{21}B_1$ | 85.0 | 18 | 233.4 | 273.9 | 538.6 | 568.3 |
| 20 | $Pt_{57.2}Cu_{20.3}P_{21.5}B_1$ | 85.0 | 17 | 232.7 | 278.0 | 542.1 | 576.2 |
| 21 | $Pt_{57}Cu_{20}P_{22}B_1$ | 85.0 | 11 | 233.0 | 275.4 | 538.9 | 573.9 |

yet another embodiment, an alloy according to the disclosure may comprise B in an atomic fraction in the range of 0.5 to 1.5 percent.

In other embodiments, a metallic glass-forming alloy, or a metallic glass, can comprise at least Pt, Cu, P and B, where the weight fraction of Pt does not exceed 91 percent and the atomic fraction of Pt is in the range of 45 to 60 percent, the atomic fraction of Cu is in the range of 15 to 35 percent, the atomic fraction of P is in the range of 16 to 23, and the atomic fraction of B is in the range of 0.25 to 3. In some embodiments, the atomic fraction of P is in the range of 16 to 21, and in others, it is in the range of 17 to 23. In some embodiments, the atomic fraction of Cu in the range of 15 to 30 percent, while in others, the Cu content ranges from 20 to 35 atomic percent.

In yet other embodiments, a metallic glass-forming alloy, or a metallic glass, can comprise at least Pt, Cu, P and B, where the weight fraction of Pt does not exceed 91 percent and the atomic fraction of Pt is in the range of 55 to 70 percent, the atomic fraction of Cu is in the range of 3 to 25 percent, the atomic fraction of P is in the range of 16 to 23, and the atomic fraction of B is in the range of 0.25 to 3. In some embodiments, the atomic fraction of Cu in the range of 5 to 20 percent, while in others, the Cu content ranges from 5 to 25 atomic percent. In some embodiments, the atomic fraction of P is in the range of 18 to 23, and in others, it is in the range of 17 to 23.

In still other embodiments, a metallic glass-forming alloy, or a metallic glass, can comprise at least Pt, Cu, P and B, where the weight fraction of Pt does not exceed 91 percent and the atomic fraction of Pt is in the range of 50 to 65 percent, the atomic fraction of Cu is in the range of 14 to 30 percent, the atomic fraction of P is in the range of 17 to 23, and the atomic fraction of B is in the range of 0.25 to 3. In some embodiments, the atomic fraction of Cu ranges from 14 to 25 atomic percent. In some embodiments, the atomic fraction of P is in the range of 17 to 22.

In further embodiments, a metallic glass-forming alloy, or a metallic glass, can comprise at least Pt, Cu, P and B, where the weight fraction of Pt does not exceed 91 percent and the atomic fraction of Pt is in the range of 57 to 63 percent, the atomic fraction of Cu is in the range of 16 to 23 percent, the atomic fraction of P is in the range of 15 to 25, and the atomic fraction of B is in the range of 0.25 to 1.5. In some embodiments, the atomic fraction of P is in the range of 17.5 to 22.5

In other embodiments, a metallic glass-forming alloy, or a metallic glass comprise at least Pt, Cu, P and B, where the weight fraction of Pt does not exceed 85.5 percent and the atomic fraction of Cu is in the range of 19.5 to 21.5, the atomic fraction of P is in the range of 20 to 22, and the atomic fraction of B is in the range of 1 to 1.5. In other embodiments, the weight fraction of Pt does not exceed 85.25 and the atomic fraction of Cu is in the range of 20 to 21, the atomic fraction of P is from 20 to 21.4, and the atomic fraction of B is in the range of 1 to 1.5. In still other embodiments, the weight fraction of Pt does not exceed 85.2, Cu ranges from 20.2 to 20.7 atomic percent, P ranges from 20.65 to 21.15 atomic percent, and B ranges from 1 to 1.5 atomic percent.

Description of Ag-Bearing Pt—Cu—P Alloys and Metallic Glass Compositions

In another embodiment, the disclosure provides a metallic glass-forming alloy, or a metallic glass, that comprises at least Pt, Cu, P and Ag, where the atomic fraction of Pt is in the range of 45 to 75 percent and the weight fraction of Pt does not exceed 91 percent, the atomic fraction of Cu is in the range of 3 to 35 percent, the atomic fraction of P is in the range of 15 to 25, and the atomic fraction of Ag is in the range of 0.25 to 7.5 percent.

Figure 8:
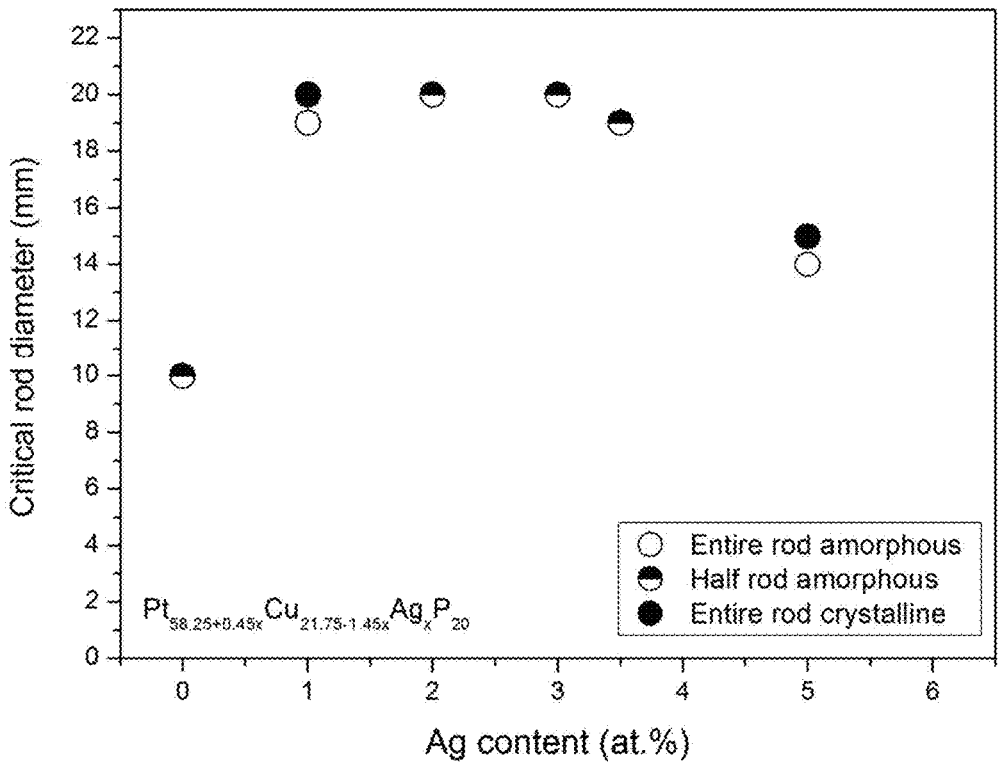
FIG. 8 provides a data plot showing the effect of varying the atomic fraction of Ag on the glass forming ability of $Pt_{58.25+0.45x}Cu_{21.75-1.45x}Ag_xP_{20}$ alloys for $0 \le x \le 5$.

Specific embodiments of metallic glasses formed of alloys with compositions according to the formula $Pt_{58.25+0.45x}Cu_{21.75-1.45x}Ag_xP_{20}$ with Pt weight fraction of at least 85.0 percent satisfying the PT850 hallmark, are presented in Table 4. The critical rod diameters of the example alloys along with the Pt weight percentage are also listed in Table 4. FIG. 8 provides a data plot showing the effect of varying the Ag atomic fraction x on the glass forming ability of the alloys according to the composition formula $Pt_{58.25+0.45x}Cu_{21.75-1.45x}Ag_xP_{20}$.

TABLE 4

Sample metallic glasses demonstrating the effect of increasing the Ag atomic concentration according to the formula $Pt_{58.25+0.45x}Cu_{21.75-1.45x}Ag_xP_{20}$ on the glass forming ability, glass-transition, crystallization, solidus, and liquidus temperatures of the alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 6 | $Pt_{58.25}Cu_{21.75}P_{20}$ | 85.0 | 10 | 233.2 | 295.2 | 545.8 | 576.3 |
| 22 | $Pt_{58.7}Cu_{20.3}Ag_1P_{20}$ | 85.0 | 19 | 237.8 | 300.9 | 543.8 | 581.4 |
| 23 | $Pt_{59.15}Cu_{18.85}Ag_2P_{20}$ | 85.0 | 20 | 240.6 | 295.3 | 541.6 | 646.1 |
| 24 | $Pt_{59.6}Cu_{17.4}Ag_3P_{20}$ | 85.0 | 20 | 241.8 | 283.7 | 546.0 | 695.3 |
| 25 | $Pt_{59.825}Cu_{16.675}Ag_{3.5}P_{20}$ | 85.0 | 19 | 240.9 | 283.1 | 548.7 | 702.8 |
| 26 | $Pt_{60.5}Cu_{14.5}Ag_5P_{20}$ | 85.0 | 14 | 251.3 | 282.9 | 546.2 | 756.5 |

As shown in Table 4 and FIG. 8, including Ag in ternary Pt—Cu—P according to the composition formula $Pt_{58.25+0.45x}Cu_{21.75-1.45x}Ag_xP_{20}$ enhances the glass forming ability. For example, the critical rod diameter increases from 10 mm for the Ag-free alloy (Example 6) to 19-20 mm or larger for the alloy containing 1 to 3.5 atomic percent Ag (Examples 22-25), and then decreases back to 14 mm for alloy containing 5 atomic percent Ag (Example 26). Hence, the critical rod diameter is shown to increase by 100% or more by increasing the atomic fraction of Ag from 0 to about 3.5 percent.

Figure 9:
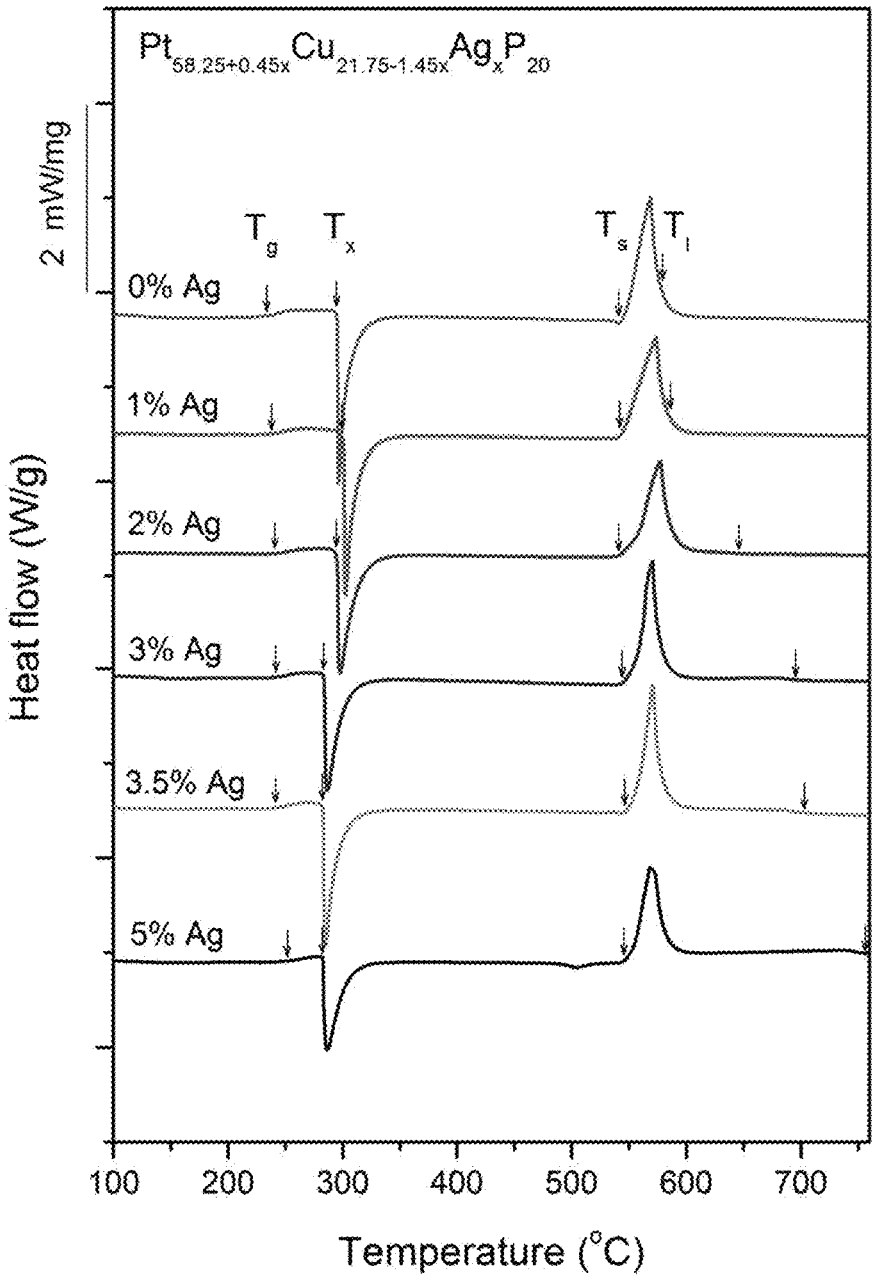
FIG. 9 provides calorimetry scans for sample metallic glasses $Pt_{58.25+0.45x}Cu_{21.75-1.45x}Ag_xP_{20}$ in accordance with embodiments of the disclosure. The glass transition temperature $T_g$, crystallization temperature $T_x$, solidus temperature $T_s$, and liquidus temperature $T_l$ are indicated by arrows.

FIG. 9 provides calorimetry scans for sample metallic glasses $Pt_{58.25+0.45x}Cu_{21.75-1.45x}Ag_xP_{20}$ in accordance with embodiments of the disclosure. The glass transition temperature $T_g$, crystallization temperature $T_x$, solidus temperature $T_s$, and liquidus temperature $T_l$ are indicated by arrows in FIG. 9, and are listed in Table 4. As seen in FIG. 9 and Table 4, $T_g$ increases and rather monotonically from 233.2 to 251.3° C. by increasing the Ag atomic fraction from 0 to 5 percent. For example, the increase in $T_g$ is nearly 20 degrees over 5 atomic percent increase in Ag, or about 4 degrees per atomic percent increase in Ag. On the other hand, $T_l$ appears to vary very slightly with increasing the Ag atomic fraction from 0 to 1 percent, slightly increasing from 576 to 581° C. However, at higher Ag concentrations, a very subtle melting event emerges at higher temperatures having an associated enthalpy that is considerably lower than that of the broad melting event. Specifically, at Ag atomic fractions between 2 and 5 percent, a very shallow endothermic event appears and advances to higher temperatures in the range of about 650 to 750° C. as the Ag content is increased. The emergence of this subtle endothermic event is consistent with the plateau in critical rod diameter observed around 2-3 atomic percent Ag and subsequent reduction in higher Ag contents (FIG. 8). Overall, the trends in $T_g$ and $T_l$ are consistent with in critical rod diameter going through a peak near 1-3 atomic percent Ag, in accordance with the reduced glass transition concept (Table 4 and FIG. 8). The solidus temperature $T_s$ also appears to vary very slightly with increasing the Ag atomic fraction from 0 to 5 percent. $T_s$ and $T_l$ remain fairly close to each other as the atomic fraction of Ag increases from 0 to 2 percent, which suggests that including Ag in a Pt—Cu—P alloy in atomic fractions under 2 percent does not disrupt the near-eutectic crystal structure of Pt—Cu—P. The crystallization temperature $T_x$ is shown to peak at 1 atomic percent Ag and decrease monotonically as the Ag content is increased further.

Figure 10:
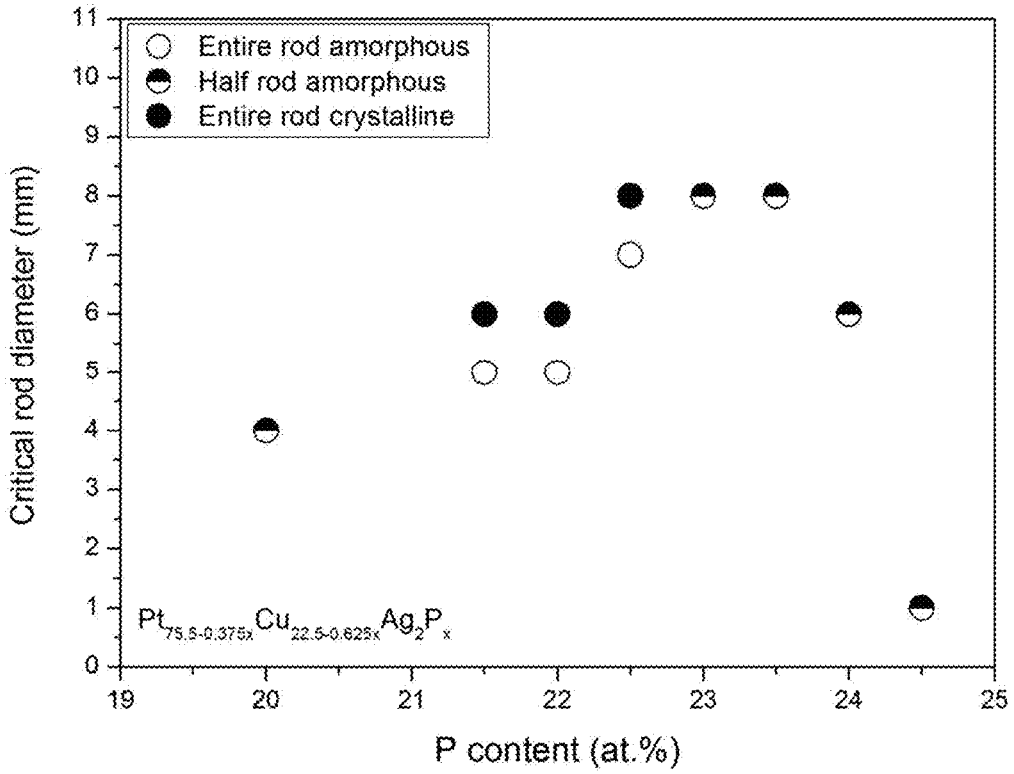
FIG. 10 provides a data plot showing the effect of varying the atomic fraction of P on the glass forming ability of $Pt_{75.5-0.375x}Cu_{22.5-0.625x}Ag_2P_x$ alloys for $20 \le x \le 24.5$.

Specific embodiments of metallic glasses formed of alloys having compositions where the P atomic fraction is increased with an accompanying reduction in the atomic concentration of Cu and Pt according to the formula $Pt_{75.5-0.375x}Cu_{22.5-0.625x}Ag_2P_x$, and Pt weight fraction of at least 90.0 percent satisfying the PT900 hallmark, are presented in Table 5. The critical rod diameters of the example alloys along with the Pt weight percentage are also listed in Table 5. FIG. 10 provides a data plot showing the effect of varying the P atomic fraction x on the glass forming ability of the alloys according to the composition formula $Pt_{75.5-0.375x}Cu_{22.5-0.625x}Ag_2P_x$.

As shown in Table 5 and FIG. 10, by varying the atomic concentration of P according to the formula $Pt_{75.5-0.375x}Cu_{22.5-0.625x}Ag_2P_x$, the critical rod diameter increases from 4 mm when x is 20 (Example 27) to 8 mm when x is between 23 and 23.5 (Examples 31 and 32), and drops precipitously when x increases beyond 23.5 reaching 1 mm when x is 24.5 (Example 34).

Figure 11:
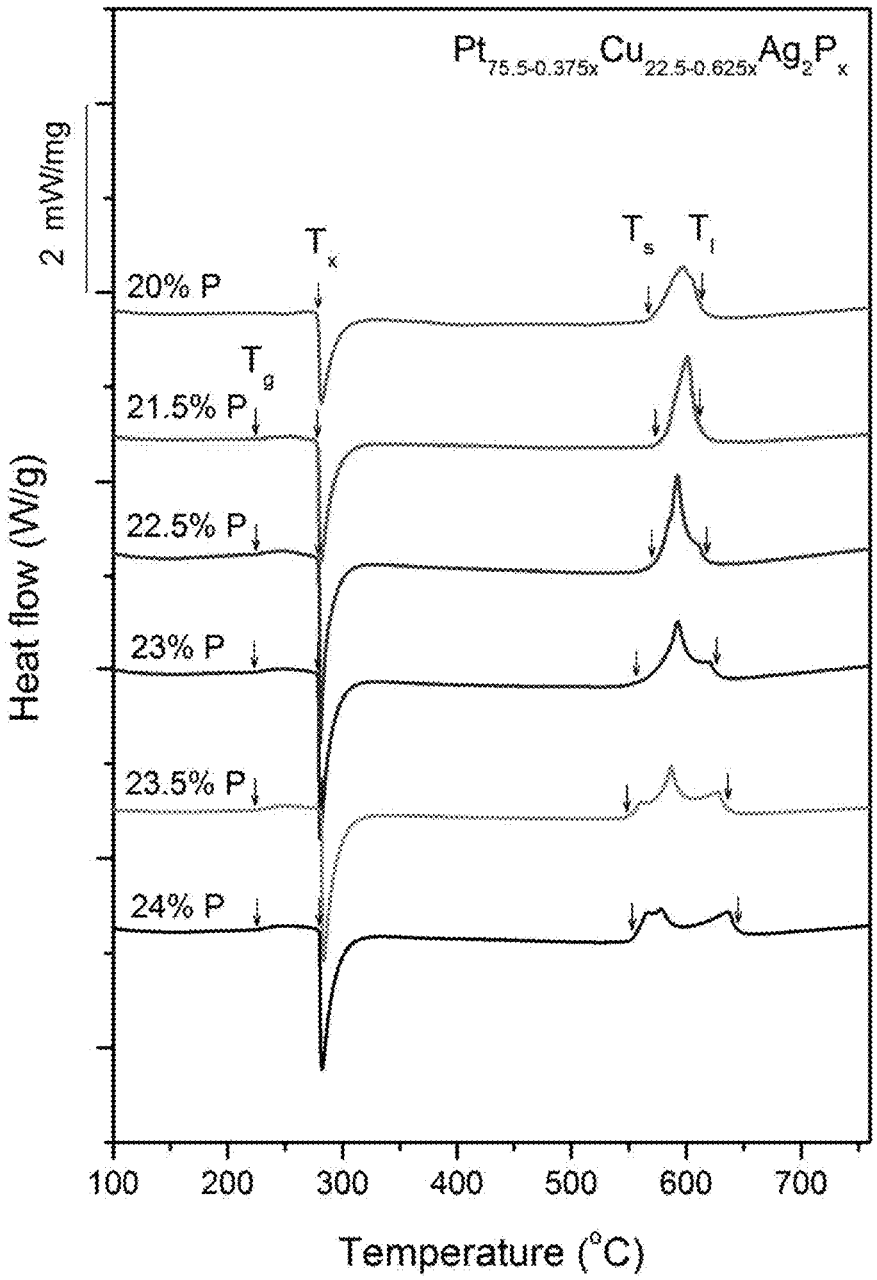
FIG. 11 provides calorimetry scans for sample metallic glasses $Pt_{75.5-0.375x}Cu_{22.5-0.625x}Ag_2P_x$ in accordance with embodiments of the disclosure. The glass transition temperature $T_g$, crystallization temperature $T_x$, solidus temperature $T_s$, and liquidus temperature $T_l$ are indicated by arrows.

FIG. 11 provides calorimetry scans for sample metallic glasses $Pt_{75.5-0.375x}Cu_{22.5-0.625x}Ag_2P_x$ in accordance with embodiments of the disclosure. The glass transition temperature $T_g$, crystallization temperature $T_x$, solidus temperature $T_s$, and liquidus temperature $T_l$ are indicated by arrows in FIG. 11, and are listed in Table 5. The glass transition temperature of Example 27 was not detectable from the calorimetry scan. As seen in FIG. 11 and Table 5, $T_g$ varies slightly from about 220 to 228° C. when the P atomic fraction varies from 20 to 24.5 percent. $T_l$ appears to also vary slightly from 614 to 618° C. when the P atomic fraction varies from 20 to 22.5 percent. However, when the atomic fraction of P is greater than 23 percent, $T_l$ increases more drastically reaching values greater than 640° C. The sharp increase in Tat those P concentrations is consistent with the precipitous drop in glass forming ability.

Figure 12:
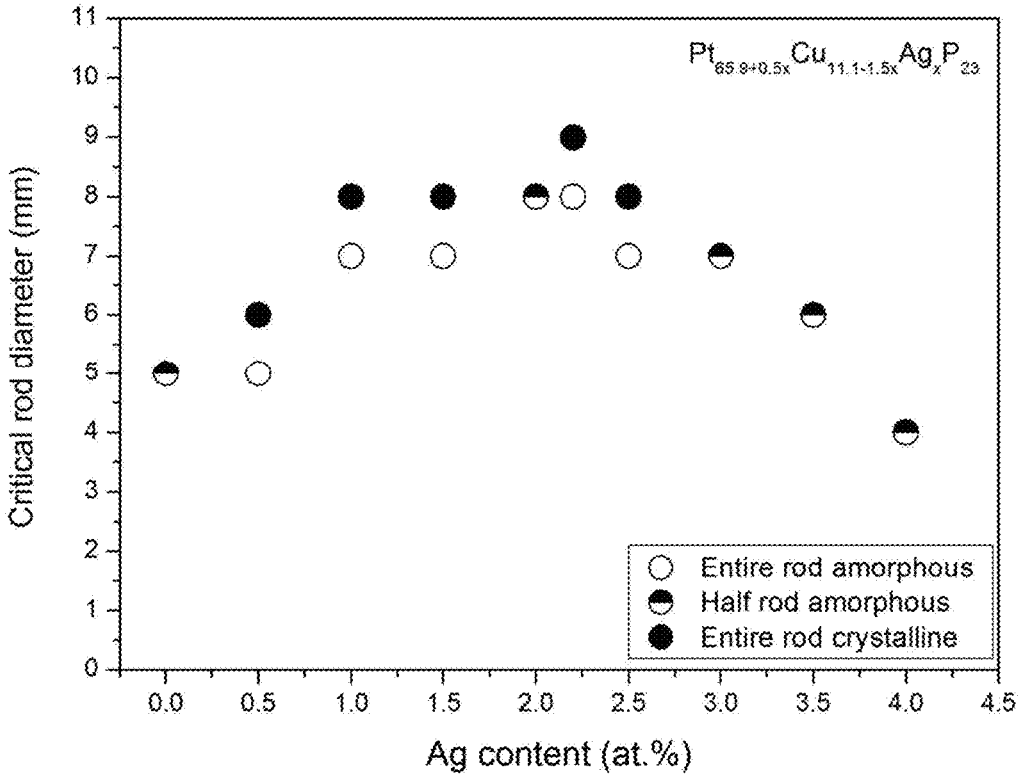
FIG. 12 provides a data plot showing the effect of varying the atomic fraction of Ag on the glass forming ability of $Pt_{65.9+0.5x}Cu_{11.1-1.5x}Ag_xP_{23}$ alloys for $0 \le x \le 4$.

Specific embodiments of metallic glasses formed of alloys having compositions where the Ag atomic fraction is increased with an accompanying reduction in the atomic concentration of Cu and Pt according to the formula $Pt_{65.9+0.5x}Cu_{11.1-1.5x}Ag_xP_{23}$, and Pt weight fraction of at least 90.0 percent satisfying the PT900 hallmark, are presented in Table 6. The critical rod diameters of the example alloys along with the Pt weight percentage are listed in Table 6. FIG. 12 provides a data plot showing the effect of varying the Ag atomic fraction x on the glass forming ability of the alloys according to the composition formula $Pt_{65.9+0.5x}Cu_{11.1-1.5x}Ag_xP_{23}$.

TABLE 5

Sample metallic glasses demonstrating the effect of increasing the P atomic concentration according to the formula $Pt_{75.5-0.375x}Cu_{22.5-0.625x}Ag_2P_x$ on the glass forming ability, glass-transition, crystallization, solidus, and liquidus temperatures of the alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 27 | $Pt_{68}Cu_{10}Ag_2P_{20}$ | 90.0 | 4 | — | 279.0 | 569.6 | 614.3 |
| 28 | $Pt_{67.4}Cu_{9.1}Ag_2P_{21.5}$ | 90.0 | 5 | 224.0 | 279.0 | 575.7 | 609.6 |
| 29 | $Pt_{67.2}Cu_{8.8}Ag_2P_{22}$ | 90.0 | 5 | 227.5 | 280.7 | 574.6 | 613.9 |
| 30 | $Pt_{67.1}Cu_{8.4}Ag_2P_{22.5}$ | 90.0 | 7 | 224.8 | 279.5 | 575.9 | 618.0 |
| 31 | $Pt_{66.9}Cu_{8.1}Ag_2P_{23}$ | 90.0 | 8 | 222.9 | 279.2 | 569.3 | 628.2 |
| 32 | $Pt_{66.7}Cu_{7.8}Ag_2P_{23.5}$ | 90.0 | 8 | 223.8 | 281.6 | 551.9 | 635.0 |
| 33 | $Pt_{66.5}Cu_{7.5}Ag_2P_{24}$ | 90.0 | 6 | 225.9 | 280.2 | 553.5 | 644.3 |
| 34 | $Pt_{66.3}Cu_{7.2}Ag_2P_{24.5}$ | 90.0 | 1 | 219.6 | 278.2 | 541.5 | 640.3 |

TABLE 6

Sample metallic glasses demonstrating the effect of increasing the Ag atomic concentration according to the formula $P_{65.9+0.5x}Cu_{11.1-1.5x}Ag_xP_{23}$ on the glass forming ability, glass-transition, crystallization, solidus, andiquidus temperatures of the alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 35 | $Pt_{65.9}Cu_{11.1}P_{23}$ | 90.0 | 5 | 222.9 | 274.4 | 548.2 | 623.9 |
| 36 | $Pt_{66.1}Cu_{10.4}Ag_{0.5}P_{23}$ | 90.0 | 5 | 222.1 | 272.4 | 549.7 | 623.6 |
| 37 | $Pt_{66.4}Cu_{9.6}Ag_1P_{23}$ | 90.0 | 7 | 221.3 | 275.9 | 551.8 | 625.3 |
| 38 | $Pt_{66.6}Cu_{8.9}Ag_{1.5}P_{23}$ | 90.0 | 7 | 223.3 | 276.7 | 549.0 | 627.6 |
| 31 | $Pt_{66.9}Cu_{8.1}Ag_2P_{23}$ | 90.0 | 8 | 222.9 | 279.2 | 569.3 | 628.2 |
| 39 | $Pt_{67}Cu_{7.8}Ag_{2.2}P_{23}$ | 90.0 | 8 | 225.7 | 283.2 | 576.1 | 632.4 |
| 40 | $Pt_{67.1}Cu_{7.4}Ag_{2.5}P_{23}$ | 90.0 | 7 | 220.3 | 281.4 | 573.9 | 631.3 |
| 41 | $Pt_{67.4}Cu_{6.6}Ag_3P_{23}$ | 90.0 | 7 | 220.8 | 281.4 | 572.3 | 631.1 |
| 42 | $Pt_{67.6}Cu_{5.9}Ag_{3.5}P_{23}$ | 90.0 | 6 | 222.7 | 287.8 | 566.2 | 634.0 |
| 43 | $Pt_{67.9}Cu_{5.1}Ag_4P_{23}$ | 90.0 | 4 | 223.3 | 288.8 | 567.7 | 635.2 |

As shown in Table 6 and FIG. 12, by varying the atomic concentration of Ag according to the formula $Pt_{65.9+0.5x}Cu_{11.1-1.5x}Ag_xP_{23}$, the critical rod diameter increases from 5 mm for the Ag-free alloy (Example 35) to 8 mm for the alloys containing 2 and 2.2 atomic percent Ag (Examples 31 and 39), and then decreases to 4 mm for alloy containing 4 atomic percent Ag (Example 43). Hence, the critical rod diameter is shown to increase by nearly 100% by increasing the atomic fraction of Ag from 0 to about 2 percent.

Figure 13:
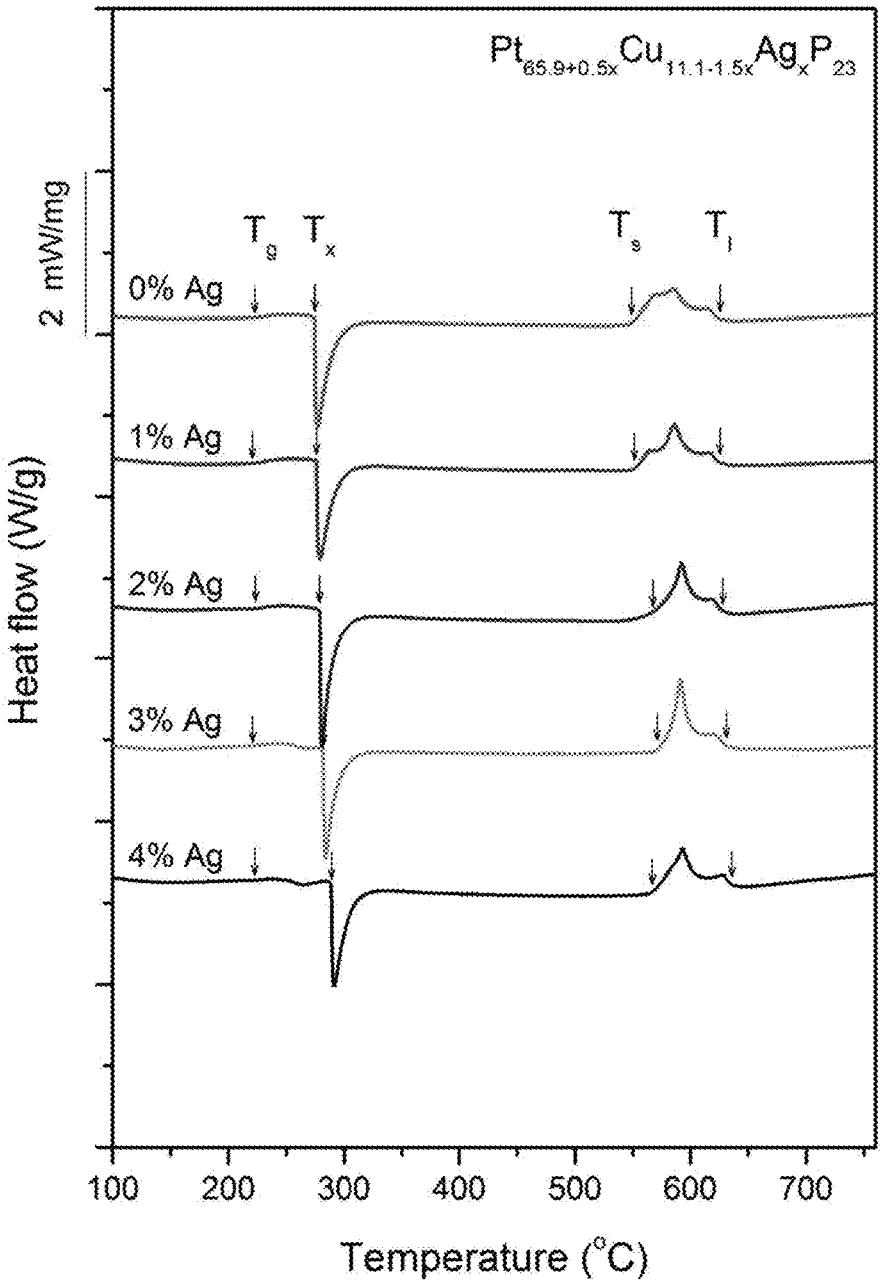
FIG. 13 provides calorimetry scans for sample metallic glasses $Pt_{65.9+0.5x}Cu_{11.1-1.5x}Ag_xP_{23}$ in accordance with embodiments of the disclosure. The glass transition temperature $T_g$, crystallization temperature $T_x$, solidus temperature $T_s$, and liquidus temperature $T_l$ are indicated by arrows.

FIG. 13 provides calorimetry scans for sample metallic glasses $Pt_{65.9+0.5x}Cu_{11.1-1.5x}Ag_xP_{23}$ in accordance with embodiments of the disclosure. The glass transition temperature $T_g$, crystallization temperature $T_x$, solidus temperature $T_s$, and liquidus temperature $T_l$ are indicated by arrows in FIG. 13, and are listed in Table 6. As seen in FIG. 13 and Table 6, $T_g$ varies very slightly and non-monotonically in the range of 221 to 223° C. by increasing the Ag atomic fraction from 0 to 4 percent. On the other hand, $T_l$ appears to increase very slightly but monotonically with increasing the Ag atomic fraction from 0 to 4 percent from 624 to 635° C.

In certain embodiments of this disclosure, an alloy according to the disclosure may comprise Ag in an atomic fraction of up to 7.5 percent. In another embodiment, an alloy according to the disclosure may comprise Ag in an atomic fraction in the range of 0.1 to 7.5 percent. In another embodiment, an alloy according to the disclosure may comprise Ag in an atomic fraction in the range of 0.25 to 5 percent. In yet another embodiment, an alloy according to the disclosure may comprise Ag in an atomic fraction in the range of 0.25 to 4 percent. In yet another embodiment, an alloy according to the disclosure may comprise Ag in an atomic fraction in the range of 0.5 to 3 percent.

In other embodiments, a metallic glass-forming alloy, or a metallic glass, can comprise at least Pt, Cu, P and Ag, where the weight fraction of Pt does not exceed 91 percent and the atomic fraction of Pt is in the range of 45 to 60 percent, the atomic fraction of Cu is in the range of 15 to 35 percent, the atomic fraction of P is in the range of 16 to 24, and the atomic fraction of Ag is in the range of 0.25 to 4. In some embodiments, the atomic fraction of P is in the range of 16 to 21, in others it is in the range of 16 to 23, and in still others P ranges from 18 to 24. In some embodiments, the atomic fraction of Cu ranges from 15 to 30 atomic percent, while in others, the Cu content ranges from 20 to 35 atomic percent.

In yet other embodiments, a metallic glass-forming alloy, or a metallic glass, can comprise at least Pt, Cu, P and Ag, where the weight fraction of Pt does not exceed 91 percent and the atomic fraction of Pt is in the range of 55 to 70 percent, the atomic fraction of Cu is in the range of 3 to 25 percent, the atomic fraction of P is in the range of 18 to 25, and the atomic fraction of B is in the range of 0.25 to 3. In some embodiments, the atomic fraction of Cu ranges from 5 to 20 percent, while in others, the Cu content ranges from 5 to 20 atomic percent. In some embodiments, the atomic fraction of P is in the range of 18 to 23, and in others, it is in the range of 17 to 23.

In still other embodiments, a metallic glass-forming alloy, or a metallic glass, can comprise at least Pt, Cu, P and Ag, where the weight fraction of Pt does not exceed 91 percent and the atomic fraction of Pt is in the range of 50 to 65 percent, the atomic fraction of Cu is in the range of 14 to 30 percent, the atomic fraction of P is in the range of 17 to 24, and the atomic fraction of Ag is in the range of 0.25 to 5. In some embodiments, the atomic fraction of Cu ranges from 14 to 25 atomic percent. In some embodiments, the atomic fraction of P is in the range of 17 to 22.

In further embodiments, a metallic glass-forming alloy, or a metallic glass, can comprise at least Pt, Cu, P and Ag, where the weight fraction of Pt does not exceed 91 percent and the atomic fraction of Pt is in the range of 57 to 63 percent, the atomic fraction of Cu is in the range of 16 to 23 percent, the atomic fraction of P is in the range of 18 to 23.5, and the atomic fraction of Ag is in the range of 0.25 to 5. In some embodiments, the atomic fraction of P is in the range of 19 to 21. In some embodiments, the atomic fraction of Ag is in the range of 0.25 to 2.5.

Description of Au-Bearing Pt—Cu—P Alloys and Metallic Glass Compositions

In another embodiment, the disclosure provides a metallic glass-forming alloy or metallic glass that comprises at least Pt, Cu, P and Au, where the atomic fraction of Pt is in the range of 45 to 75 percent and the weight fraction of Pt does not exceed 91 percent, the atomic fraction of Cu is in the range of 3 to 35 percent, the atomic fraction of P is in the range of 15 to 25, and the atomic fraction of Au is in the range of 0.05 to 5 percent.

Figure 14:
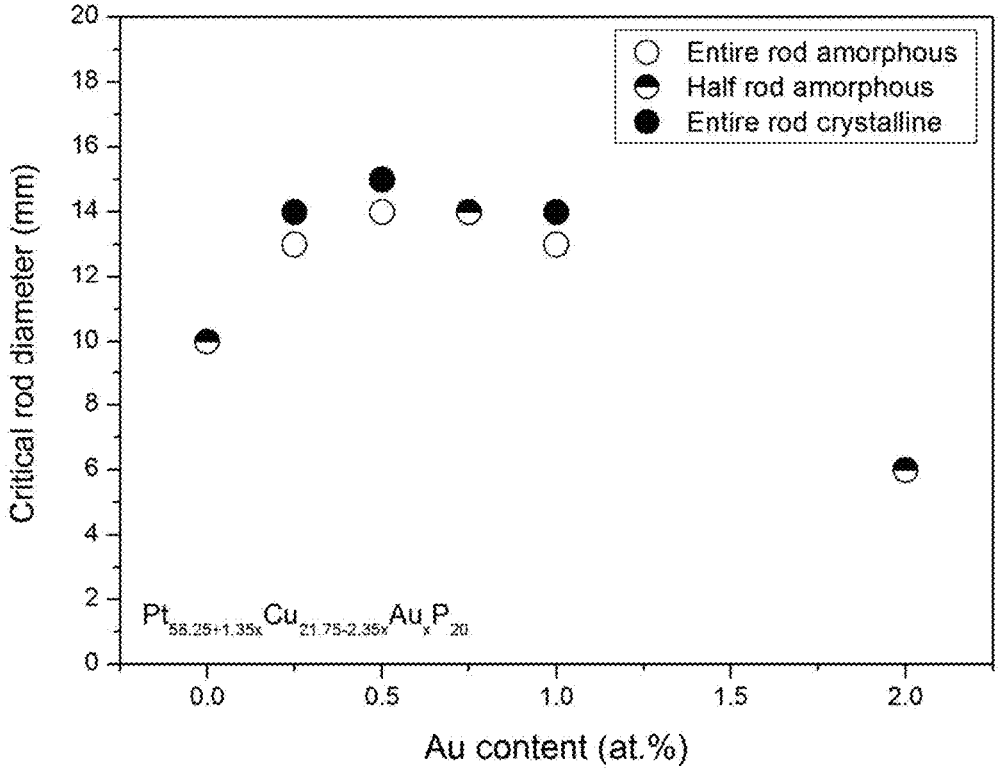
FIG. 14 provides a data plot showing the effect of varying the atomic fraction of Au on the glass forming ability of $Pt_{58.25+1.35x}Cu_{21.75-2.35x}Au_xP_{20}$ alloys for $0 \le x \le 2$.

Specific embodiments of metallic glasses formed of alloys with compositions according to the formula $Pt_{58.25+1.35x}Cu_{21.75-2.35x}Au_xP_{20}$ with Pt weight fraction of at least 85.0 percent satisfying the PT850 hallmark, are presented in Table 7. The critical rod diameters of the example alloys along with the Pt weight percentage are also listed in Table 7. FIG. 14 provides a data plot showing the effect of varying the Au atomic fraction x on the glass forming ability of the alloys according to the composition formula $Pt_{58.25+1.35x}Cu_{21.75-2.35x}Au_xP_{20}$.

TABLE 7

Sample metallic glasses demonstrating the effect of increasing the Au atomic concentration according to the formula $Pt_{58.25+1.35x}Cu_{21.75-2.35x}Au_xP_{20}$ on the glass forming ability, glass-transition, crystallization, solidus, and liquidus temperatures of the alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 6 | $Pt_{58.25}Cu_{21.75}P_{20}$ | 85.0 | 10 | 233.2 | 295.2 | 545.8 | 576.3 |
| 44 | $Pt_{58.5875}Cu_{21.1625}AU_{0.25}P_{20}$ | 85.0 | 13 | 233.5 | 295.7 | 539.6 | 578.9 |
| 45 | $Pt_{58.925}Cu_{20.575}AU_{0.5}P_{20}$ | 85.0 | 14 | 232.9 | 293.0 | 528.6 | 571.7 |
| 46 | $Pt_{59.2625}Cu_{19.9875}AU_{0.75}P_{20}$ | 85.0 | 14 | 231.0 | 295.3 | 529.8 | 568.8 |
| 47 | $Pt_{59.6}Cu_{19.4}AU_1P_{20}$ | 85.0 | 13 | 231.0 | 298.7 | 531.4 | 573.8 |
| 48 | $Pt_{60.95}Cu_{17.05}AU_2P_{20}$ | 85.0 | 6 | 230.0 | 288.3 | 531.2 | 572.6 |

As shown in Table 7 and FIG. 14, including Au in ternary Pt—Cu—P according to the composition formula $Pt_{58.25+1.35x}Cu_{21.75-2.35x}Au_xP_{20}$ enhances the glass forming ability. For example, the critical rod diameter increases from 10 mm for the Au-free alloy (Example 6) to 14 mm by adding just 0.5 atomic percent Au (Example 45), and then decreases back to 6 mm for alloy containing 2 atomic percent Au (Example 48). Hence, the critical rod diameter is shown to increase by 30% by increasing the atomic fraction of Au from 0 to just 0.5 percent.

Figure 15:
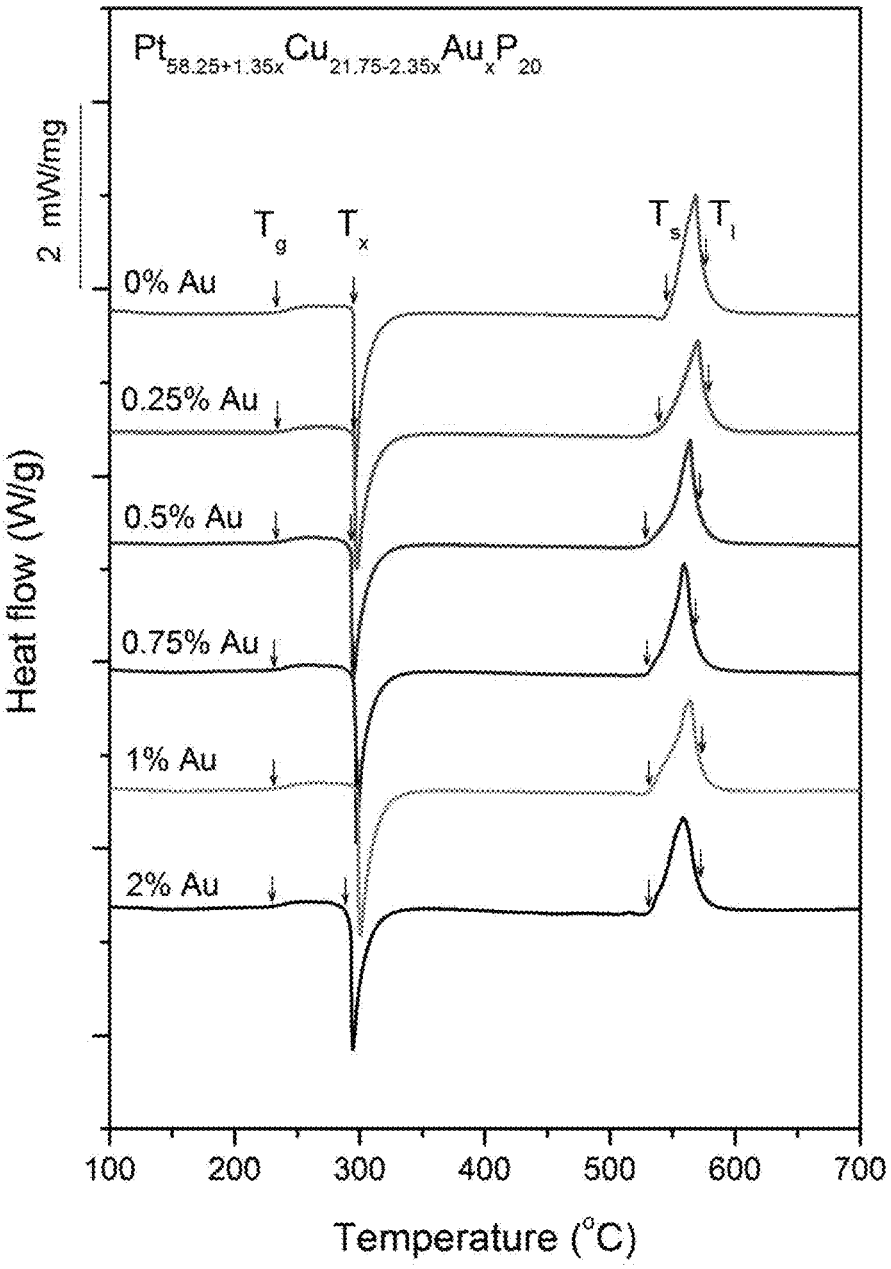
FIG. 15 provides calorimetry scans for sample metallic glasses $Pt_{58.25+1.35x}Cu_{21.75-2.35x}Au_xP_{20}$ in accordance with embodiments of the disclosure. The glass transition temperature $T_g$, crystallization temperature $T_x$, solidus temperature $T_s$, and liquidus temperature $T_l$ are indicated by arrows.

FIG. 15 provides calorimetry scans for sample metallic glasses $Pt_{58.25+1.35x}Cu_{21.75-2.35x}Au_xP_{20}$ in accordance with embodiments of the disclosure. The glass transition temperature $T_g$, crystallization temperature $T_x$, solidus temperature $T_s$, and liquidus temperature $T_l$ are indicated by arrows in FIG. 15, and are listed in Table 7. As seen in FIG. 15 and Table 7, $T_g$ slightly decreases monotonically from 233.2 to 230.0° C. by increasing the Au atomic fraction from 0 to 2 percent. On the other hand, $T_l$ appears to vary very slightly and non-monotonically with increasing the Au atomic fraction from 0 to 2 percent, revealing a slight dip at 0.5 to 0.75 atomic percent Au, where $T_l$ drops from 578.9 to 568.8° C. as the Au atomic fraction increases from 0.25 to 0.75 atomic percent. The trends in $T_g$ and $T_l$ suggest a reduced glass transition that increases around 0.5 to 0.75 atomic percent Au, which is consistent with a peak in glass forming ability at that composition (Table 7 and FIG. 14). The solidus temperature $T_s$ also appears to be lower for the Au-bearing alloys as compared to the Au-free alloy. $T_s$ and $T_l$ remain fairly close to each other as the atomic fraction of Au increases from 0 to 2 percent, which suggests that including Au in a Pt—Cu—P alloy does not disrupt the near-eutectic crystal structure of Pt—Cu—P. The crystallization temperature $T_x$ is shown to vary inconsistently with an increasing atomic fraction of Au, demonstrating a peak at 1 atomic percent Au.

In certain embodiments of this disclosure, an alloy or metallic glass according to the disclosure may comprise Au in an atomic fraction of up to 5 percent. In another embodiment, an alloy or metallic glass according to the disclosure may comprise Au in an atomic fraction in the range of 0.1 to 3 percent. In another embodiment, an alloy or metallic glass according to the disclosure may comprise Au in an atomic fraction in the range of 0.15 to 2.5 percent. In yet another embodiment, an alloy or metallic glass according to the disclosure may comprise Au in an atomic fraction in the range of 0.2 to 2 percent. In yet another embodiment, an alloy according to the disclosure may comprise Au in an atomic fraction in the range of 0.25 to 1.75 percent.

In other embodiments, a metallic glass-forming alloy, or a metallic glass, can comprises at least Pt, Cu, P and Au, where the weight fraction of Pt does not exceed 91 percent and the atomic fraction of Pt is in the range of 45 to 60 percent, the atomic fraction of Cu is in the range of 15 to 35 percent, the atomic fraction of P is in the range of 16 to 24, and the atomic fraction of Au is in the range of 0.1 to 3. In some embodiments, the atomic fraction of P is in the range of 16 to 23, in others it is in the range of 17 to 23, and in still others P ranges from 18 to 24. In some embodiments, the atomic fraction of Cu is in the range of 15 to 30 percent, while in others, the Cu content ranges from 20 to 30 atomic percent. In some embodiments, the atomic fraction of Au is in the range of 0.1 to 2.5 atomic percent.

In yet other embodiments, a metallic glass-forming alloy, or a metallic glass, can comprise at least Pt, Cu, P and Au, where the weight fraction of Pt does not exceed 91 percent and the atomic fraction of Pt is in the range of 55 to 70 percent, the atomic fraction of Cu is in the range of 3 to 25 percent, the atomic fraction of P is in the range of 17 to 25, and the atomic fraction of Au is in the range of 0.1 to 2.5. In some embodiments, the atomic fraction of Cu ranges from 5 to 20 percent, while in others, the Cu content ranges from 5 to 25 atomic percent. In some embodiments, the atomic fraction of P is in the range of 17 to 23, and in others, it is in the range of 18 to 24. In some embodiments, the atomic fraction of Au is in the range of 0.1 to 1.75 atomic percent.

In still other embodiments, a metallic glass-forming alloy, or a metallic glass, can comprise at least Pt, Cu, P and Au, where the weight fraction of Pt does not exceed 91 percent and the atomic fraction of Pt is in the range of 50 to 65 percent, the atomic fraction of Cu is in the range of 15 to 30 percent, the atomic fraction of P is in the range of 17 to 24, and the atomic fraction of Au is in the range of 0.1 to 2. In some embodiments, the atomic fraction of Cu is in the range of 16 to 27 percent. In some embodiments, the atomic fraction of P is in the range of 17 to 23.

In further embodiments, a metallic glass-forming alloy, or a metallic glass, can comprise at least Pt, Cu, P and Au, where the weight fraction of Pt does not exceed 91 percent and the atomic fraction of Pt is in the range of 57 to 63 percent, the atomic fraction of Cu is in the range of 16 to 23 percent, the atomic fraction of P is in the range of 18 to 23.5, and the atomic fraction of Au is in the range of 0.25 to 1.75. In some embodiments, the atomic fraction of Cu is in the range of 18 to 25, while in others Cu ranges from 16 to 23 atomic percent. In some embodiments, the atomic fraction of P is in the range of 18.55 to 23.5, while in others P ranges from 19 to 23 atomic percent.

Description of B- and Ag-Bearing Pt—Cu—P Alloys and Metallic Glass Compositions

In certain embodiments, alloys or metallic glasses of the disclosure may include both B and Ag, in other embodiments, the alloys or metallic glasses may include B and Au, in other embodiments, the alloys or metallic glasses may include Ag and Au, and in yet other embodiments, the alloys or metallic glasses may include B and Ag and Au.

In one embodiment, the disclosure provides a metallic glass-forming alloy or metallic glass that comprises at least Pt, Cu, P, B, and Ag, having a composition represented by the formula (subscripts demote atomic percentages):

$$Pt_{(100-a-b-c-d-e)}Cu_aAg_bP_cB_d$$

where:

a ranges from 5 to 30 b is up to 7.5 c ranges from 16 to 22 d ranges from 0.25 to 5 and the weight fraction of Pt is between 74 and 91 percent.

In another embodiment, a ranges from 5 to 30, b ranges from 0.25 to 7.5, c ranges from 16 to 22, d is up to 5, and the Pt weight fraction is between 74 and 91 percent.

In one embodiment of the disclosure, Ag is included in $Pt_{58}Cu_{22}P_{19}B_1$ in a manner such that the Pt weight fraction is at least 85.0 percent and the PT850 hallmark is satisfied.

Figure 16:
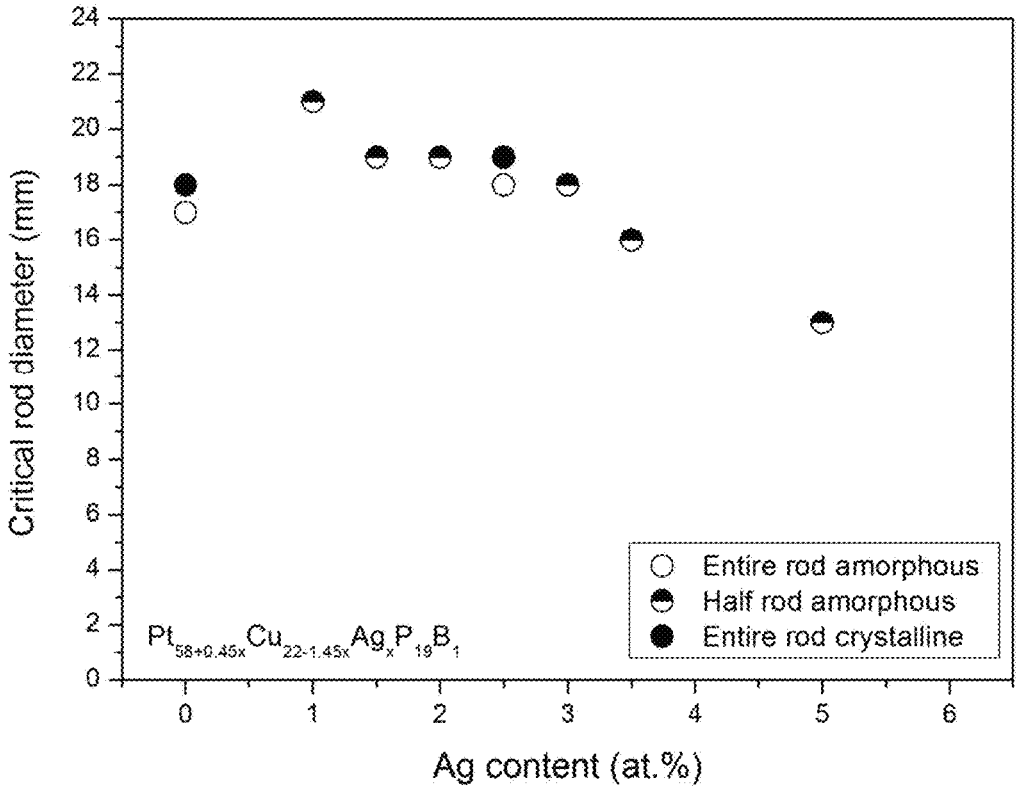
FIG. 16 provides a data plot showing the effect of varying the atomic percent of Ag on the glass forming ability of $Pt_{58+0.45x}Cu_{22-1.45x}Ag_xP_{19}B_1$ alloys for $0 \le x \le 5$.

Specific embodiments of metallic glasses formed of alloys with compositions according to the formula $Pt_{58+0.45x}Cu_{22-1.45x}Ag_xP_{19}B_1$ where x varies in the range of 0 to 5, which describes Pt—Cu—Ag—P—B alloys with Pt weight fraction of at least 85.0 percent satisfying the PT850 hallmark, are presented in Table 8. The critical rod diameters of the example alloys along with the Pt weight percentage are also listed in Table 8. FIG. 16 provides a data plot showing the effect of varying the Ag atomic fraction x on the glass forming ability of the alloys according to the composition formula $Pt_{58+0.45x}Cu_{22-1.45x}Ag_xP_{19}B_1$.

TABLE 8

Sample metallic glasses demonstrating the effect of increasing the Ag atomic concentration according to the formula $Pt_{58+0.45x}Cu_{22-1.45x}Ag_xP_{19}B_1$ on the glass forming ability, glass-transition, crystallization, solidus, and liquidus temperatures of the alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 7 | $Pt_{58}Cu_{22}P_{19}B_1$ | 85.0 | 17 | 237.4 | 276.9 | 538.4 | 578.1 |
| 49 | $Pt_{58.45}Cu_{20.55}Ag_1P_{19}B_1$ | 85.0 | 21 | 237.9 | 279.3 | 538.5 | 575.7 |
| 50 | $Pt_{58.7}Cu_{19.8}Ag_{1.5}P_{19}B_1$ | 85.0 | 19 | 240.0 | 279.7 | 538.4 | 572.2 |
| 51 | $Pt_{58.9}Cu_{19.1}Ag_2P_{19}B_1$ | 85.0 | 19 | 240.7 | 282.9 | 537.2 | 648.1 |
| 52 | $Pt_{59.125}Cu_{18.375}Ag_{2.5}P_{19}B_1$ | 85.0 | 18 | 242.8 | 291.7 | 536.8 | 669.1 |
| 53 | $Pt_{59.35}Cu_{17.65}Ag_3P_{19}B_1$ | 85.0 | 18 | 245.8 | 288.2 | 546.5 | 694.5 |
| 54 | $Pt_{59.575}Cu_{16.925}Ag_{3.5}P_{19}B_1$ | 85.0 | 16 | 247.0 | 289.1 | 547.0 | 713.1 |
| 55 | $Pt_{60.25}Cu_{14.75}Ag_5P_{19}B_1$ | 85.0 | 13 | 253.2 | 289.7 | 549.5 | 746.4 |

As shown in Table 8 and FIG. 16, including Ag in quaternary Pt—Cu—P—B according to the composition formula $Pt_{58+0.45x}Cu_{22-1.45x}Ag_xP_{19}B_1$ enhances the glass forming ability. For example, the critical rod diameter increases from 17 mm for the Ag-free alloy (Example 7) to 21 mm for the alloys containing 1 atomic percent Ag (Examples 49), decreases gradually to about 18 mm and below when the Ag atomic fractions increases beyond 3 percent, and then decreases further reaching 13 mm for the alloy containing 5 atomic percent Ag (Example 55). Hence, the critical rod diameter is shown to increase by about 10% by increasing the atomic fraction of Ag from 0 to 1-2 percent. The critical rod diameter is larger than 19 mm when Ag is included in an atomic fraction ranging from 1 to 2 percent.

Figure 17:
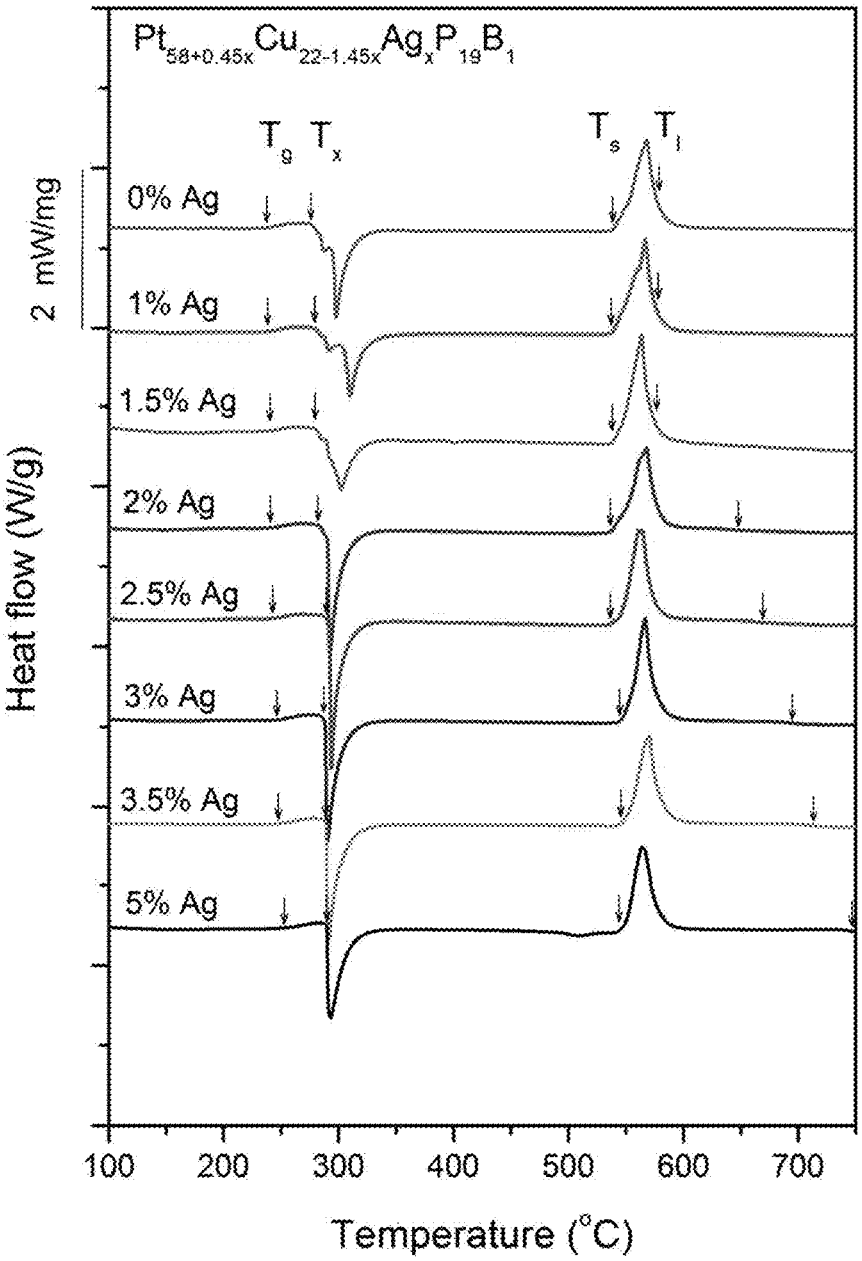
FIG. 17 provides calorimetry scans for sample metallic glasses $Pt_{58+0.45x}Cu_{22-1.45x}Ag_xP_{19}B_1$ in accordance with embodiments of the disclosure. The glass transition temperature $T_g$, crystallization temperature $T_x$, solidus temperature $T_s$, and liquidus temperature $T_l$ are indicated by arrows.

FIG. 17 provides calorimetry scans for sample metallic glasses $Pt_{58+0.45x}Cu_{22-1.45x}Ag_xP_{19}B_1$ in accordance with embodiments of the disclosure. The glass transition temperature $T_g$, crystallization temperature $T_x$, solidus temperature $T_s$, and liquidus temperature $T_l$ are indicated by arrows in FIG. 17, and are listed in Table 8. As seen in FIG. 17 and Table 8, $T_g$ increases significantly and monotonically from 237.4 to 253.2° C. by increasing the Ag atomic fraction from 0 to 5 percent. The increase in $T_g$ is about 20 degrees over 5 atomic percent increase in Ag, or about 4 degrees per atomic percent increase in Ag. On the other hand, $T_l$ appears to vary very slightly with increasing the Ag atomic fraction from 0 to 1.5 percent, ranging between about 571 and 578° C. However, just like in the Pt—Cu—Ag—P system, at higher Ag concentrations, a very subtle melting event emerges at higher temperatures having an associated enthalpy that is considerably lower than that of the broad melting event. Specifically, at Ag atomic fractions between 2 and 5 percent, a very shallow endothermic event appears and advances to higher temperatures in the range of about 650 to 750° C. as the Ag content is increased. The emergence of this subtle endothermic event is consistent with the drop in critical rod diameter observed around 2 atomic percent Ag (FIG. 16). Overall, the trends in $T_g$ and $T_l$ are consistent with in critical rod diameter going through a peak near 1 atomic percent Ag, in accordance with the reduced glass transition concept (Table 8 and FIG. 16). The solidus temperature $T_s$ appears to vary very slightly with increasing the Ag atomic fraction from 0 to 5 percent, revealing a slight dip at 2 atomic percent Ag. $T_s$ and $T_l$ remain fairly close to each other as the atomic fraction of Ag increases from 0 to 1.5 percent, which suggests that including Ag in a Pt—Cu—P—B alloy in atomic fractions up to 1.5 percent does not disrupt the near-eutectic crystal structure of Pt—Cu—P—B. The crystallization temperature $T_x$ is shown to increase monotonically when the Ag content increases in the range of 0 to 2.5 atomic percent, and remains high when the Ag content increases further.

In certain embodiments of this disclosure, a B-bearing alloy or metallic glass according to the disclosure may also comprise Ag in an atomic fraction of up to 7.5 percent. In another embodiment, an alloy or metallic according to the disclosure may comprise Ag in an atomic fraction in the range of 0.1 to 5 percent. In another embodiment, an alloy or metallic glass according to the disclosure may comprise Ag in an atomic fraction in the range of 0.25 to 4 percent. In yet another embodiment, an alloy or metallic glass according to the disclosure may comprise Ag in an atomic fraction in the range of 0.5 to 2.5 percent. In yet other embodiments, alloys or metallic glasses may include B and Ag and Au. In one embodiment, the disclosure is directed to an alloy capable of forming a metallic glass having a composition represented by the following formula (subscripts denote atomic percentages):

$$Pt_{(100-a-b-c-d-e)}Cu_aAg_bAu_cP_dB_e$$

where:

a ranges from 3 to 35;

b is up to 7.5;

c is up to 3;

d ranges from 14 to 26;

e is up to 5; and at least one of b, c, and e is at least 0.1; wherein the Pt weight fraction is between 74 and 91 percent. In another embodiment, a ranges from 5 to 30, b is up to 7.5, c is up to 3, d ranges from 17 to 24, e ranges from 0.2 to 5, and the Pt weight fraction is between 74 and 91 percent. In yet another embodiment, a ranges from 5 to 30, b ranges from 0.25 to 7.5, c is up to 3, d ranges from 18 to 25, e is up to 5, and the Pt weight fraction is between 74 and 91 percent. In still another embodiment, a ranges from 5 to 35, b is up to 7.5, c ranges from 0.05 to 3, d ranges from 18 to 25, e is up to 5, and the Pt weight fraction is between 74 and 91 percent.

Addition of Ni and/or Co

In various embodiments of the disclosure, Ni and/or Co may be included in the alloys or metallic glasses of the disclosure in appropriate atomic fractions that still satisfy the PT850 hallmark.

In one embodiment of the disclosure, Ni may be included in $Pt_{60}Cu_{20}P_{19}B_1$ in a in a manner such that the Pt weight fraction is at least 85.0 percent and the PT850 hallmark is satisfied.

Figure 18:
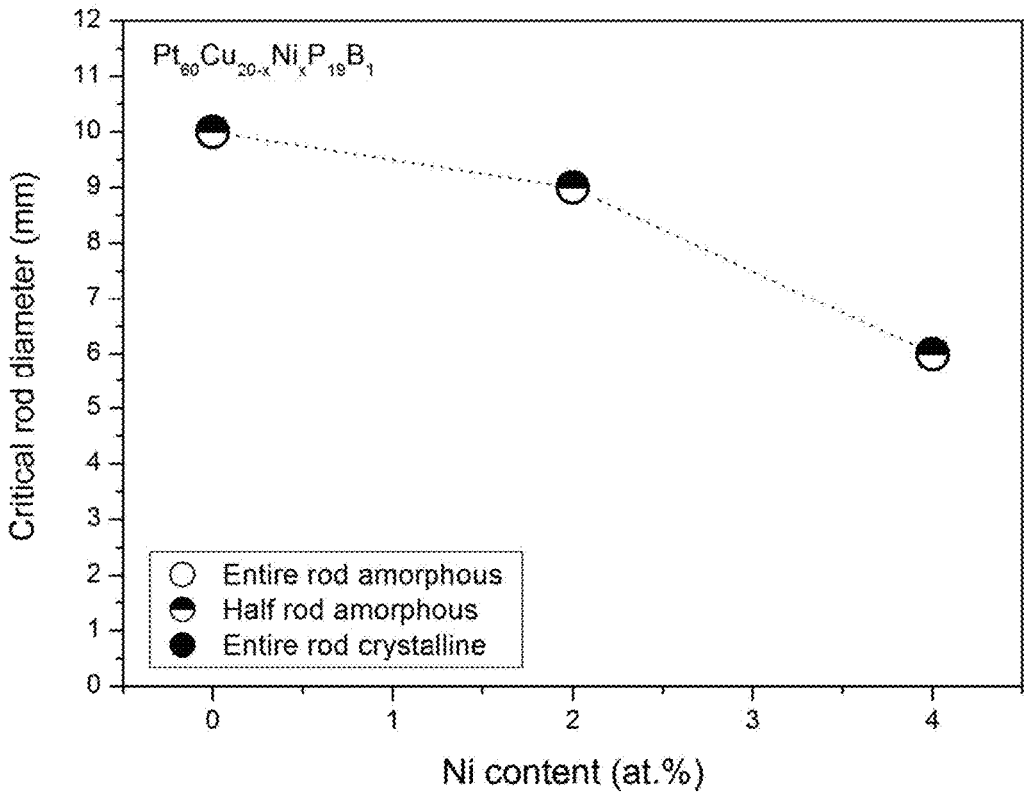
FIG. 18 provides a data plot showing the effect of varying the atomic percent of Ni on the glass forming ability of $Pt_{60}Cu_{20-x}Ni_xP_{19}B_1$ alloys for $0 \leq x \leq 4$.

Specific embodiments of metallic glasses formed of alloys with compositions according to the formula $Pt_{60}Cu_{20-x}Ni_xP_{19}B_1$ where x varies in the range of 0 to 4, which describes Pt—Cu—Ni—P—B alloys with Pt weight fraction of at least 85.0 percent satisfying the PT850 hallmark, are presented in Table 9. The critical rod diameters of the example alloys along with the Pt weight percentage are also listed in Table 9. FIG. 18 provides a data plot showing the effect of varying the Ni atomic fraction x on the glass forming ability of the alloys according to the composition formula $Pt_{60}Cu_{20-x}Ni_xP_{19}B_1$.

As shown in Table 9 and FIG. 18, including Ni in quaternary Pt—Cu—P—B according to the composition formula $Pt_{60}Cu_{20-x}Ni_xP_{19}B_1$ degrades the glass forming ability. Specifically, the critical rod diameter decreases from 10 mm for the Ni-free alloy (Example 3) to 9 mm for the alloy containing 2 atomic percent Ni (Example 56), and then decreases further to 6 mm for the alloy containing 4 atomic percent Ni (Example 57).

Figure 19:
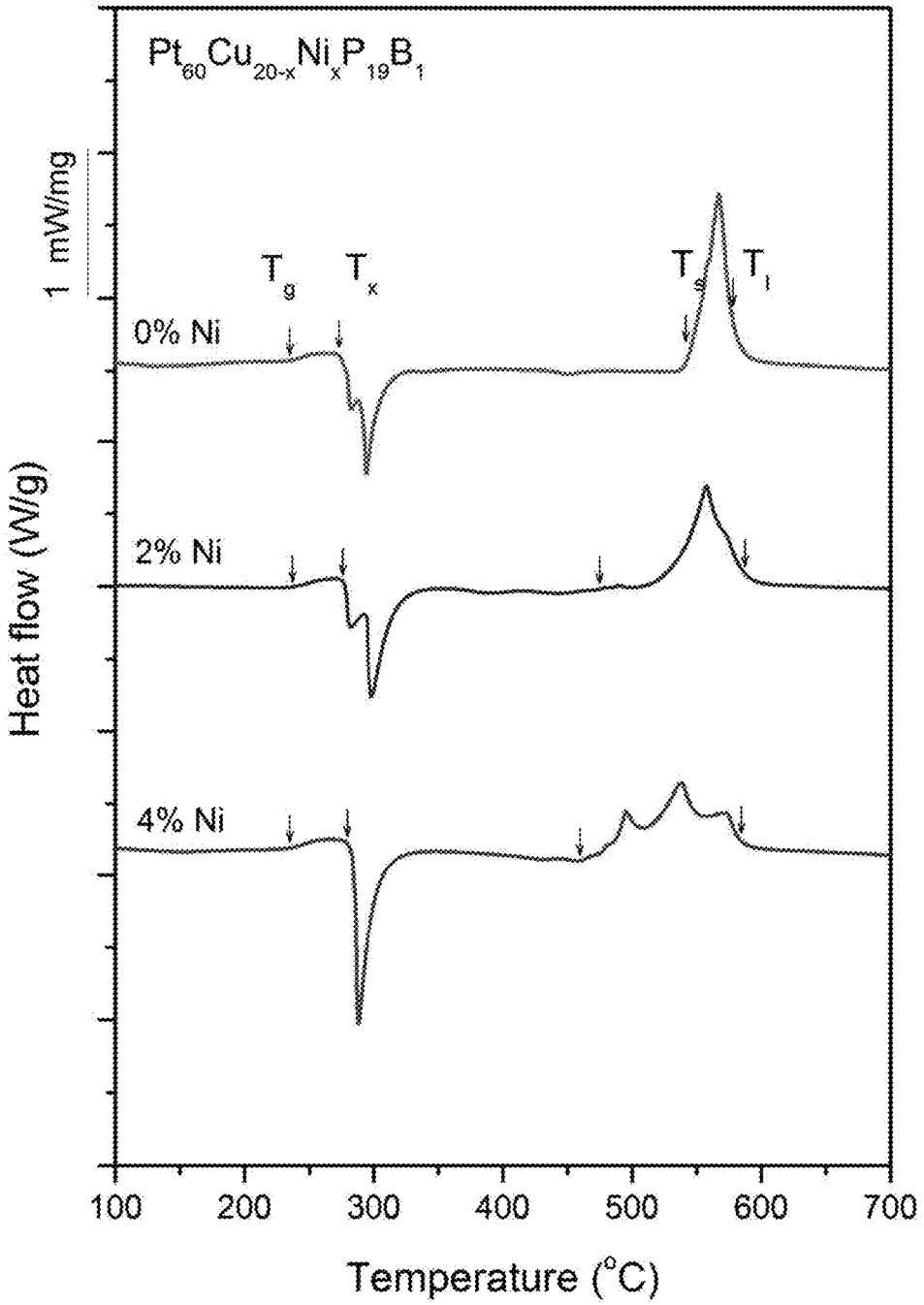
FIG. 19 provides calorimetry scans for sample metallic glasses $Pt_{60}Cu_{20-x}Ni_xP_{19}B_1$ in accordance with embodiments of the disclosure. The glass transition temperature $T_g$, crystallization temperature $T_x$, solidus temperature $T_s$, and liquidus temperature $T_l$ are indicated by arrows.

FIG. 19 provides calorimetry scans for sample metallic glasses $Pt_{60}Cu_{20-x}Ni_xP_{19}B_1$ in accordance with embodiments of the disclosure. The glass transition temperature $T_g$, crystallization temperature $T_x$, solidus temperature $T_s$, and liquidus temperature $T_l$ are indicated by arrows in FIG. 19, and are listed in Table 9. As seen in FIG. 19 and Table 9, $T_g$ increases very slightly from 235.0 to 236.6° C. by increasing the Ni atomic fraction from 0 to 2 percent, while it decreases back to 234.6° C. when the Ni atomic fraction increases to 4 percent. On the other hand, $T_l$ increases from 578.3 to 588.1° C. by increasing the Ni atomic fraction from 0 to 2 atomic percent, and remains high at 588.2° C. when the Ni atomic fraction is increased to 4 atomic percent. The trends in $T_g$ and $T_l$ suggest a reduced glass transition that gradually decreases with increasing Ni content, which is consistent with a gradually decreasing glass forming ability shown in Table 9 and FIG. 18. On the other hand, the solidus temperature $T_s$ decreases monotonically with increasing Ni content, dropping from 541.6 to 474.7° C. when the Ni atomic fraction is increased from 0 to 2 atomic percent, and from 474.7 to 459.5° C. when the Ni atomic fraction is increased from 2 to 4 atomic percent. Such a decrease in $T_s$ while $T_l$ is increasing suggests a very complex melting process involving a crystal structure with multiple phases, in contrast to the Ni-free alloys where $T_s$ and $T_l$ are much closer thereby suggesting a near-eutectic crystal structure. The multi-phase crystal structure of the Ni-bearing alloys may be contributing to the lower glass-forming ability of these alloys as compared to the Ni-free alloys, which demonstrate a near-eutectic crystal structure. Lastly, the crystallization temperature $T_x$ is shown to increase monotonically but gradually as the Ni content is increased.

In another embodiment of the disclosure, Ni may be included in $Pt_{58.7}Cu_{20.3}Ag_1P_{20}$ in a in a manner such that the Pt weight fraction is at least 85.0 percent and the PT850 hallmark is satisfied.

Specific embodiments of metallic glasses formed of alloys with compositions according to the formula $Pt_{58.7}Cu_{20.3-x}Ni_xAg_1P_{20}$ where x varies in the range of 0 to 2, which describes Pt—Cu—Ag—Ni—P alloys with Pt weight fraction of at least 85.0 percent satisfying the PT850 hallmark, are presented in Table 10. The critical rod diameters of the example alloys along with the Pt weight percentage

TABLE 9

Sample metallic glasses demonstrating the effect of increasing the Ni atomic concentration with an accompanying reduction in the atomic concentration of Cu on the glass forming ability, glass-transition, crystallization, solidus, and liquidus temperatures of the $Pt_{60}Cu_{20-x}Ni_xP_{19}B_1$ alloy

Figure 20:
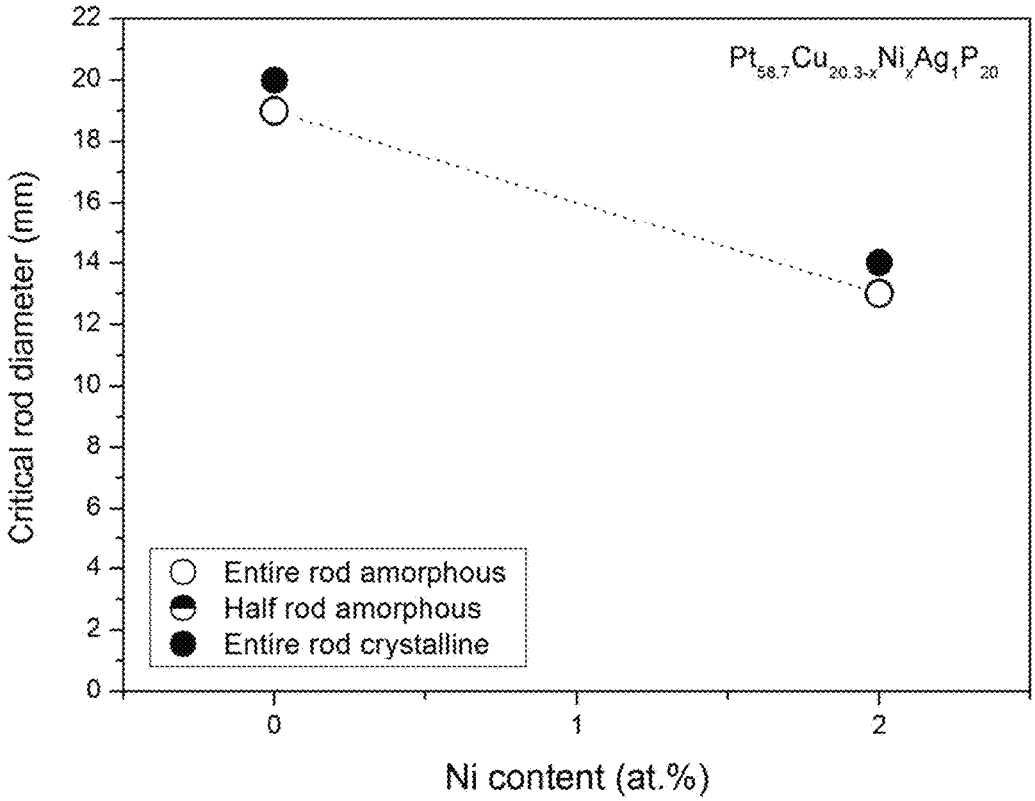
FIG. 20 provides a data plot showing the effect of varying the atomic percent of Ni on the glass forming ability of $Pt_{58.7}Cu_{20.3-x}Ni_xAg_1P_{20}$ alloys for $0 \leq x \leq 2$.

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 3 | $Pt_{60}Cu_{20}P_{19}B_1$ | 86.22 | 10 | 235.0 | 272.8 | 541.6 | 578.3 |
| 56 | $Pt_{60}Cu_{18}Ni_2P_{19}B_1$ | 86.28 | 9 | 236.6 | 275.6 | 474.7 | 588.1 |
| 57 | $Pt_{60}Cu_{16}Ni_4P_{19}B_1$ | 86.35 | 6 | 234.6 | 279.7 | 459.5 | 585.2 |

are also listed in Table 10. FIG. 20 provides a data plot showing the effect of varying the Ni atomic fraction x on the glass forming ability of the alloys according to the composition formula $Pt_{58.7}Cu_{20.3-x}Ni_xAg_1P_{20}$.

TABLE 10

Sample metallic glasses demonstrating the effect of increasing the Ni atomic concentration with an accompanying reduction in the atomic concentration of Cu on the glass forming ability, glass-transition, crystallization, solidus, and liquidus temperatures of the $Pt_{58.7}Cu_{20.3-x}Ni_xAg_1P_{20}$ alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 22 | $Pt_{58.7}Cu_{20.3}Ag_1P_{20}$ | 85.0 | 19 | 237.8 | 300.9 | 543.8 | 581.4 |
| 58 | $Pt_{58.7}Cu_{18.3}Ni_2Ag_1P_{20}$ | 85.1 | 13 | 232.9 | 301.1 | 477.6 | 564.3 |

As shown in Table 10 and FIG. 20, including Ni in quaternary Pt—Cu—Ag—P according to the composition formula $Pt_{58.7}Cu_{20.3-x}Ni_xAg_1P_{20}$ considerably degrades the glass forming ability. Specifically the critical rod diameter decreases from 19 mm for the Ni-free alloy (Example 22) to 13 mm for the alloy containing 2 atomic percent Ni (Example 58).

Figure 21:
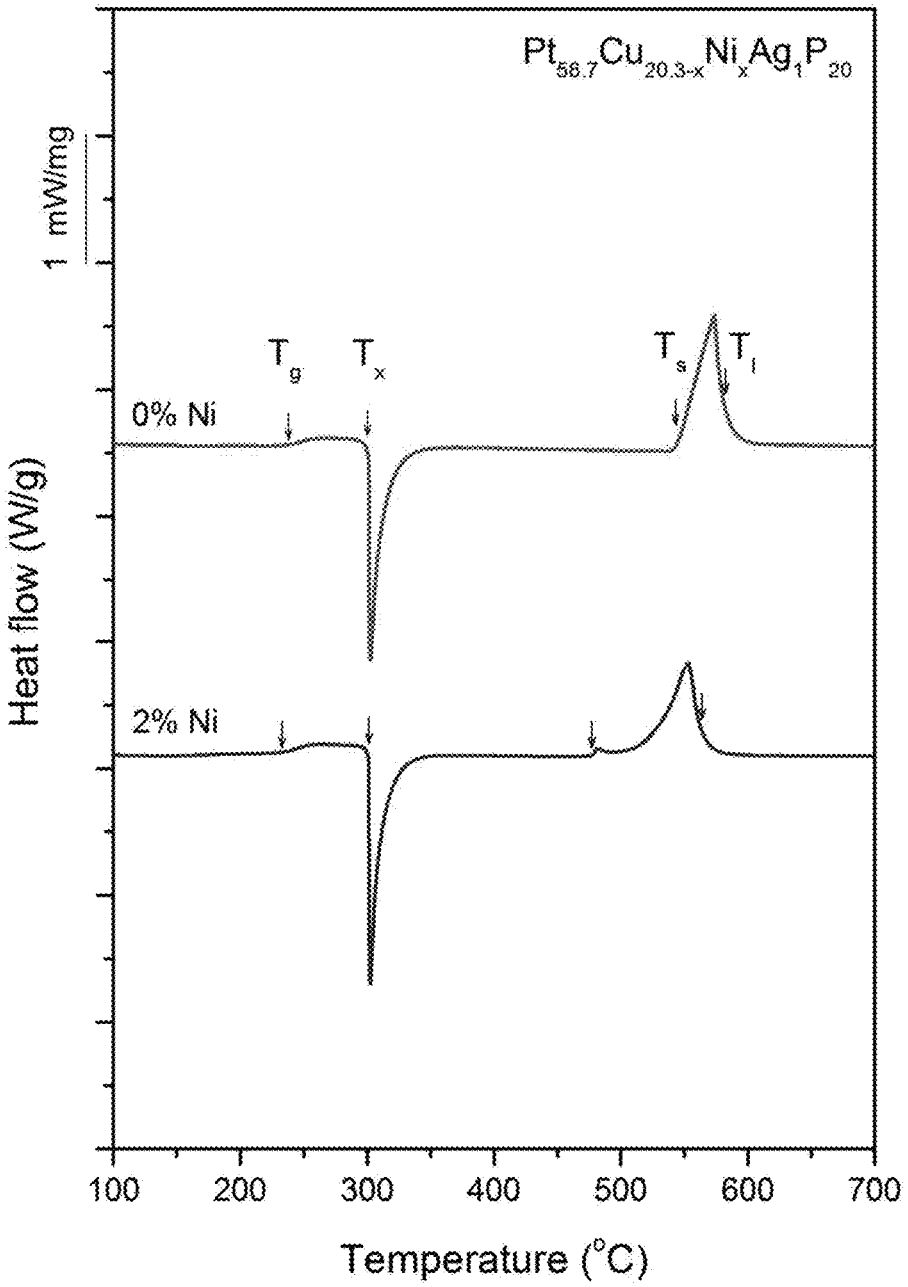
FIG. 21 provides calorimetry scans for sample metallic glasses $Pt_{58.7}Cu_{20.3-x}Ni_xAg_1P_{20}$ in accordance with embodiments of the disclosure. The glass transition temperature $T_g$, crystallization temperature $T_x$, solidus temperature $T_s$, and liquidus temperature $T_l$ are indicated by arrows.

FIG. 21 provides calorimetry scans for sample metallic glasses $Pt_{58.7}Cu_{20.3-x}Ni_xAg_1P_{20}$ in accordance with embodiments of the disclosure. The glass transition temperature $T_g$, crystallization temperature $T_x$, solidus temperature $T_s$, and liquidus temperature $T_l$ are indicated by arrows in FIG. 21, and are listed in Table 10. As seen in FIG. 21 and Table 10, $T_g$ decreases considerably from 237.8 to 232.9° C. by increasing the Ni atomic fraction from 0 to 2 percent. $T_l$ also decreases significantly from 581.4 to 564.3° C. by increasing the Ni atomic fraction from 0 to 2 atomic percent. The decrease in $T_l$ however does not appear to offset the decrease in $T_g$ with a net effect of decreasing the glass forming ability. On the other hand, the solidus temperature $T_s$ decreases with increasing the Ni content, dropping from 543.8 to 477.6° C. when the Ni atomic fraction is increased from 0 to 2 atomic percent. Such a decrease in $T_s$ while $T_l$ decreases much less suggests a very complex melting process involving a crystal structure with multiple phases, in contrast to the Ni-free alloys where $T_s$ and $T_l$ are much closer thereby suggesting a near-eutectic crystal structure. The multi-phase crystal structure of the Ni-bearing alloys may be contributing to the lower glass-forming ability of these alloys as compared to the Ni-free alloys, which demonstrate a near-eutectic crystal structure. Lastly, the crystallization temperature $T_x$ is shown to remain roughly constant as the Ni content is increased.

In yet another embodiment of the disclosure, Co may be included in $Pt_{60}Cu_{20}P_{19}B_1$ in a in a manner such that the Pt weight fraction is at least 85.0 percent and the PT850 hallmark is satisfied.

Figure 22:
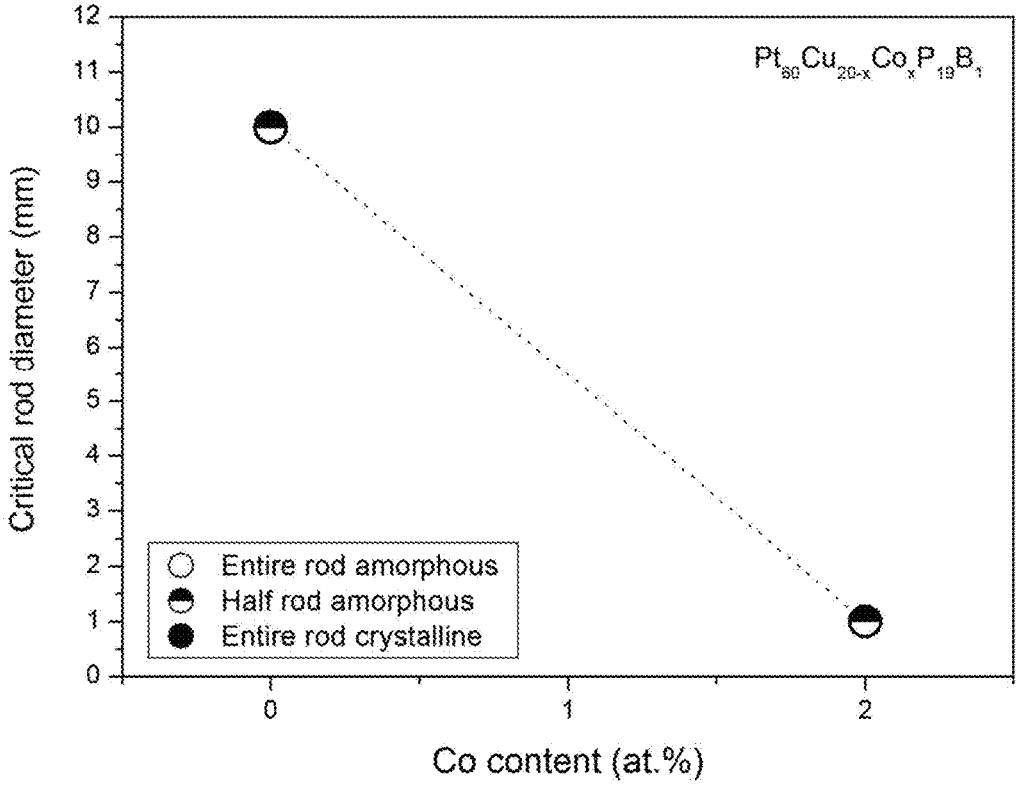
FIG. 22 provides a data plot showing the effect of varying the atomic percent of Co on the glass forming ability of $Pt_{60}Cu_{20-x}Co_xP_{19}B_1$ alloys for $0 \leq x \leq 2$.

Specific embodiments of metallic glasses formed of alloys with compositions according to the formula $Pt_{60}Cu_{20-x}Co_xP_{19}B_1$ where x varies in the range of 0 to 2, which describes Pt—Cu—Co—P—B alloys with Pt weight fraction of at least 85.0 percent satisfying the PT850 hallmark, are presented in Table 11. The critical rod diameters of the example alloys along with the Pt weight percentage are also listed in Table 11. FIG. 22 also provides a data plot showing the effect of varying the Co atomic fraction x on the glass forming ability of the alloys according to the composition formula $Pt_{60}Cu_{20-x}Co_xP_{19}B_1$.

TABLE 11

Sample metallic glasses demonstrating the effect of increasing the Co atomic concentration with an accompanying reduction in the atomic concentration of Cu on the glass forming ability, glass-transition, crystallization, solidus, and liquidus temperatures of the $Pt_{60}Cu_{20-x}Co_xP_{19}B_1$ alloy

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 3 | $Pt_{60}Cu_{20}P_{19}B_1$ | 86.22 | 10 | 235.0 | 272.8 | 541.6 | 578.3 |
| 59 | $Pt_{60}Cu_{18}Co_2P_{19}B_1$ | 86.28 | 1 | 237.5 | 287.0 | 539.8 | 670.1 |

As shown in Table 11 and FIG. 22, including Co in quaternary Pt—Cu—P—B according to the composition formula $Pt_{60}Cu_{20-x}Co_xP_{19}B_1$ degrades the glass forming ability. Specifically the critical rod diameter decreases very sharply from 10 mm for the Co-free alloy (Example 3) to 1 mm for the alloy containing 2 atomic percent Co (Example 59).

Figure 23:
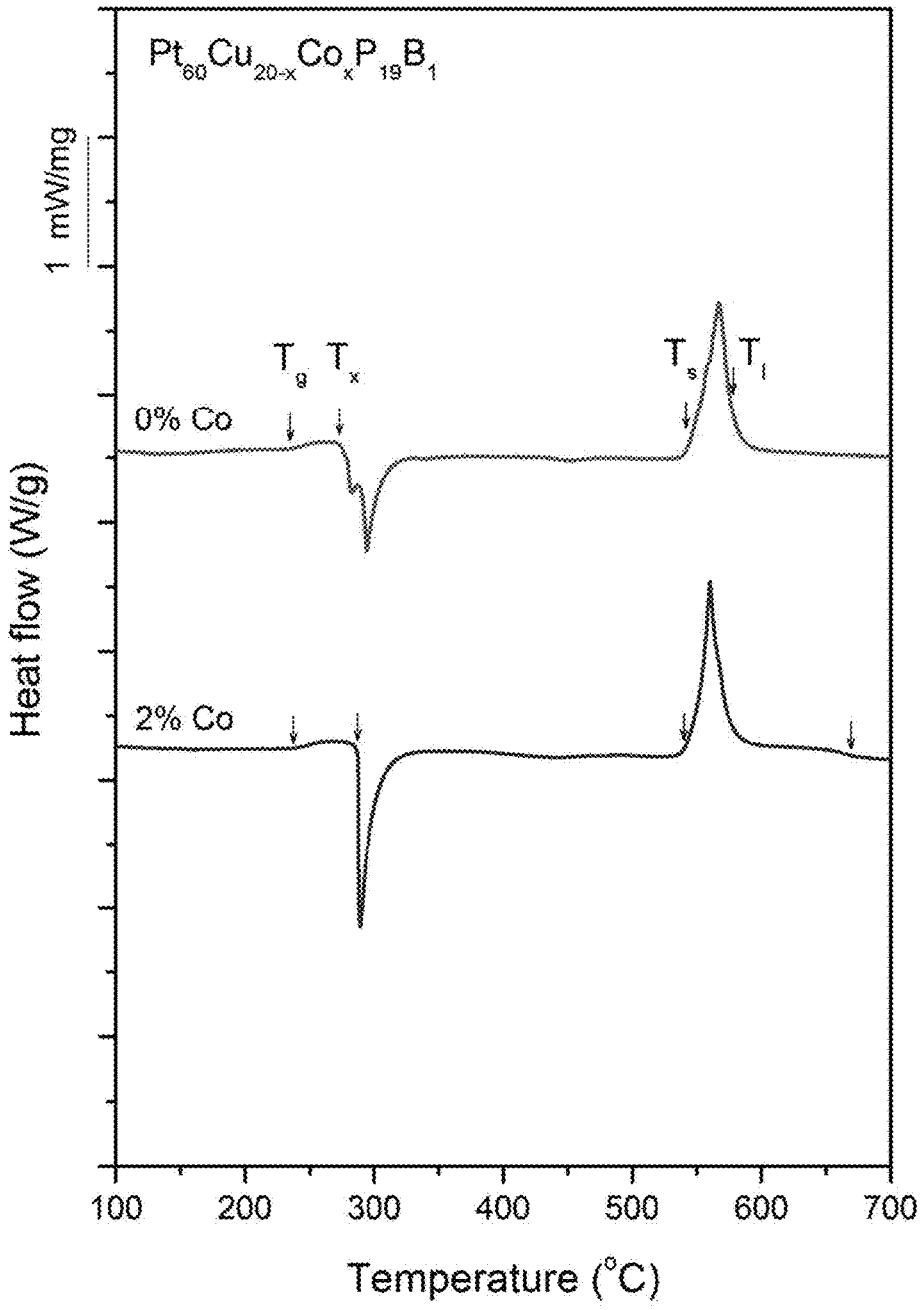
FIG. 23 provides calorimetry scans for sample metallic glasses $Pt_{60}Cu_{20-x}Co_xP_{19}B_1$ in accordance with embodiments of the disclosure. The glass transition temperature $T_g$, crystallization temperature $T_x$, solidus temperature $T_s$, and liquidus temperature $T_l$ are indicated by arrows.

FIG. 23 provides calorimetry scans for sample metallic glasses $Pt_{60}Cu_{20-x}Co_xP_{19}B_1$ in accordance with embodiments of the disclosure. The glass transition temperature $T_g$, crystallization temperature $T_x$, solidus temperature $T_s$, and liquidus temperature $T_l$ are indicated by arrows in FIG. 23, and are listed in Table 11. As seen in FIG. 23 and Table 11, $T_g$ is increased very slightly from 235.0 to 237.5° C. by increasing the Co atomic fraction from 0 to 2 percent. On the other hand, $T_l$ is increased from 578.3 to 670.1° C. by increasing the Co atomic fraction from 0 to 2 atomic percent. That is, $T_l$ increases by more than 90° C. over a 2 atomic percent increase in Co content, which represents more than 45° C. per atomic percent increase in Co content. This increase in $T_l$ is very high, and may be the case for the precipitous drop in glass-forming ability associated with the Co addition. Specifically, the trends in $T_g$ and $T_l$ suggest a reduced glass transition that decreases with increasing Co content, which is consistent with the sharp drop in glass forming ability shown in Table 11 and FIG. 22. The sharp increase in $T_l$ and associated drop in reduced glass transition suggest that the equilibrium crystal structure of the alloy includes a phase that is thermodynamically very stable and thus nucleates rather easily in the undercooled liquid during quenching of the molten alloy. On the other hand, the solidus temperature $T_s$ remains constant or very slightly decreases with increasing the Co content. Lastly, the crystallization temperature $T_x$ is shown to increase substantially from 272.8 to 287° C. as the atomic fraction of Co is increased from 0 to 2 percent.

Hence, from Tables 9-11 and FIGS. 18-23 it can be concluded that including Ni and/or Co in B-bearing Pt—Cu—P alloys degrades the glass forming ability of this alloy system, especially when the combined Ni and/or Co atomic fraction is 2 percent or higher. In certain embodiments of disclosure, Pt—Cu—P alloys or metallic glasses bearing B may comprise Ni and/or Co in a combined atomic fraction of less than 2 percent. In other embodiments, Pt—Cu—P alloys or metallic glasses bearing Ag may comprise Ni and/or Co in a combined atomic fraction of less than 2 percent. In yet other embodiments, Pt—Cu—P alloys or metallic glasses bearing Au may comprise Ni and/or Co in a combined atomic fraction of less than 2 percent. In some embodiments, Ni and/or Co may be included in a combined atomic fraction of up to 1.75 percent. In other embodiments, Ni and/or Co may be included in a combined atomic fraction of up to 1.5 percent. In yet other embodiments, Ni and/or Co may be included in a combined atomic fraction of up to 1.25 percent. In yet other embodiments, Ni and/or Co may be included in a combined atomic fraction of up to 1 percent. In yet other embodiments, Ni and/or Co may be included in a combined atomic fraction of up to 0.75 percent. In yet other embodiments, Ni and/or Co may be included in a combined atomic fraction of up to 0.5 percent. In yet other embodiments, Ni and/or Co may be included in a combined atomic fraction of either less than 2 percent, or less than 25 percent of the Cu atomic fraction, whichever is lower, Ni and/or Co may be included in a combined atomic fraction that is less than 5% of the Cu atomic fraction.

Aside from their negative effect on the glass forming ability, Ni and Co can be undesirable elements to include in Pt-based alloys for use in jewelry, watches, or other ornamental luxury goods because of the allergenic reactions associated with Ni and Co. Allergenic reactions associated with Ni are particularly common. Specifically, hypersensitivity to Ni is the most common (affects approximately 14% of the population), followed by Co and Cr (see for example D. A. Basketter, G. Briatico-Vangosa, W. Kaestner, C. Lally, and W. J Bontinck, "Nickel, Cobalt and Chromium in Consumer Products: a Role in Allergic Contact Dermatitis?" *Contact Dermatitis,* 28 (1993), pp. 15-25, the reference of which is incorporated herein in its entirety).

Other Elemental Additions

In certain embodiments, elements other than Ni and Co may be included in the alloys or metallic glasses of the disclosure.

In certain embodiments of the disclosure, Si may be included as replacement for P. In some embodiments, Si may contribute to enhance the glass forming ability. In one embodiment Si may be included in atomic fractions of up to 3 atomic percent, while in another embodiment up to 2 atomic percent, and yet in another embodiment up to 1 atomic percent. Sb and Ge may also be included in a manner similar to Si.

In certain embodiments of the disclosure, Pd may be included as replacement for Pt and/or Cu. In some embodiments, Pd may contribute to enhance the glass forming ability. In one embodiment Pd may be included in atomic fractions of up to 5 atomic percent, while in another embodiment up to 2 atomic percent, and yet in other embodiment up to 1 atomic percent. Rh and Ir may have benefits similar to Pd, and may also be included in a manner similar to Pd.

In certain embodiments of the disclosure, Fe may be included as a replacement for Pt and/or Cu. In some embodiments, Fe may contribute to enhance the glass forming ability. In one embodiment Fe may be included in atomic fractions of up to 3 atomic percent, while in another embodiment up to 2 atomic percent, and yet in other embodiment up to 1 atomic percent. Cr, Mo, and Mn may be included in a manner similar to Fe.

Other Compositions According to Embodiments of the Disclosure

Figure 24:
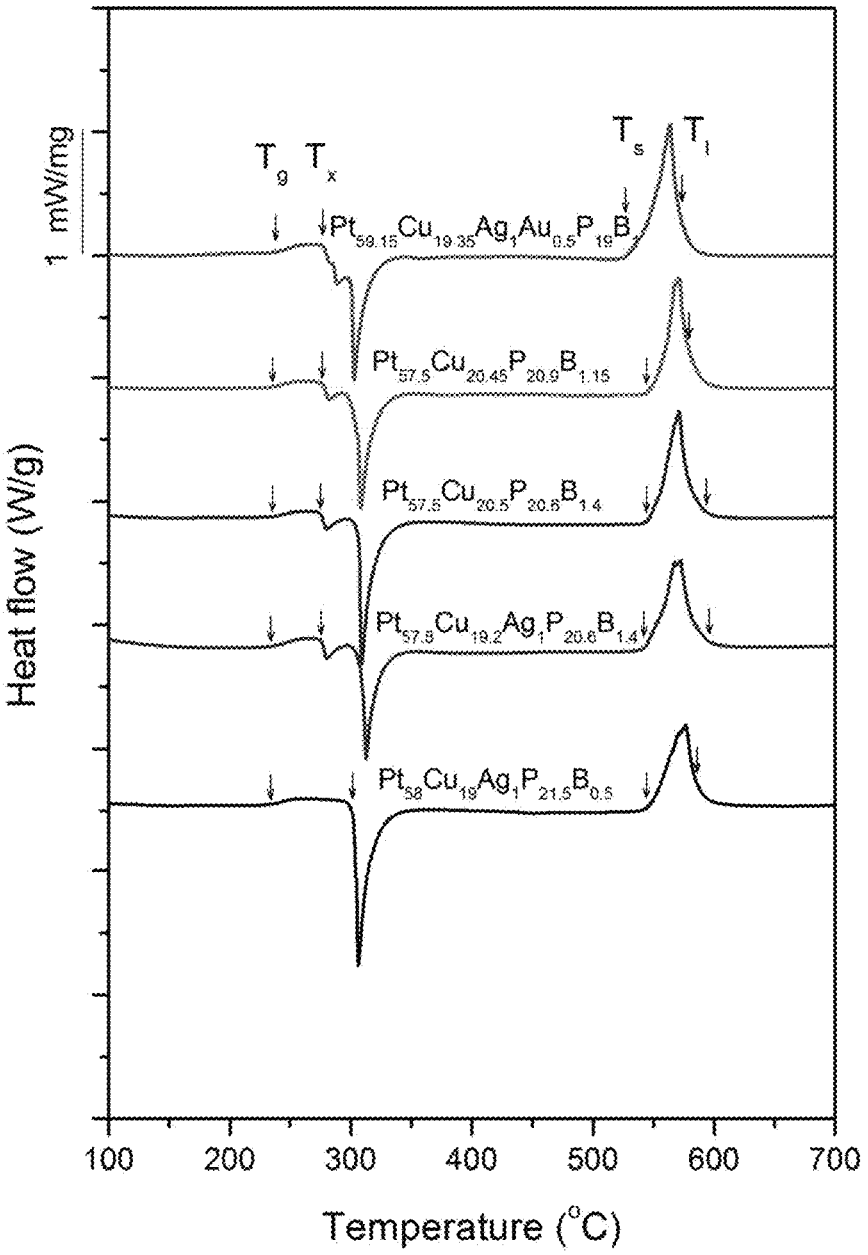
FIG. 24 provides calorimetry scans for the sample metallic glasses listed in Table 10 in accordance with embodiments of the disclosure. The glass transition temperature $T_g$, crystallization temperature $T_x$, solidus temperature $T_s$, and liquidus temperature $T_l$ are indicated by arrows.

Other compositions according to embodiments with the disclosure that satisfy the PT850 hallmark are listed in Table 12, along with the associated critical rod diameters. Calorimetry scans of the alloys of Table 12 are presented in FIG. 24. The glass transition temperature $T_g$, crystallization temperature $T_x$, solidus temperature $T_s$, and liquidus temperature $T_l$ are indicated by arrows in FIG. 24, and are listed in Table 12.

TABLE 12

Alloy compositions according to embodiments of the disclosure that satisfy the PT850 hallmark

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 60 | $Pt_{58.3}Cu_{20.2}Ag_1P_{19.5}B_1$ | 85.0 | 21 | 235.2 | 275.8 | 540.3 | 577.7 |
| 61 | $Pt_{58.7}Cu_{20.8}Au_{0.5}P_{19}B_1$ | 85.0 | 18 | 235.4 | 277.9 | 524.5 | 572.3 |
| 62 | $Pt_{59.15}Cu_{19.35}Ag_1Au_{0.5}P_{19}B_1$ | 85.0 | 18 | 237.8 | 277.2 | 524.5 | 571.9 |
| 63 | $Pt_{58.5}Cu_{20.5}Pd_1P_{19}B_1$ | 85.0 | 16 | 236.4 | 273.1 | 540.1 | 574.0 |
| 64 | $Pt_{57.55}Cu_{20.45}P_{20.9}B_{1.1}$ | 85.1 | 19 | 236.3 | 284.3 | 544.5 | 583.2 |
| 65 | $Pt_{57.5}Cu_{20.45}P_{20.9}B_{1.15}$ | 85.1 | 21 | 235.5 | 276.9 | 543.2 | 579.0 |
| 66 | $Pt_{57.5}Cu_{20.5}P_{20.8}B_{1.2}$ | 85.1 | 21 | 233.5 | 279.9 | 543.3 | 578.3 |
| 67 | $Pt_{57.5}Cu_{20.5}P_{20.7}B_{1.3}$ | 85.1 | 21 | 233.8 | 274.5 | 543.4 | 592.7 |
| 68 | $Pt_{57.5}Cu_{20.5}P_{20.6}B_{1.4}$ | 85.2 | 21 | 235.2 | 275.2 | 544.7 | 593.7 |
| 69 | $Pt_{57.5}Cu_{20.5}P_{20.5}B_{1.5}$ | 85.2 | 19 | 235.5 | 272.7 | 543.5 | 599.2 |

TABLE 12-continued

Alloy compositions according to embodiments of the disclosure that satisfy the PT850 hallmark

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 70 | $Pt_{57.95}Cu_{19}Ag_1P_{20.9}B_{1.15}$ | 85.1 | 25 | 237.9 | 283.2 | 542.3 | 581.1 |
| 71 | $Pt_{57.8}Cu_{19.2}Ag_1P_{20.6}B_{1.4}$ | 85.1 | 25 | 234.0 | 275.9 | 542.0 | 596.4 |
| 72 | $Pt_{57.9}Cu_{18.9}Ag_{1.2}P_{20.6}B_{1.4}$ | 85.1 | 25 | 236.8 | 276.0 | 540.2 | 590.2 |
| 73 | $Pt_{58.6}Cu_{20.4}Ag_1P_{19.5}B_{0.5}$ | 85.0 | 19 | 236.3 | 299.6 | 543.7 | 579.0 |
| 74 | $Pt_{58}Cu_{19}Ag_1P_{21.5}B_{0.5}$ | 85.0 | 18 | 233.8 | 301.7 | 546.6 | 585.7 |

Figure 25:
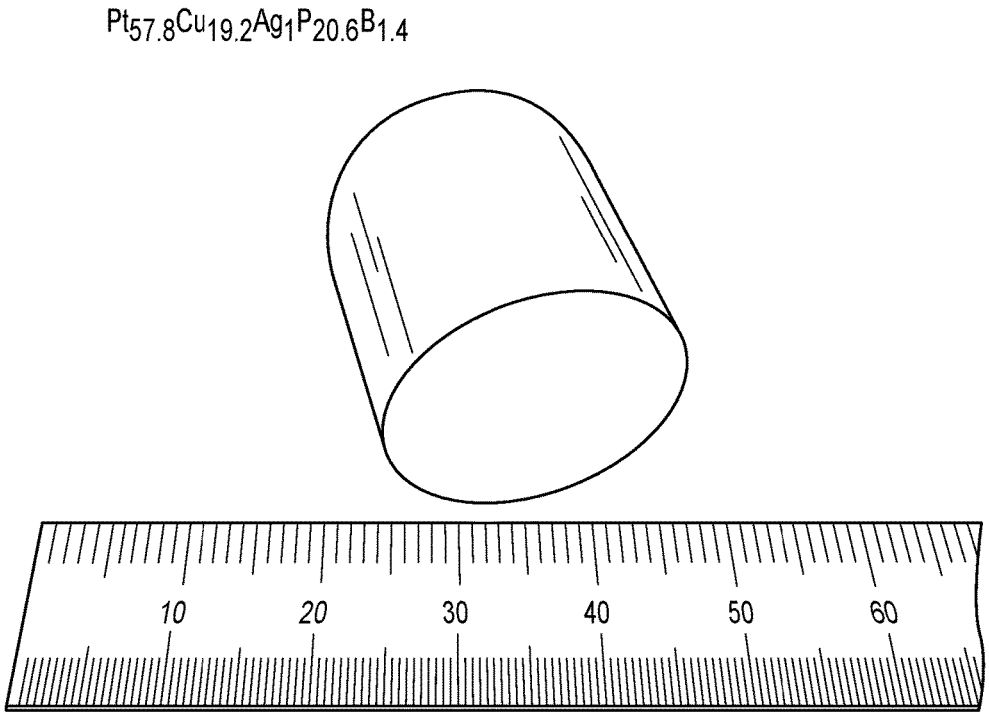
FIG. 25 provides an image of a 22-mm diameter metallic glass rod with composition $Pt_{57.8}Cu_{19.2}Ag_1P_{20.6}B_{1.4}$ (Example 71).
Figure 26:
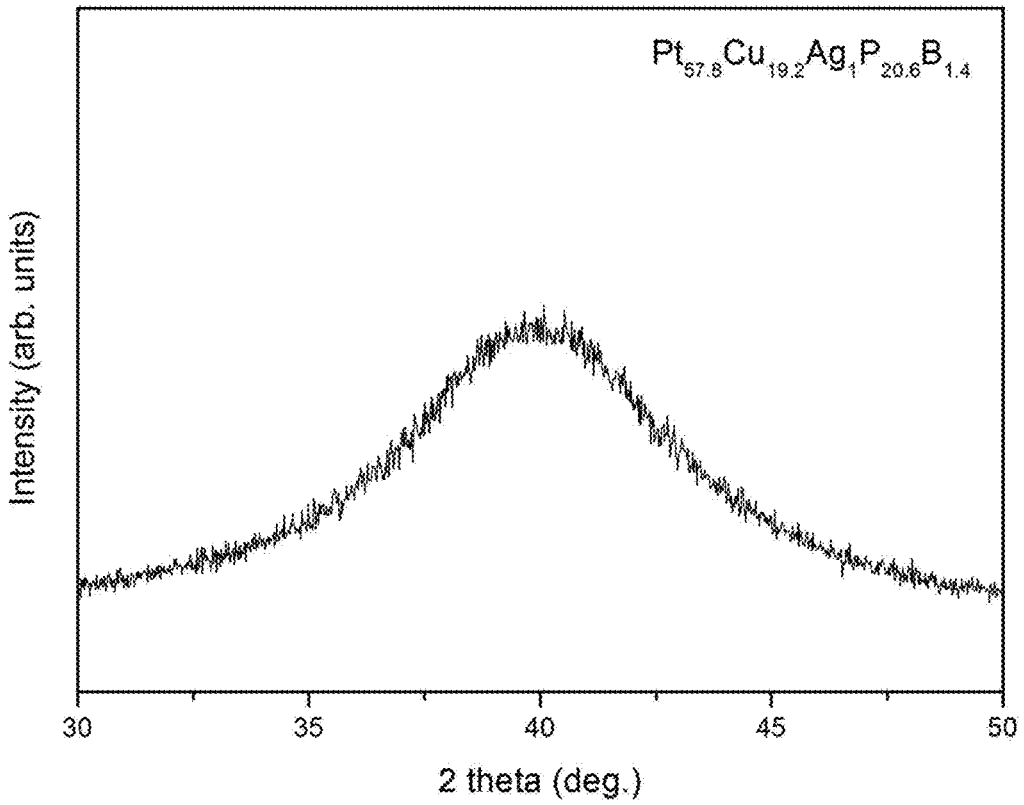
FIG. 26 provides an x-ray diffractogram verifying the amorphous structure of a 22-mm diameter metallic glass rod with composition $Pt_{57.8}Cu_{19.2}Ag_1P_{20.6}B_{1.4}$ (Example 71)

FIG. 25 provides an image of a 22-mm diameter metallic glass rod with composition $Pt_{57.8}Cu_{19.2}Ag_1P_{20.6}B_{1.4}$ (Example 71). FIG. 26 provides an x-ray diffractogram verifying the amorphous structure of a 22-mm diameter metallic glass rod with composition $Pt_{57.8}Cu_{19.2}Ag_1P_{20.6}B_{1.4}$ (Example 71).

Other compositions according to embodiments the disclosure that satisfy the PT850 hallmark in addition to those listed in Table 12 include $Pt_{57.4}Cu_{20.6}P_{20.8}B_{1.2}$, $Pt_{57.4}Cu_{20.6}P_{20.6}B_{1.4}$, $Pt_{57.3}Cu_{20.5}P_{20.8}B_{1.4}$, $Pt_{57.4}Cu_{20.6}P_{20.7}B_{1.3}$, $Pt_{57}Cu_{20}P_{21.6}B_{1.4}$, $Pt_{57.2}Cu_{20.3}P_{21.1}B_{1.4}$, $Pt_{57.7}Cu_{21.3}P_{19.6}B_{1.4}$, $Pt_{57.5}Cu_{20.5}P_{21.5}B_{0.5}$, $Pt_{57.5}Cu_{19.8}Ag_{0.5}P_{20.8}B_{1.4}$, $Pt_{57.8}Cu_{19}Ag_1P_{20.8}B_{1.4}$, $Pt_{58}Cu_{18.6}Ag_{1.4}P_{20.6}B_{1.4}$, $Pt_{58}Cu_{19.5}Au_{0.5}P_{20.6}B_{1.4}$, and $Pt_{57.6}Cu_{19.9}Pd_{0.5}P_{20.6}B_{1.4}$.

Figure 27:
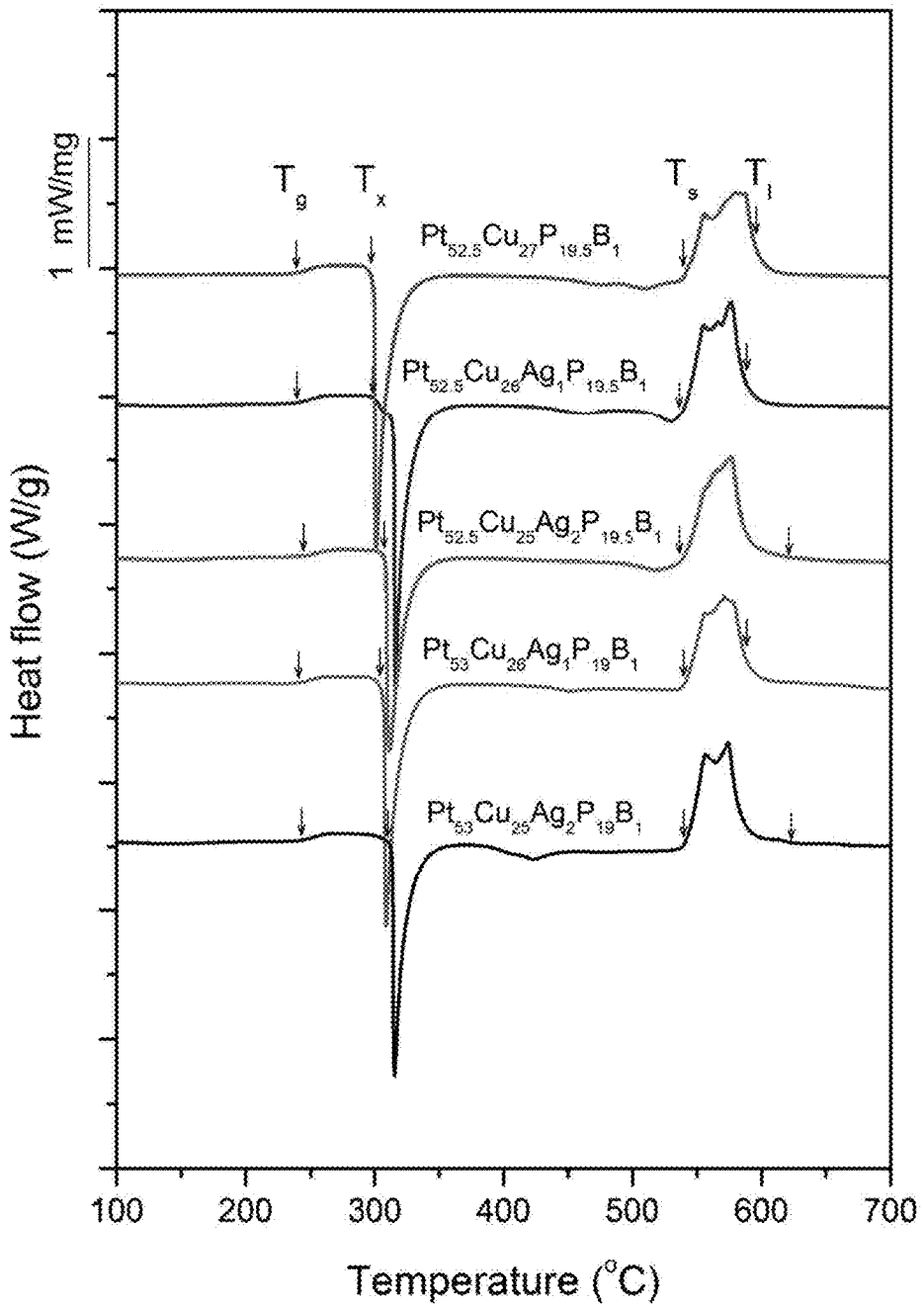
FIG. 27 provides calorimetry scans for the sample metallic glasses listed in Table 11 in accordance with embodiments of the disclosure. The glass transition temperature $T_g$, crystallization temperature $T_x$, solidus temperature $T_s$, and liquidus temperature $T_l$ are indicated by arrows.

Other compositions according to embodiments with the disclosure that satisfy the PT800 hallmark are listed in Table 13, along with the associated critical rod diameters. Calorimetry scans of the alloys of Table 13 are presented in FIG. 27. The glass transition temperature $T_g$, crystallization temperature $T_x$, solidus temperature $T_s$, and liquidus temperature $T_l$ are indicated by arrows in FIG. 27, and are listed in Table 13.

TABLE 13

Alloy compositions according to embodiments of the disclosure that satisfy the PT800 hallmark

| Example | Composition | Pt wt. % | Critical Rod Diameter [mm] | $T_g$ (° C.) | $T_x$ (° C.) | $T_s$ (° C.) | $T_l$ (° C.) |
|---|---|---|---|---|---|---|---|
| 75 | $Pt_{52.5}Cu_{27}P_{19.5}B_1$ | 81.5 | >30 | 239.2 | 299.7 | 538.9 | 598.0 |
| 76 | $Pt_{52.5}Cu_{26}Ag_1P_{19.5}B_1$ | 81.2 | >30 | 239.0 | 299.8 | 536.5 | 586.9 |
| 77 | $Pt_{52.5}Cu_{25}Ag_2P_{19.5}B_1$ | 80.9 | >30 | 244.6 | 308.7 | 539.0 | 618.6 |
| 78 | $Pt_{53}Cu_{26}Ag_1P_{19}B_1$ | 81.4 | >30 | 240.3 | 306.6 | 540.2 | 589.9 |
| 79 | $Pt_{53}Cu_{25}Ag_2P_{19}B_1$ | 81.1 | >30 | 242.8 | 313.3 | 541.7 | 620.4 |

Glass Forming Ability by Casting in a Metal Mold

The glass forming ability of the alloys according to the disclosure is investigated when the alloys in the molten state are cast in a metal mold. The critical plate thickness of various alloys according to the disclosure when processed by pour-casting in a copper mold is presented in Table 14.

Figure 28:
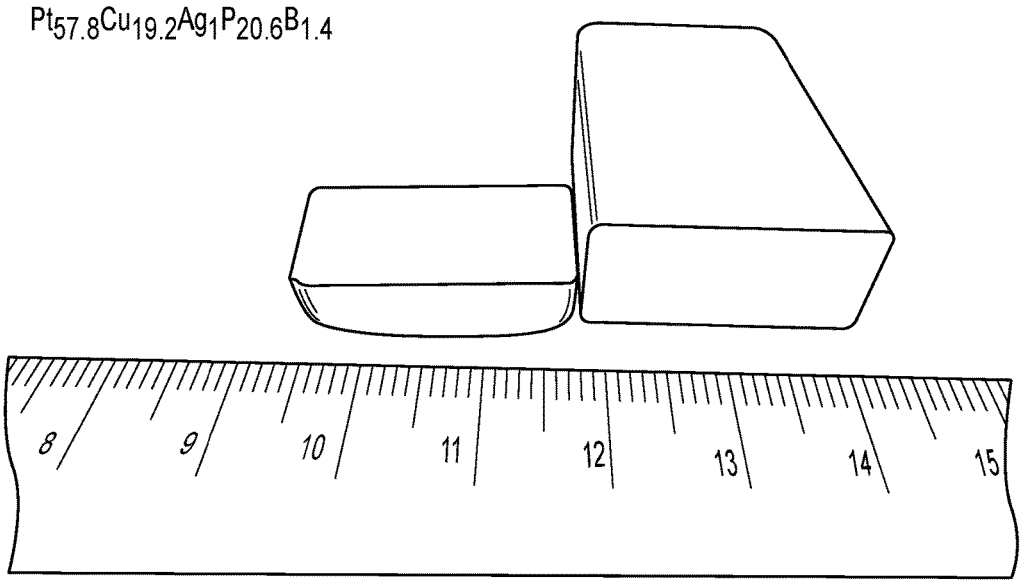
FIG. 28 provides an image of a 10-mm thick metallic glass plate with composition $Pt_{57.8}Cu_{19.2}Ag_1P_{20.6}B_{1.4}$ (Example 71).
Figure 29:
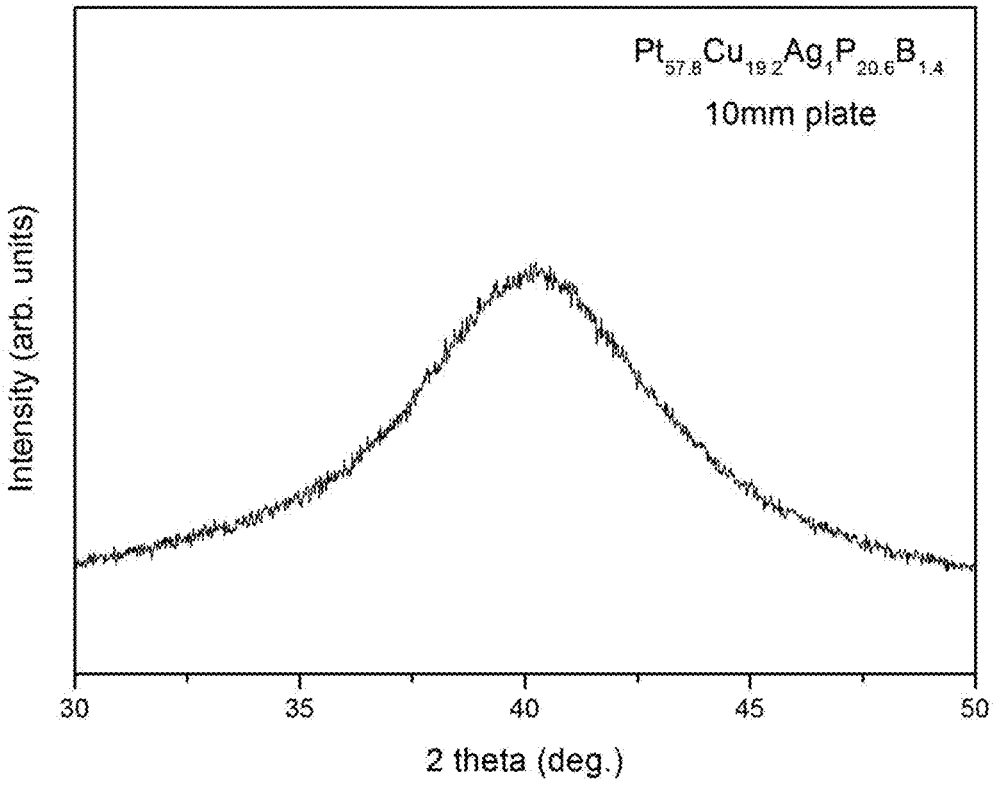
FIG. 29 provides an x-ray diffractogram verifying the amorphous structure of a 10-mm thick metallic glass plate with composition $Pt_{57.8}Cu_{19.2}Ag_1P_{20.6}B_{1.4}$ (Example 71).

FIG. 28 provides an image of a 10-mm thick metallic glass plate with composition $Pt_{57.8}Cu_{19.2}Ag_1P_{20.6}B_{1.4}$ (Example 71). FIG. 29 provides an x-ray diffractogram verifying the amorphous structure of a 10-mm thick metallic glass plate with composition $Pt_{57.8}Cu_{19.2}Ag_1P_{20.6}B_{1.4}$ (Example 71).

TABLE 14

Critical plate thickness of alloys according to embodiments of the disclosure when processed by pour casting in a copper mold

| Example | Composition | Pt wt. % | Critical Plate thickness [mm] |
|---|---|---|---|
| 17 | $Pt_{57.7}Cu_{21.3}P_{20}B_1$ | 85.0 | 7 |
| 18 | $Pt_{57.5}Cu_{21}P_{20.5}B_1$ | 85.0 | 7 |
| 19 | $Pt_{57.35}Cu_{20.65}P_{21}B_1$ | 85.0 | 8 |
| 20 | $Pt_{57.2}Cu_{20.3}P_{21.5}B_1$ | 85.0 | 7 |
| 64 | $Pt_{57.55}Cu_{20.45}P_{20.9}B_{1.1}$ | 85.1 | 9 |
| 65 | $Pt_{57.5}Cu_{20.45}P_{20.9}B_{1.15}$ | 85.1 | 11 |
| 66 | $Pt_{57.5}Cu_{20.5}P_{20.8}B_{1.2}$ | 85.1 | 10 |
| 67 | $Pt_{57.5}Cu_{20.5}P_{20.7}B_{1.3}$ | 85.1 | 10 |
| 68 | $Pt_{57.5}Cu_{20.5}P_{20.6}B_{1.4}$ | 85.1 | 10 |
| 69 | $Pt_{57.5}Cu_{20.5}P_{20.5}B_{1.5}$ | 85.1 | 9 |
| 70 | $Pt_{57.95}Cu_{19}Ag_1P_{20.9}B_{1.15}$ | 85.1 | 10 |
| 71 | $Pt_{57.8}Cu_{19.2}Ag_1P_{20.6}B_{1.4}$ | 85.1 | 10 |
| 72 | $Pt_{57.9}Cu_{18.9}Ag_{1.2}P_{20.6}B_{1.4}$ | 85.1 | 11 |

Hardness of the Sample Alloys

The Vickers hardness values of sample metallic glasses according to the disclosure are listed in Table 15. The Vickers hardness values of the sample metallic glasses satisfying the PT900 hallmark are about 400 Kgf/mm$^2$, those satisfying the PT850 hallmark are greater than 420 Kgf/mm$^2$, while those satisfying the PT800 hallmark are at least 460 Kgf/mm$^2$.

TABLE 15

Vickers hardness of sample metallic glasses according to embodiments of the disclosure.

| Example | Composition | Pt wt. % | Vickers Hardness (Kgf/mm$^2$) |
|---|---|---|---|
| 1 | $Pt_{60}Cu_{20}P_{20}$ | 86.1 | 421.9 ± 1.2 |
| 3 | $Pt_{60}Cu_{20}P_{19}B_1$ | 86.2 | 421.7 ± 3.4 |
| 16 | $Pt_{57.85}Cu_{21.65}P_{19.5}B_1$ | 85.0 | 436.5 ± 1.0 |

TABLE 15-continued

Vickers hardness of sample metallic glasses according to embodiments of the disclosure.

| Example | Composition | Pt wt. % | Vickers Hardness (Kgf/mm$^2$) |
|---|---|---|---|
| 45 | $Pt_{58.925}Cu_{20.575}Au_{0.5}P_{20}$ | 85.0 | 422.5 ± 2.5 |
| 32 | $Pt_{66.7}Cu_{7.8}Ag_2P_{23.5}$ | 90.0 | 398.6 ± 1.8 |
| 53 | $Pt_{59.35}Cu_{17.65}Ag_3P_{19}B_1$ | 85.0 | 427.0 ± 3.0 |
| 60 | $Pt_{58.3}Cu_{20.2}Ag_1P_{19.5}B_1$ | 85.0 | 435.1 ± 1.5 |
| 65 | $Pt_{57.5}Cu_{20.45}P_{20.9}B_{1.15}$ | 85.1 | 438.7 ± 2.1 |
| 72 | $Pt_{57.9}Cu_{18.9}Ag_{1.2}P_{20.6}B_{1.4}$ | 85.1 | 436.1 ± 1.3 |
| 9 | $Pt_{55}Cu_{25}P_{19}B_1$ | 83.1 | 445.7 ± 2.2 |
| 75 | $Pt_{52.5}Cu_{27}P_{19.5}B_1$ | 81.5 | 461.2 ± 2.3 |
| 76 | $Pt_{52.5}Cu_{26}Ag_1P_{19.5}B_1$ | 81.2 | 460.0 ± 1.7 |

Description of Methods of Processing the Ingots of the Sample Alloys

A method for producing the alloy ingots involves inductive melting of the appropriate amounts of elemental constituents in a quartz tube under inert atmosphere. The purity levels of the constituent elements were as follows: Pt 99.99%, Pd 99.95%, Au 99.99%, Ag 99.95%, Cu 99.995%, Ni 99.995%, Co 99.995, P 99.9999%, and B 99.5%. The melting crucible may alternatively be a ceramic such as alumina or zirconia, graphite, sintered crystalline silica, or a water-cooled hearth made of copper or silver. In some embodiments, P can be incorporated in the alloy as a pre-alloyed compound formed with at least one of the other elements, like for example, as a Pt—P or a Cu—P compound.

Description of Methods of Processing the Sample Metallic Glasses

A particular method for producing metallic glass rods from the alloy ingots for the sample alloys involves remelting the alloy ingots in quartz tubes having 0.5-mm thick walls in a furnace at 850° C. under high purity argon and rapidly quenching in a room-temperature water bath. In some embodiments, the melt temperature prior to quenching is between 750 and 1200° C., while in other embodiments it is between 800 and 950° C. In some embodiments, the bath could be ice water or oil. In other embodiments, metallic glass articles can be formed by injecting or pouring the molten alloy into a metal mold. In some embodiments, the mold can be made of copper, brass, or steel, among other materials.

Description of Methods of Fluxing the Ingots of the Sample Alloys

Optionally, prior to producing a metallic glass article, the alloyed ingots may be fluxed with a reducing agent. In one embodiment, the reducing agent can be dehydrated boron oxide ($B_2O_3$). A particular method for fluxing the alloys of the disclosure involves melting the ingots and $B_2O_3$ in a quartz tube under inert atmosphere at a temperature in the range of 750 and 900° C., bringing the alloy melt in contact with the $B_2O_3$ melt and allowing the two melts to interact for about 1000 s, and subsequently quenching in a bath of room temperature water. In some embodiments, the melt and $B_2O_3$ are allowed to interact for at least 500 seconds prior to quenching, and in some embodiments for at least 2000 seconds. In some embodiments, the melt and $B_2O_3$ are allowed to interact at a temperature of at least 700° C., and in other embodiments between 800 and 1200° C. In yet other embodiments, the step of producing the metallic glass rod may be performed simultaneously with the fluxing step, where the water-quenched sample at the completion of the fluxing step represents the metallic glass rod.

The glass forming ability of the ternary Pt—Cu—P alloys, quaternary Pt—Cu—P—B alloys (Table 1 and FIG. 1), and quinary Pt—Cu—Ni—P—B, Pt—Cu—Ag—Ni—P and Pt—Cu—Co—P—B alloys (Tables 9, 10 and 11 and FIGS. 18, 20 and 22) was obtained by performing $B_2O_3$ fluxing as an intermediate step between the steps of producing the alloy ingots and the step of producing the metallic glass rods. The glass forming ability of all other alloys was determined in the absence of fluxing, where the step of producing the alloy ingot was followed by the process of producing the metallic glass rod.

Test Methodology for Assessing Glass-Forming Ability by Tube Quenching

The glass-forming ability of the alloys were assessed by determining the maximum rod diameter in which the amorphous phase of the alloy (i.e. the metallic glass phase) could be formed when processed by the method of water-quenching a quartz tube containing the alloy melt, namely water quenching a quartz tube having 0.5 mm thick walls containing the molten alloy. X-ray diffraction with Cu-Kα radiation was performed to verify the amorphous structure of the quenched rods.

Test Methodology for Assessing Glass-Forming Ability by Mold Casting

The glass-forming ability of the alloys were assessed by determining the maximum plate thickness in which the amorphous phase of the alloy (i.e. the metallic glass phase) could be formed when processed by casting in copper mold. Mold casting was performed in a vacuum induction melter using sintered crystalline silica crucible (binder matrix consists of Na, K, Ca, and TI). An argon atmosphere is established in the melting chamber by cycling vacuum 5 times between −1 bar and 0 bar, and finally backfilling with argon at −0.7 bar pressure. The alloy contained in the crucible is heated inductively to the molten state at temperature of 900° C., and subsequently cooled to 620° C. prior to being poured in a copper mold with a rectangular cross-section cavity. Multiple molds were used. All molds had rectangular cavities 22 mm in width, 60 mm in length, but each had a different cavity thickness in order to assess glass-forming ability. The external dimensions of the molds were 50 mm in thickness, 70 mm in width, and 80 mm in length. X-ray diffraction with Cu-Kα radiation was performed to verify the amorphous structure of the cast plates.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Test Methodology for Measuring Hardness

The Vickers hardness (HV0.5) of sample metallic glasses was measured using a Vickers microhardness tester. Eight tests were performed where micro-indentions were inserted on a flat and polished cross section of a 3 mm metallic glass rod using a load of 500 g and a duel time of 10 s.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy capable of forming a metallic glass comprising:

Pt having an atomic fraction in the range of 45 to 75 percent, where the weight fraction of Pt does not exceed 91 percent;

Cu having an atomic fraction in the range of 3 to 35 percent;

P having an atomic fraction in the range of 14 to 26 percent;

at least one additional element selected from the group consisting of Ag, Au, and B where the atomic fraction of the at least one additional element is in the range of 0.05 to 7.5 percent;

optionally Ni in an atomic fraction of less than 2 percent; and wherein the critical rod diameter of the alloy is at least 3 mm and wherein the solidus temperature of the alloy is greater than 477.6° C.

2. The alloy of claim 1, wherein the atomic fraction of Pt is in the range of 45 to 60 percent, the atomic fraction of Cu is in the range of 15 to 35 percent, the atomic fraction of P is in the range of 17 to 24 percent, and wherein the Pt weight fraction is at least 80.0 percent.

3. The alloy of claim 1, wherein the atomic fraction of Pt is in the range of 50 to 65 percent, the atomic fraction of Cu is in the range of 15 to 30 percent, the atomic fraction of P is in the range of 17 to 24 percent, and wherein the Pt weight fraction is at least 85.0 percent.

4. The alloy of claim 1, wherein the atomic fraction of Pt is in the range of 55 to 70 percent, the atomic fraction of Cu is in the range of 3 to 25 percent, the atomic fraction of P is in the range of 17 to 24 percent, and wherein the Pt weight fraction is at least 90.0 percent.

5. The alloy of claim 1, wherein the atomic fraction of the at least one additional element selected from the group consisting of Ag, Au, and B is in the range of 0.2 to 5 percent.

6. The alloy of claim 1, wherein the alloy also comprises at least one of Pd, Rh, and Ir, each in an atomic fraction of up to 5 percent.

7. The alloy of claim 1, wherein the alloy also comprises at least one of Si, Ge, Sb, Sn, Zn, Fe, Ru, Cr, Mo, and Mn, each in an atomic fraction of up to 3 percent.

8. A metallic glass comprising an alloy of claim 1.

9. An alloy capable of forming a metallic glass having a composition represented by the following formula (subscripts denote atomic percentages):

$$Pt_{(100-a-b-c-d-e)}Cu_aAg_bAu_cP_dB_e$$

where:

a ranges from 3 to 35;

b is up to 7.5;

c is up to 7.5;

d ranges from 14 to 26;

e is up to 7.5;

wherein at least one of b, c, and e is at least 0.05;

wherein the Pt weight fraction is between 74 and 91 percent; and wherein the critical rod diameter of the alloy is at least 3 mm.

10. The alloy of claim 9, where a ranges from 5 to 30, d ranges from 14 to 24, e ranges from 0.25 to 6; and the atomic percent of Pt ranges from 45 to 75 percent.

11. The alloy of claim 10, where the sum of d and e ranges from 19 to 24.

12. The alloy of claim 9, where a ranges from 5 to 30, b ranges from 0.25 to 7.5, d ranges from 15 to 25; and the atomic percent of Pt ranges from 45 to 75 percent.

13. The alloy of claim 9, where a ranges from 5 to 35, c ranges from 0.1 to 5, d ranges from 15 to 25; and the atomic percent of Pt ranges from 45 to 75 percent.

14. The alloy of claim 9, where a ranges from 16 to 23, d ranges from 19 to 23, e ranges from 0.25 to 3; and the Pt weight fraction is at least 85.0.

15. The alloy of claim 9, where a ranges from 19.5 to 21.5, d ranges from 20 to 22, e ranges from 1 to 1.5; and the Pt weight fraction is at least 85.0.

16. The alloy of claim 9, where a ranges from 16 to 23, b ranges from 0.1 to 5, d ranges from 19 to 23, e ranges from 0.25 to 3, and the Pt weight fraction is at least 85.0 percent.

17. The alloy of claim 9, where a ranges from 13 to 23, b ranges from 0.1 to 6, d ranges from 20 to 25, wherein the Pt weight fraction is at least 85.0 percent.

18. The alloy of claim 9, where a ranges from 4 to 13, b ranges from 0.1 to 4, d ranges from 20 to 25, and the Pt weight fraction is at least 90.0 percent.

19. The alloy of claim 9, where a ranges from 16 to 23, c ranges from 0.1 to 2.5, d ranges from 20 to 25, and the Pt weight fraction is at least 85.0 percent.

20. A metallic glass comprising an alloy of claim 9.

* * * * *